United States Patent [19]

Onishi et al.

[11] Patent Number: 4,781,221

[45] Date of Patent: Nov. 1, 1988

[54] MISPICKED WEFT YARN REMOVING METHOD AND SYSTEM THEREFOR

[75] Inventors: Kimimasa Onishi, Hachioji; Takatsugu Kato; Kenichi Iwatani, both of Tokyo; Miyuki Gotoh, Machida; Eiji Ichimatsu, Tokyo, all of Japan

[73] Assignee: Nissan Motor Co., Ltd., Yokohama, Japan

[21] Appl. No.: 879,319

[22] Filed: Jun. 27, 1986

[30] Foreign Application Priority Data

Jun. 29, 1985 [JP] Japan ..... 60-141570
Sep. 11, 1985 [JP] Japan ..... 60-201082
Sep. 11, 1985 [JP] Japan ..... 60-199487

[51] Int. Cl.[4] ..... D03D 51/00; D03D 49/00; D03D 47/30; D03D 47/36

[52] U.S. Cl. ..... 139/116; 139/1 E; 139/336; 139/435; 139/452

[58] Field of Search ..... 139/1 E, 1 R, 452, 435, 139/336, 370.2, 370.1, 116

[56] References Cited

U.S. PATENT DOCUMENTS 4,444,226 4/1984 Ichikawa et al. ..... 139/452
4,502,512 3/1985 Suzuki et al. ..... 139/435
4,520,849 6/1985 Suzuki et al. ..... 139/435
4,534,387 8/1985 Van Hest ..... 139/435
4,559,976 12/1985 Araki et al. ..... 139/452
4,635,686 1/1987 Terasaki ..... 139/116
4,711,273 12/1987 Kato et al. ..... 139/435
4,730,643 3/1988 Tamatani ..... 139/116

FOREIGN PATENT DOCUMENTS 59-32577 8/1984 Japan .
216949 12/1984 Japan ..... 139/116
59-228047 12/1984 Japan .

*Primary Examiner*—Philip R. Coe
*Assistant Examiner*—Joseph S. Machuga
*Attorney, Agent, or Firm*—Foley & Lardner, Schwartz, Jeffery, Schwaab, Mack, Blumenthal & Evans

[57] ABSTRACT

A method of removing a mispicked weft yarn when a mispick occurs in a loom. The operation of the loom in a state where the mispicked weft yarn is connected to weft inserting means after the mispicked weft yarn is beaten up by a reed. The mispicked weft yarn is exposed at the cloth fell of a woven cloth. A weft yarn connected to the mispicked weft yarn is inserted from a weft picking side to a counter-weft picking side of the loom. The inserted weft yarn is drawn together with the mispicked weft yarn to the counter-weft picking side, thereby effectively peeling off the mispicked weft yarn from the cloth fell.

54 Claims, 48 Drawing Sheets

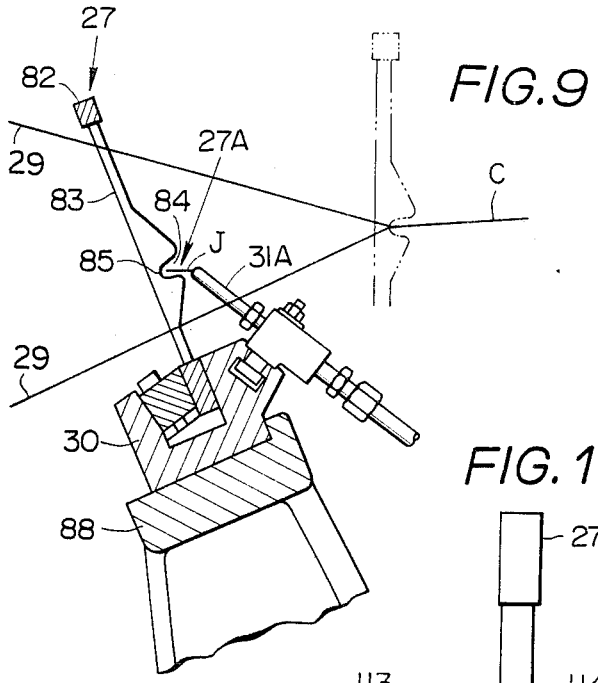
FIG. 9
FIG. 10
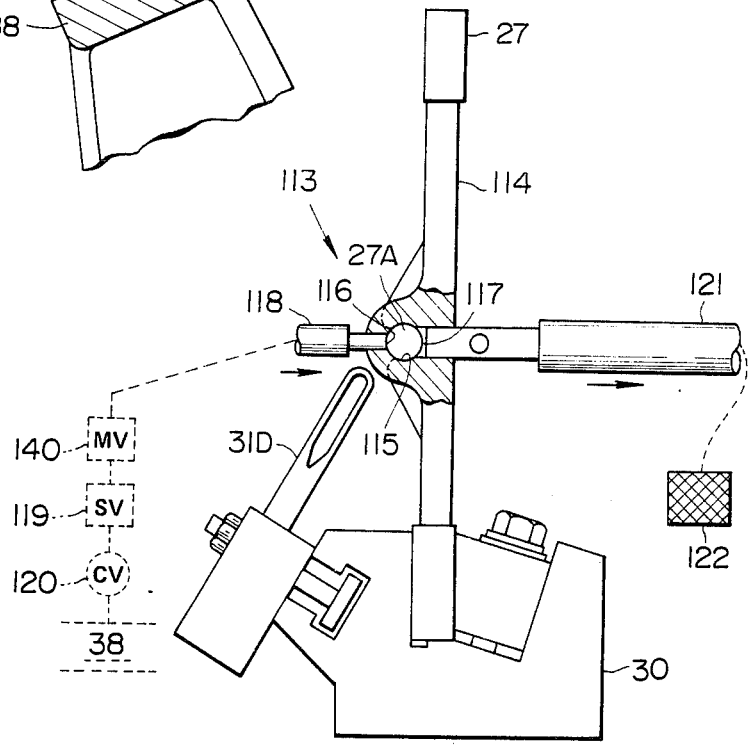

MISPICKED WEFT YARN REMOVING METHOD AND SYSTEM THEREFOR

BACKGROUND OF THE INVENTION

1. Field of the Invention

The present invention relates to an improvement in operation of a loom and a system therefor, and more specifically to a method for removing a mispicked weft yarn and a system accomplishing the same in which the mispicked weft yarn after being beaten up is exposed at cloth fell upon stopping the operation of the loom thereby to remove the mispicked weft yarn.

2. Description of the Prior Art

A variety of methods for removing a mispicked weft yarn have been hitherto proposed. One of these methods is carried out as follows: First cutting operation is stopped at the timing of weft yarn cutting after beating-up of a mispicked weft yarn. Then the operation of the loom is stopped in a state where the mispicked weft yarn is connected to a weft inserting nozzle. Thereafter, the mispicked weft yarn upon being exposed at a cloth fell is drawn to a weft picking side while forcing a mispicked weft yarn removing member into between the mispicked weft yarn and the cloth fell of a woven cloth thereby to facilitate removing the mispicked weft yarn from the cloth fell.

However, difficulties have been encountered in the above mispicked weft yarn removing method in which the mispicked weft yarn and the weft yarn connected thereto is liable to cut when being drawn to the weft picking side, for the following reasons. A greater tension is applied to the mispicked weft yarn drawn to the weft picking side since drawing resistances from the respective portions (engaged with warp yarns) of the mispicked weft yarn are totalled to produce the above-mentioned tension when the weft yarn is drawn to the weft picking side. It will be understood that beating-up by a reed causes the weft yarn to securely engage with the warp yarns. Furthermore, the above-mentioned mispicked weft yarn removing member may be caught by the warp yarn, thereby causing warp yarn cutting.

SUMMARY OF THE INVENTION

Mispicked weft yarn removing method and system of the present invention functions as follows (as illustrated in FIG. 2): First the operation of the loom is stopped in a state where a mispicked weft yarn M is connected to weft inserting means, after the mispicked weft yarn M is beaten up against the cloth fell C1 of a woven cloth. Subsequently, the mispicked weft yarn M is exposed at the cloth fell. Thereafter, a weft yarn W connected to the mispicked weft yarn is inserted from the weft picking side to the counter-weft picking side of the loom as indicated by 1 in FIG. 2. The thus inserted weft yarn W is drawn together with the mispicked weft yarn M to the counter-weft picking side as indicated by 2 in FIG. 2. Such drawing of the inserted weft yarn W and the mispicked weft yarn M is accomplished maintaining the V-shape as clearly shown in FIG. 2, in which the mispicked weft yarn M is peeled off from the cloth fell C1 as indicated by dot-dash lines in FIG. 2, and effectively removed from the woven cloth. Since such peeling-off operation of the mispicked weft yarn M is carried out successively for respective warp yarns Y, the tension applied to the drawn mispicked weft yarn results from a drawing resistance from each warp yarn.

Thus, according to the present invention, the totalled drawing resistances from the respective warp yarn cannot be applied as tension to the mispicked weft yarn drawn to the counter-weft picking side, thereby reducing the tension applied to the mispicked weft yarn. This prevents the mispicked weft yarn and the connected weft yarn from cutting. Additionally, the mispicked weft yarn removing member to be used in the conventional mispicked weft yarn removing method becomes unnecessary, thereby preventing warp yarn cutting due to the fact the removing member is caught by the warp yarn.

BRIEF DESCRIPTION OF THE DRAWINGS

FIG. 9 is a cross-sectional view taken in the direction of arrows substantially along the line 9—9 of FIG. 8;

FIG. 10 is a side view, partly in section, of a weft traction device of the loom of FIG. 3;

FIGS. 19A to 26 are schematic illustrations showing the process of the mispicked weft yarn removing method of FIGS. 15 to 18;

DETAILED DESCRIPTION OF THE INVENTION

Figure 1:
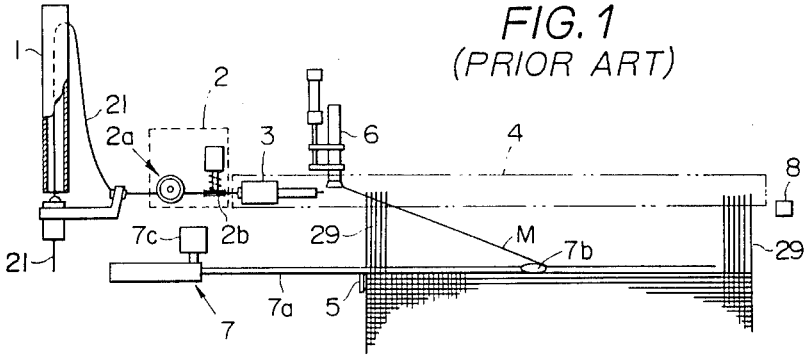
FIG. 1 (PRIOR ART)
FIG. 1 is a schematic illustration of a conventional mispicked weft yarn removing system in a loom.

To facilitate understanding the present invention, a brief reference will be made to a conventional method of removing a mispicked weft yarn from a loom (air jet loom) whose essential part is fundamentally shown in FIG. 1. Referring to FIG. 1, the loom consists of a yarn storage pipe 1 adapted to store therein a weft yarn 21 in a predetermined length, the weft yarn being fed through a weft yarn feeding section (not shown) and a length-measuring mechanism (not shown). The weft yarn 21 is introduced through a gripper device 2 into a weft inserting nozzle (referred hereinafter to as "main nozzle") 3 which is fixed to a sleigh 4 moved in a reciprocal swinging manner. The gripper 2 consists of a normally closed main gripper 2*a*, and a normally opened auxiliary gripper 2*b*. The reference numeral 5 denotes a weft cutting device for cutting the weft yarn 21 along the side edge on a weft picking side after the picked weft yarn is beaten up by a reed (not shown) on the sleigh 4.

A suction pipe 6 is provided to suck a mispicked weft yarn M on which a normal weft picking is not conducted. The suction pipe 6 is normally in a withdrawn position and adapted to project to the vicinity of the tip end section of the main nozzle thereby to suck the mispicked weft yarn M when the normal weft picking has not accomplished. Additionally, a mispicked weft yarn removing device 7 consists of a retractable belt 7*a* which is provided at its tip end with a mispicked weft yarn removing member 7*a*. The belt 7*a* is retractably driven by a drive section 7*c* so that the removing member 7*b* moves forward and backward along the cloth fell (not identified) of a woven cloth (not identified). The removing device 7 is so configurated that the belt 7*a* extends thereby to remove the mispicked weft yarn M from the cloth fell when weft picking is not normally conducted.

The above-described loom for carrying out the conventional mispicked weft yarn removing method operates as follows:

First air is ejected from the main nozzle 3 when weft picking timing comes close. Then the normally closed main gripper 2*a* is released when the weft picking timing has come. Accordingly the weft yarn 21 is projected from the main nozzle 3, making its flight to a counter-weft picking side through the inside of a warp shed thus to complete a weft picking. The thus picked weft yarn is beaten up against the cloth fell by the reed moved together with the sleigh 4, so that the warp yarns are in a closed-shed condition at this time. Subsequently when the reed initiates its backward movement, the weft cutting device 5 cuts the weft yarn 21 now beaten up against the cloth fell thereby to disconnect the picked weft yarn from the main nozzle 3. From this step, the locational relationship between the upper yarns and the lower yarns of the warp yarns 29 is reversed to form a next open warp shed.

Here, when a mispick more specifically a short pick occurs in which the tip end of the weft yarn 21 does not reach the counter-weft picking side, a weft detector 8 detects absence of the weft yarn and outputs a mispick signal. Then a control circuit (not shown) of the loom outputs a loom stopping command in response to the mispick signal thereby to stop loom operation at a predetermined stopping phase. This stopping phase is set in the vicinity of the timing of the maximum open warp shed, in which an inertial loom operation of about one loom operational or weaving cycle is carried out taking account of the operational inertial of the loom. Accordingly, during this inertial loom operation, the mispicked weft yarn is beaten up by the reed and subsequently the next weft picking is conducted.

During the inertial loom operation, the weft cutting device 5 is temporarily made inoperative thereby to stop the cutting operation for the mispicked weft yarn M at the timing of weft cutting after beating-up so that this mispicked weft yarn M is allowed to be connected to the main nozzle 3. In this state, the suction nozzle 6 projects to the vicinity of the tip end section of the main nozzle 3 to suck the mispicked weft yarn M therein. Then, the mispicked weft yarn M is cut at a position between the main nozzle 3 and the suction nozzle 6 by another weft cutting device (not shown).

Thereafter, a reverse revolution is made in the loom so that the locational relationship between the upper yarns and the lower yarns of the warp yarns 29 is reversed to again make the maximum opened warp shed thereby exposing the mispicked weft yarn M at the cloth fell. During this loom reverse revolution, the main gripper *2a* of the gripper device 2 is released while carrying out air ejection from the main nozzle; however, the auxiliary gripper *2b* of the gripper device 2 is being closed so that the weft yarn 21 in the main nozzle 3 cannot be drawn out. When the mispicked weft yarn M is exposed at the cloth fell as described above, the belt *7a* of the weft separating device 7 advances so that the separating member *7a* is thrusted in between the woven cloth and the mispicked weft yarn M in a tensed state under suction of the suction pipe 6. Consequently, when the weft separating member *7b* reaches the side edge of the woven cloth on the counter-weft picking side with advance of the belt *7a*, the mispicked weft yarn M is completely sucked into the suction pipe, thus removing the mispicked weft yarn M from the woven cloth. Thereafter, the suction pipe 6 and the belt *7a* are restored to their withdrawn position with the result that the loom becomes in the condition where re-start is possible.

Thus, the conventional mispicked weft yarn removing method is summarized as follows: (1) Cutting of the mispicked weft yarn is stopped at timing of weft yarn cutting after beating-up of the mispicked weft yarn with the reed; (2) The operation of the loom is stopped in the state where the mispicked weft yarn is connected to the weft inserting nozzle (the main nozzle 3); and (3) The mispicked weft yarn in the state to be exposed at the cloth fell is pulled from the weft picking side, thus removing the mispicked weft yarn.

However, difficulties have encountered in the above-discussed conventional mispicked weft yarn removing method in which the mispicked weft yarn and the weft yarn connected to the mispicked weft yarn are liable to be cut when the mispicked weft yarn is pulled by the suction pipe 6. This is caused by the following reasons: Although the mispicked weft yarn is exposed, the mispicked weft yarn has been already beaten up with the reed and therefore is securely engaged with each warp yarn upon being entangled with the array of the warp yarns. When such a mispicked weft yarn is pulled out to the weft picking side, an excessive tension is applied to the mispicked weft yarn because of accumulated pulling resistances at a plurality of portions where the mispicked weft yarn is engaged with the warp yarns. Furthermore, the above-mentioned weft yarn separating device is necessary particularly in case of using fluffed spun yarn having a larger engaging force to the warp yarn or regenerated filament yarn having a lower tensile strength, in which the weft yarn separating member is caught by the warp yarn thereby resulting in warp yarn cutting.

Figure 2:
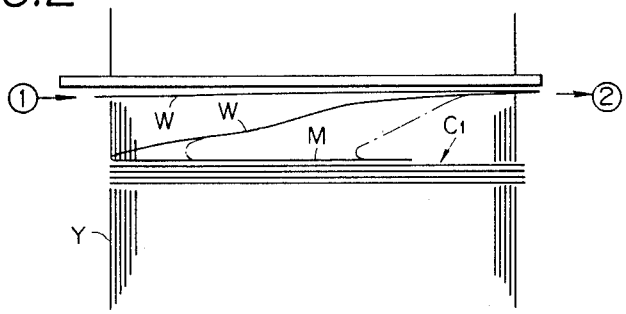
FIG. 2 is a schematic illustration showing the function of a picked weft yarn removing system in accordance with the present invention.

In view of the above description of the conventional picked weft yarn removing method, reference is now made to FIGS. 3 to 13, and more specifically to FIG. 2, wherein an air jet loom provided with a first embodiment of a mispicked weft yarn removing system in accordance with the present invention.

Figure 3:
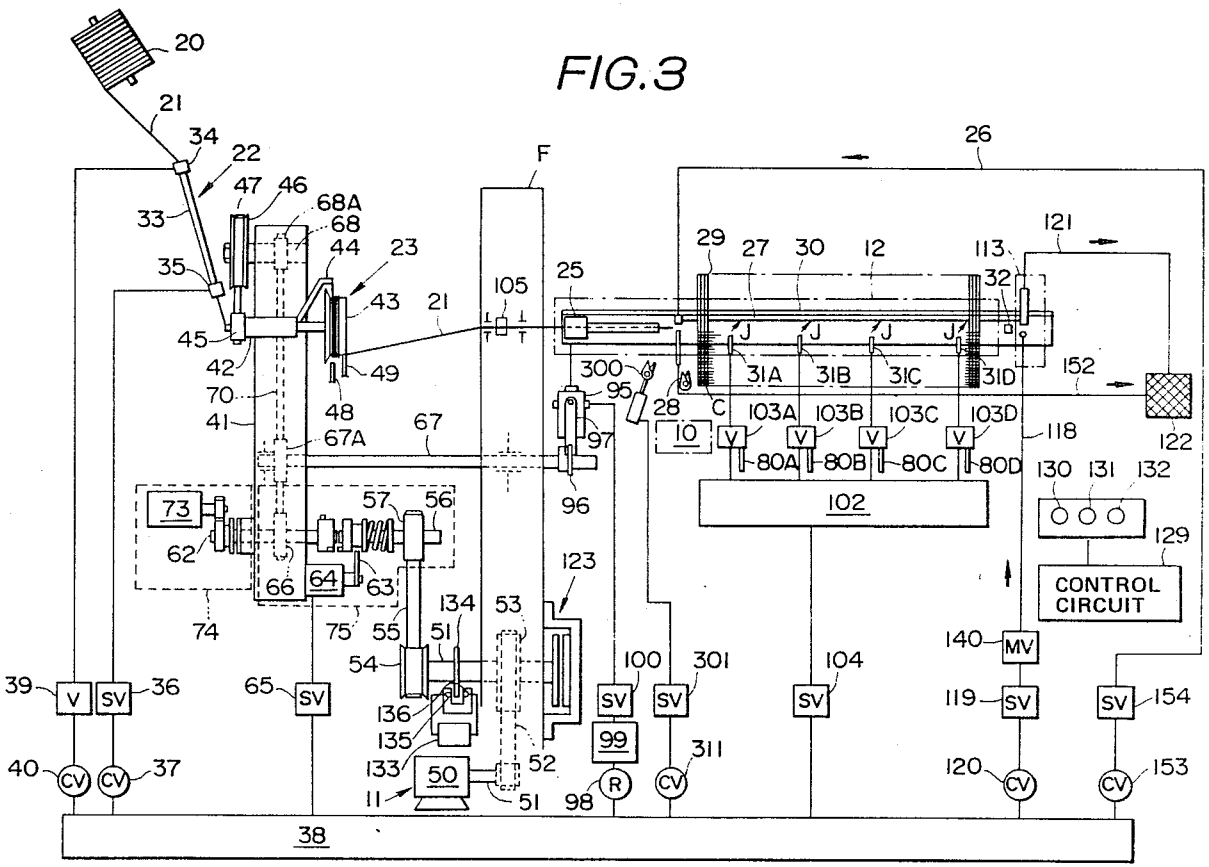
FIG. 3 is a schematic view of an essential part of an air jet loom provided with a first embodiment of a mispicked weft yarn removing system in accordance with the present invention.

As shown in FIG. 3, the air jet loom comprises a yarn supply package or bobbin 20 containing a weft yarn 21. The weft yarn 21 is passed through an air tensor 22 and thereafter fed to a weft measuring and reserving device 23. The weft yarn 21 from the weft measuring and reserving device 23 is introduced to a weft inserting nozzle (main nozzle) or weft inserting means 25 adapted to project the weft yarn into an air guide channel (not shown) defined by a reed 27 fixed to a reed holder 30. A cutter 28 is disposed between the main nozzle 25 and warp yarns 29. Auxiliary nozzles 31A, 31B, 31C, 31D are fixedly disposed at predetermined equal intervals to carry the weft yarn 21 projected from the main nozzle 25 along the air guide channel under traction force due to air jet from each auxiliary nozzle.

The air tensor 22 consists of a pipe 33 which is fixedly provided at its opposite end sections with nozzles 34, 35 adapted to eject pressurized air into the pipe 33. The nozzle 35 is communicated with a pressurized air supply source 38 through a solenoid valve 36 and a check valve 37. The solenoid valve 36 is adapted to open upon a starting preparation switch 130 being turned ON while to close upon interruption of electric current supply to a main motor 50 of the loom. The nozzle 34 is communicated with the pressurized air supply source 38 through a manually operated valve 39 and a check valve 40. Accordingly, during loom operation, pressurized air is ejected from the nozzle 35 toward the side of the nozzle 34 so that the weft yarn 21 is drawn from the side of the weft measuring and reserving device 23 thereby to apply a tension to the weft yarn 21. Upon opening of the manually operated valve 39, the nozzle 34 ejects pressurized air toward the side of the nozzle 35, so that the weft yarn 21 from the weft package 20 can be introduced and passed into the pipe 33.

The weft measuring and reserving device 23 consists of a hollow rotatable shaft 42 rotatably supported in a transmission case 41. A drum 43 is rotatably mounted on the tip end section of the rotatable shaft 42 and is maintained stationary by means of a magnet (not shown). A winding arm 44 is fixed to the rotatable shaft 42 and adapted to wind the weft yarn 21 around the drum 43. Additionally, a driven pulley 45 is fixedly mounted on the rotatable shaft 42 and adapted to be driven through a belt 47 passed on the pulleys 45 and 46 in a manner to be extended therebetween. Engaging members 48, 49 are movably disposed near the drum 43 for the purpose of measuring and reserving the weft yarn in a predetermined length required for one weft picking. The engaging member 49 is being engaged into the drum 43 to reserve the weft yarn 21 in the length for one pick or, for example, the length of four turns, on the drum behind (left in FIG. 3) the engaging member 49 until a weft picking timing comes. When weft picking timing has come, the engaging member 48 is engaged into the drum 43 at a position behind (left in FIG. 3) the reserved weft yarn while the engaging member 49 is withdrawn or disengaged from the drum 43, so that the weft yarn of the four turns is unwinded. In this case, such engagement of the engaging member 48, 49 is made by inserting the engaging member into an opening (not identified) formed in the drum 43, and such disengagement of the same is made by withdrawing the same from the opening of the drum 43. Such a weft measuring and reserving device 23 is disclosed, for example, in Japanese Patent Publication No. 59-32577.

Figure 4:
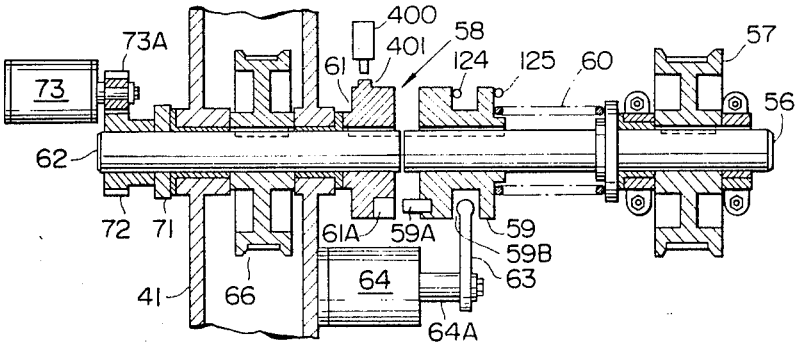
FIG. 4 is a vertical sectional view of an auxiliary drive mechanism and a clutch mechanism of the loom of FIG. 3.

A main motor 50 having a rotation reversing device 11 is provided to drive a main shaft 51 through a belt 52 and a pulley 53. The main shaft 51 drives a warp yarn system (not shown) including a warp shedding mechanism and a weft feeding mechanism, and drives a pulley 57 fixedly mounted on a driven shaft 56 through a pulley 54 and a belt 55. The transmission ratio between the pulleys 54, 57 is 1:1. The driven shaft 56 is connectable through a clutch mechanism 75 to a shaft 62 of an auxiliary drive mechanism 74. Here, the clutch mechanism 75 and the auxiliary drive mechanism 74 will be discussed in detail with reference to FIG. 4. As illustrated in FIG. 4, the driven shaft 56 is provided thereon with a clutch counterpart 59 having a projection 59A forming part of a one-position clutch 58. The clutch counterpart 59 is axially movably secured to the rotatable shaft 56 by means of a spline structure or the like in such a manner that the clutch counterpart 59 is rotatable together with the rotatable shaft 56 as a one-piece member and axially slidable. The clutch counterpart 59 is biased in the direction of the other clutch counterpart 61 by means of a compression spring 60. The clutch counterpart 61 has a groove 61A engageable with the projection 59A, and fixedly mounted on a shaft 62 which is rotatably supported by the transmission case 41. Accordingly, engagement of the projection 59A and the groove 61A causes the clutch counterparts 59, 61 to rotate as a one-piece member. The clutch counterpart 59 is arranged to be selectively put into a first position where the projection 59A engages with the groove 61A and into a second position where the projection 59A cannot engage with the groove 61A, by means of a shifter 63 inserted into a groove 59B of the clutch counterpart 59. The shifter 63 is fixedly mounted on an operating rod 64A of an air actuator 64. The air actuator 64 is communicated with the pressurized air supply source 38 through a solenoid valve 65 shown in FIG. 3. A gear 72 is mounted through an electromagnetic clutch 71 on an end section of the shaft 62. An auxiliary motor 73 fixed to the transmission case 41 has an output shaft (no numeral) on which a gear 73A is fixedly mounted to engage with the gear 72. Limit switches 124, 125 are provided to be contactable with the clutch counterpart 59 in such a manner that the limit switch 125 is turned ON when the projection 59A disengages from the groove 61A upon displacement of the clutch counterpart 59 rightward in FIG. 4 while the limit switch 124 is turned ON when the projection 61A engages with the groove 61A. A proximity switch 400 is fixedly disposed near the clutch counterpart 61 and so adapted as to be turned ON when an operation piece 401 approaches the switch 400, the operation piece projeting from the periphery of the clutch counterpart 61 at a predetermined position. Turning to FIG. 3, a pulley 66 is fixedly mounted on the shaft 62 of the auxiliary drive mechanism 74 and drivingly connected with pulleys 67A, 68A respectively fixedly mounted on shafts 67, 68 by means of a belt 70 passed on the pulleys 66, 67A, 68A. The pulley 46 is fixedly mounted on the shaft 68. The pulleys 66, 67A, 68A have the same diameter and therefore the transmission ratio among them is 1:1:1.

As illustrated in FIG. 3, the main nozzle 25 is fixed on the reed holder 30 and adapted to be supplied with pressurized air from the pressurized air supply source 38 through a pressure regulator 98, an air tank 99, a solenoid valve 100, and a control valve 95. The solenoid valve 100 is so arranged as to open in timed relation to turning-ON of a starting preparation switch 130 while to close in response to electric current supply interruption to the main motor 50. The control valve 95 is so arranged as to open and close at predetermined timings upon a control lever 97 being swingingly moved by a cam 96 fixedly mounted on the shaft 67. The auxiliary nozzles 31A–31D are fluidly connected to the pressurized air supply source 38 through a solenoid valve 104 like the solenoid valve 100, an air tank 102, and respective control valves 103A, 103B, 103C, and 103D each of which is adapted to open at a predetermined rotational angle of the main shaft 51 under operation of each cam 80A, 80B, 80C, 80D.

Figure 5A:
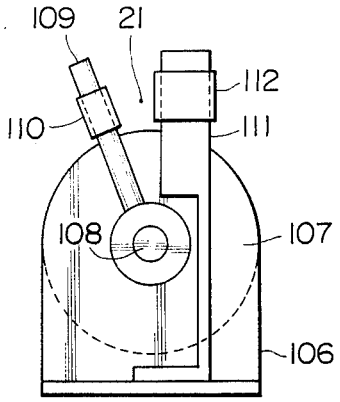
FIG. 5A to 5C are front and plan views of a weft brake of the loom of FIG. 3.
Figure 5B:
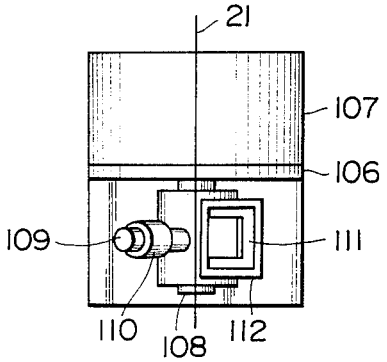
Figure 5C:
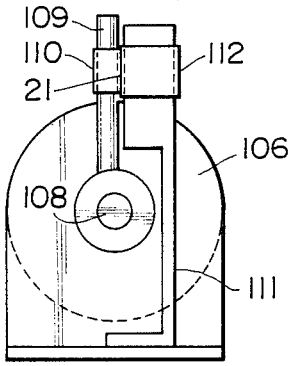

A weft brake or gripper 105 is provided to make grip and release actions to the weft yarn 21 at a position between the weft measuring and reserving device 23 and the main nozzle 25. The weft brake 105 is fixed to a loom frame F and has a detailed structure as shown in FIGS. 5A, 5B and 5C. As illustrated in FIGS. 5A to 5C, the weft brake 105 consists of a rotary solenoid 107 fixed to a bracket 106 standing on the frame F. The rotary solenoid 107 has its output shaft 108 on which a movable rod 109 is fixedly mounted. A pipe-shaped rubber piece 110 fits on the movable rod 109. A generally C-shaped fixed member 111 is fixed to the bracket 106 and located in a manner to surround the rotary solenoid output shaft 108. A pipe-shaped rubber piece 112 fits on the fixed member 111 and located to be contactable with the rubber piece 110 of the movable rod 109. Accordingly, energization of the rotary solenoid 107 causes the movable rod 109 to rotate toward the fixed member 111 so that the weft yarn 21 is pressed on the rubber piece 112 by the rubber piece 110.

Figure 6:
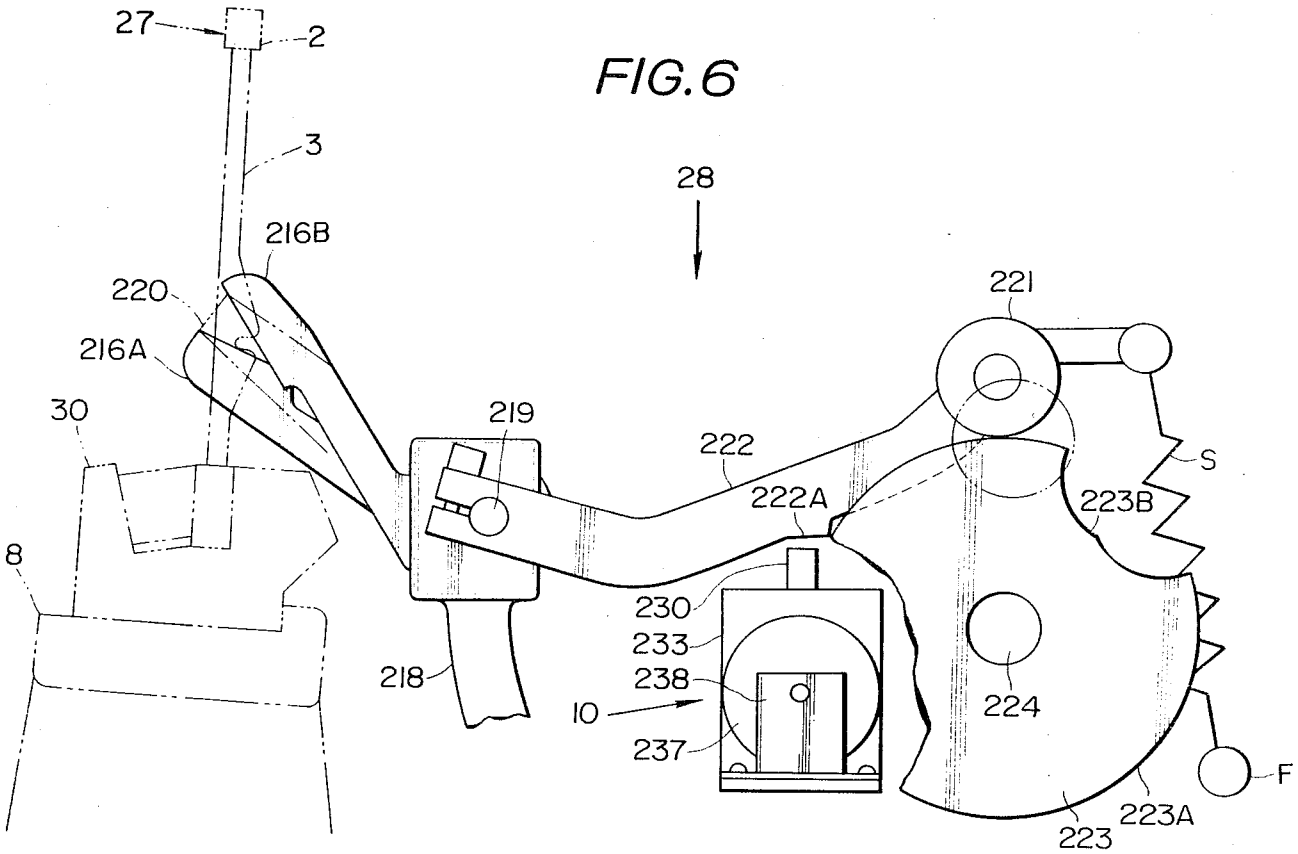
FIG. 6 is a front elevation of a weft cutter of the loom of FIG. 3.

The cutter 28 in FIG. 3 is shown in detail in FIG. 6. As illustrated in FIG. 6, a bracket 218 is fixed to the frame F. A movable blade 216 is fixed to a rotatable shaft 219 rotatably mounted in the bracket 218, while a fixed blade 216B is fixed to the side of the bracket 218. The movable and fixed blades 216A, 216B define therebetween a weft yarn receiving opening 220 through which the weft yarn 21 is passed. Accordingly, shearing action is made under clockwise rotation of the movable blade 216A. A drive lever 222 is fixedly mounted on the rotatable shaft 219 and provided at its tip end section with a cam follower 221. The cam follower 221 is brought into contact with a cam 223 by means of an extension spring S extended between the tip end section of the drive lever 222 and the frame F. The cam 223 is fixedly mounted on a rotatable shaft 224 which is rotatable in timed relation to the loom main shaft 51. The cam 223 is formed with a depressed section 223B which is so configurated that the abovementioned shearing action is made at the timing of 5 degrees in rotational angle of the main shaft 51 (beating-up with reed being at the timing of 0 degree). The cam 223 is also formed with a cam lobe section 223A.

Figure 7:
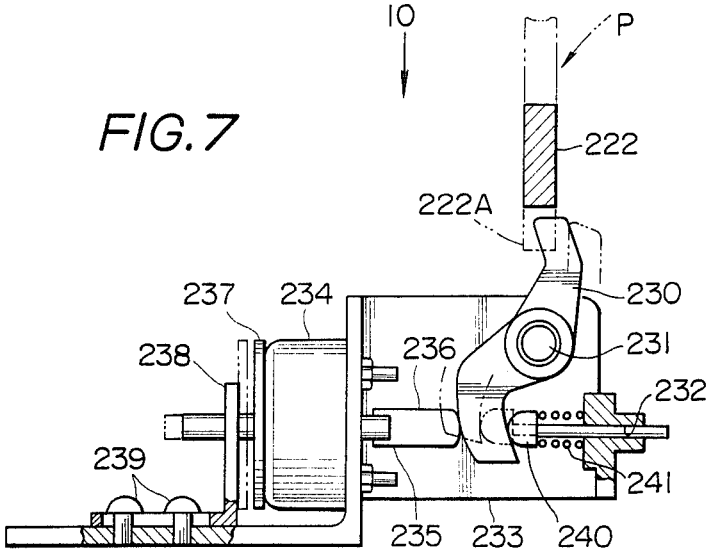
FIG. 7 is a front elevation of a cutter disabling device used in combination with the cutter of FIG. 6.

The cutter disabling device 10 is disposed under the drive lever 222 of the cutter 28 and illustrated in detail in FIG. 7. In FIG. 7, a fixed shaft 231 is located in the extension of a plane (region) P of rotational movement of the drive lever 222 of the cutter 28. A movement preventing member 230 is rotatably mounted on the fixed shaft 231 which fixed to a bracket 233 secured to the frame F. The upper end section of the movement preventing member 230 is formed so flat so to become parallel with the flat face of the contacting section 222A of the drive lever 222 when upon facing the contacting section flat face. The locational relationship between the movement interrupting member 230 and the lever 222 is so set that a slight clearance is formed therebetween when the cam follower 221 is in contact with the cam lobe section 223A. Disposed in contact with the lower section of the movement preventing member 230 is a pushing member 236 fixed to the tip end of the an armature 235 of an electromagnetic actuator 234. An engaging member 237 is fixed to the armature 235. The electromagnetic actuator 234 is fixed to the bracket 233. A stopper 238 is provided to restrict the displacement of the engaging member 237, and adjustably fixed to the bracket 233 by means of small screws 239. Disposed opposite to the pushing member 236 relative to the movement preventing member 230 is another pushing member 240 which slidably fits in an opening 232 of the bracket 233 and is being biased leftward in FIG. 7 by means of a compression spring 241 disposed between the head section of the pushing member 240 and the bracket 233. This biasing causes the movement preventing member 230 to rotate clockwise so that the upper end section of the movement preventing member 230 withdraws from the moving region (corresponding to the plane P) of the drive lever 222 thereby avoiding contact between the movement preventing member 230 and the drive lever 222. At this time, the engaging member 237 is brought into contact with the stopper 238, thereby preventing a further rotational movement of the movement preventing member 230. The biasing force of the compression spring 241 is weak enough to prevent the movement preventing member 230 from entering the moving region of the drive lever 222 under vibration and the like.

Figure 8:
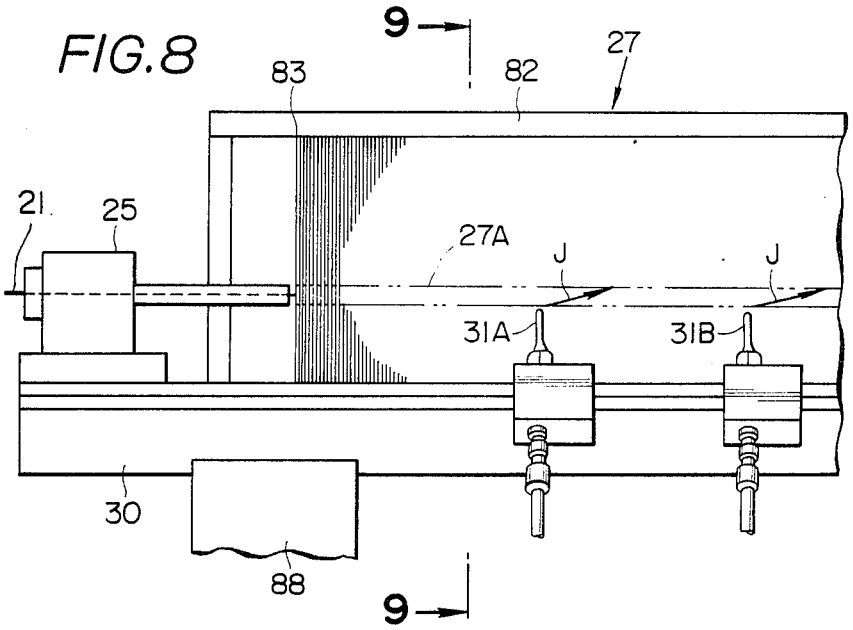
FIG. 8 is a front elevation of a weft picking device of the loom of FIG. 3.

As illustrated in FIG. 3, a weft carrying device 12 is provided to carry the weft yarn 21 projected from the main nozzle 25 with air jet to a counter-weft picking side. The counter-weft picking side is opposite to a weft picking side where the main nozzle 25 is disposed, with respect to an array of warp yarns 29. The detailed structure of the weft carrying device 12 is shown in FIGS. 8 and 9. As illustrated in FIGS. 8 and 9, the reed 27 consists of a reed frame 82 to which a plurality of reed blades 83 are fixed. Each reed blade 83 is formed at its front side (side of the cloth fell) with a projected plate section having a top part formed with a groove 84. The row of the grooves 84 constitutes the air guide channel 27A. The reed 27 is fixed to the reed holder 30 which is installed to a sleigh 88. The main nozzle 25 fixed to the reed holder 30 on the weft picking side is opened to the air guide channel 27A. The auxiliary nozzles 31A–31D are aligned at predetermined intervals in front of and along the air guide channel 27A. With this weft carrying device 12, when the weft picking timing has come, the weft yarn 21 is projected from the main nozzle 25 under the influence of air jet ejected from the main nozzle 25. Subsequently, auxiliary air is ejected from the auxiliary nozzle 31A located the nearest the main nozzle 25 to form an air jet stream J which is directed diagonally upward and toward the counter-weft picking side. A part of this air jet stream J escapes to the back side of the row of the reed blades 83, whereas the remaining part of the air jet stream J is guided toward the counter-weft picking side forming a relatively stable air flow stream in the vicinity of the bottom section of the air guide channel 27A upon being reflected on the bottom surface 85 of the groove 84 while being drawn by the air flow escaping to the back side of the reed blade row. Thus, the tip end section of the weft yarn 21 projected from the main nozzle 25 is carried by this air flow stream. At about the time when the tip end section of the weft yarn 21 reaches the vicinity of the succeeding auxiliary nozzle 31B, air jet is ejected from the auxiliary nozzle. Such weft carrying action is successively taken over by the succeeding auxiliary nozzle, thus accomplishing the weft picking of the weft yarn 21.

Turning back to FIG. 3, a traction device 113 for sucking the weft yarn 21 and a weft feeler 32 for detecting comming or reaching of the weft yarn 21 are provided on the counter-weft picking side to which the weft yarn 21 projected from the main nozzle 25 comes flying. The detailed structure of the traction device 113 is shown in FIG. 10. As illustrated in FIG. 10, a parent reed blade 114 located on the counter-weft picking side is formed with an air introduction opening 115 located in the extension of the air guide channel 27A. The parent reed blade 14 is further formed with an air ejection opening 116 through which air is ejected, and an air introduction opening 117 for receiving air ejected from the air ejection opening 116. The air ejection opening 116 and the air introduction opening 117 are so arranged that their axes are aligned with each other and that the air introduction opening 115 is located between them. The air ejection opening 116 is fluidly connectable with the pressurized air supply source 38 through a mechanical valve 140, a solenoid valve 119, and a check valve 120. The mechanical valve 140 is adapted to open at a predetermined timing. The air introduction opening 117 is communicated through an air introduction pipe 121 with a waste yarn receiver 122.

Figure 11:
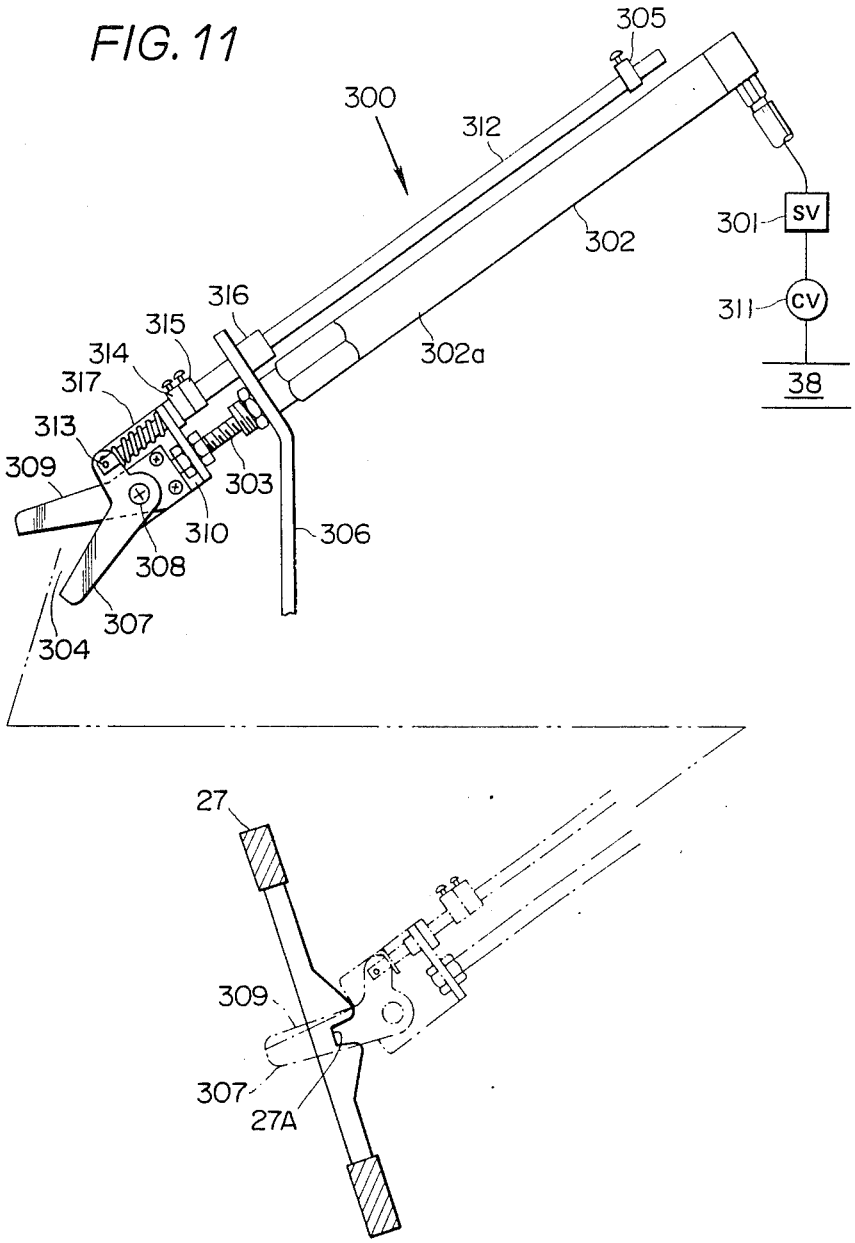
FIG. 11 is a side view of a mispicked weft yarn cutter of the loom of FIG. 3.

As shown in FIG. 3, a mispicked yarn cutter 300 is provided to cut a mispicked weft yarn upon advancing to the vicinity of the tip end section of the main nozzle 25. The detailed structure of the mispicked yarn cutter 300 is shown in FIG. 11. As illustrated in FIG. 11, the cutter 300 consists of an air actuator 302 secured to a bracket 306 fixed to the frame F. The air actuator 302 has a projectable rod 303 which retractable into a cylinder **302*a* and is provided at its tip end section with a bracket 310. A fixed blade 309 is secured to the bracket 310. A movable blade 307 is pivotally fixed to the bracket 310 by means of a pin 308 fixed to the bracket 310. The air actuator 302 is fluidly connectable with the pressurized air supply source 38 through a solenoid valve 301 and a check valve 311. A rod 312 is pivotally fixed to the upwardly projecting section of the movable blade 307 by means of a pin 313. The rod 312 passes through the bracket 306 in a manner to allow its slidable movement, and provided with stoppers 305, 314, 315 which are mounted on the rod 312 and secured in position with small screws. A cylindrical member 316 is fixed to the bracket 306 in such a manner that the rod 312 passes therethrough. A compression spring 317 is disposed between the movable blade 307 and the bent section of the bracket 310 thereby to bias the movable blade 307 to separate from the fixed blade 309. With the thus configurated cutter 300, during loom operation in which pressurized air is not supplied to the air actuator cylinder 302*a*, the projectable rod 303 is withdrawing in the cylinder 302*a* under the action of a spring (not shown) housed in the air actuator cylinder 302*a*, so that the bent section of the bracket 310 is brought into engagement with the stopper 314. Accordingly, the biasing force of the spring 317 causes the movable blade 307 to rotate counterclockwise thereby to form an opening 304. At this time, the cutter 300 is being located outside the swinging region of the the reed 27. When the cylinder 302*a* of the air actuator 302 is supplied with pressurized air, the rod 303 projects outside of the cylinder 302*a* and toward the side of the reed 27. At this time, the movable blade 307 is being rotated counterclockwise under the reaction of the spring 317 forming the opening 304 until the stopper 305 is brought into contact with the cylindrical member 316. The size of the opening 304 is set by selecting the location of the stopper 314 relative to the rod 303. When the stopper 305 is brought into contact with the cylindrical member 316 upon projecting of the rod 303, the rod 312 is prevented from its further advance, thereby causing the movable blade 307 to rotate clockwise. At this time, the weft yarn 21 is located within the opening 304 formed by the fixed and movable blades 307, 309. A further projection of the rod 312 allows the movable blade 307 to further rotate in the same direction, thus cutting the weft yarn 21 as shown by dot-dash lines in FIG. 11. The air actuator 302 is arranged such that projection of the rod 303 is stopped immediately after completion of this cutting action of the cutter 300. When the solenoid valve 301 is closed, the rod 303 moves back from the side of the reed 27. Together with this, the movable blade 307 is rotated counterclockwise until the stopper 14 is brought into contact with the bend section of the bracket 310 under the action of the spring 317. Subsequently, the cutter 300 moves back together with the rod 302 from the side of the reed 27**.

Figure 12:
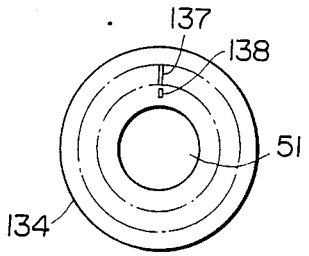
FIG. 12 is a front view of a disc rotatable with a main shaft of the loom of FIG. 3.

Turning back to FIG. 3, the main shaft 51 is provided coaxially with a disc 134 which is formed with a plurality of outer slits 137 and a inner slit 138 as shown in FIG. 12. The inner slit 138 is located at a position corresponding to the angular position of one of the outer slits 137. Additionally, light casting devices or projectors 135 and light receiving devices 136 are disposed in such a manner that the disc 134 is interposed therebetween. A pair of the projector 135 and the light receiving device 136 are provided for the outer slits 137, while another pair of the projector 135 and the light receiving device 136 are provided for the inner slit 138. An angle sensor 133 is adapted to detect a standard angle (0 degree) of the main shaft 51 in response to pulse signal output from the light receiving device 136 faceable with the slit 138, and a rotational angle of the main shaft 51 relative to the standard angle (0 degree) in response to pulse signal output from the-light receiving device 136 faceable to the outer slits 137.

A control circuit 129 includes a microcomputer (not identified) and arranged to control the solenoid valves 36, 65, 100, 104, 119, the electromagnetic clutch 71, the electromagnetic brake 123, the main motor 50, the auxiliary motor 73, and the weft brake 105 in response to ON and OFF signals from the starting preparation switch 130, a starting switch 131, and a stopping switch 132 operated by an operator, an angular signal (representing an angle) from the angle sensor 133, singles from the limit switches 124, 125, and the proximity switch 400, and existence or not of a weft detection signal (output when the weft yarn 21 reaches the counter-weft picking side) from the weft feeler 32.

Figure 13:
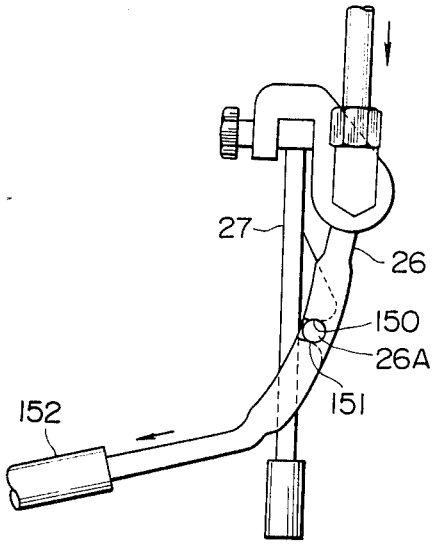
FIG. 13 is a side view of an air ejection pipe of the loom of FIG. 3.

An air ejection pipe 26 in FIG. 3 is shown in detail in FIG. 13 in which the pipe 26 is fixedly supported to the reed 27 and formed with a suction hole 26A located by the air guide channel 27A in such a manner that the suction hole 26A and the air guide channel 27A are coincident with each other as indicated in phantom. An ejection opening 150 is positioned upstream of the suction hole 26A, while a drawing opening 151 is positioned downstream of the suction hole 26A. The drawing opening 151 is communicated through a flexible pipe 152 with the waste yarn receiver 122. Additionally, the ejection opening 150 is communicated with the pressurized air supply source 38 through a solenoid valve 154 and a check valve 153.

Next, the manner of operation of the thus configurated loom will be discussed hereinafter.

Figure 14:
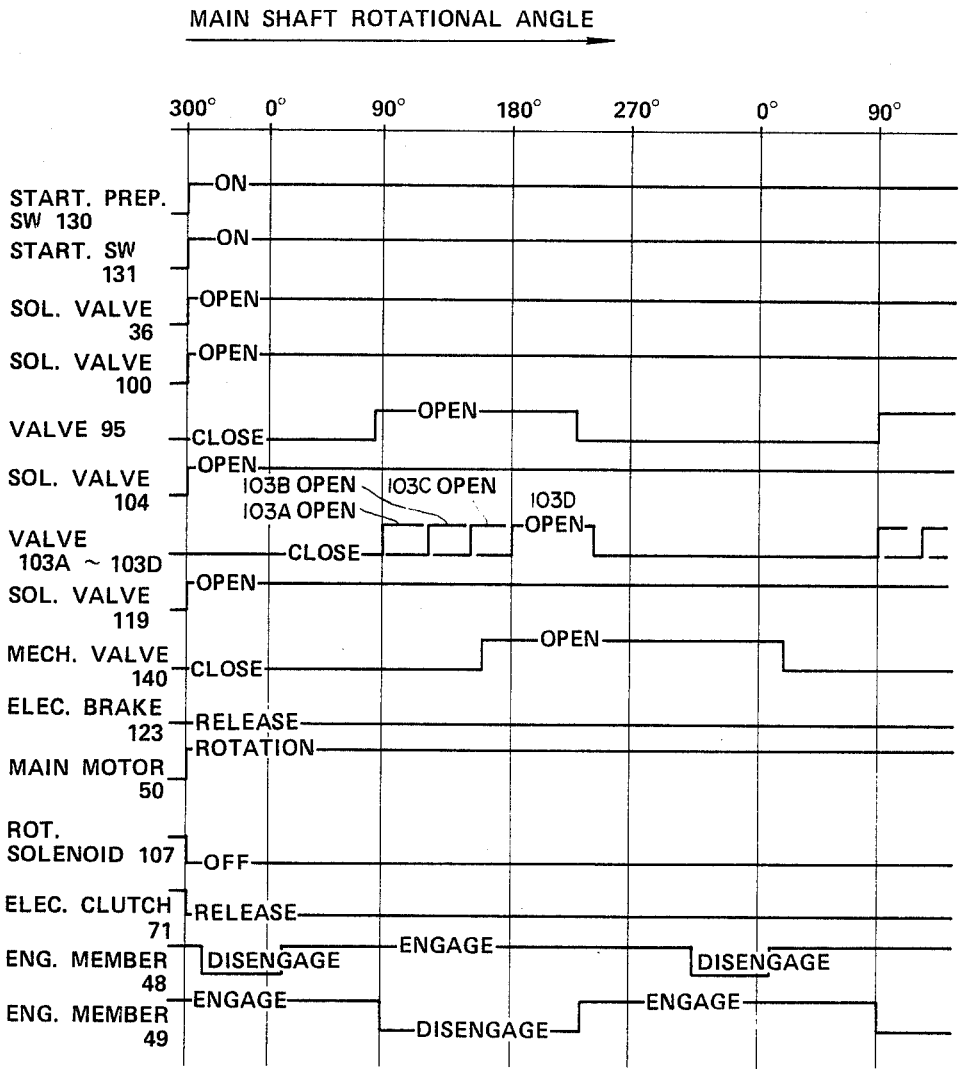
FIG. 14 is a diagram of a timing chart showing the operation timings of various devices and parts of the loom of FIG. 3.

First the basic or normal weaving operation will be discussed with reference to FIG. 14 showing a timing chart based on the rotational angle of the main shaft 51.

When the starting preparation switch 130 is turned ON by the operator, the following preparation operation is taken place: The solenoid valves 36, 100, 104, 119 are opened, the electromagnetic clutch 71 is released, and the rotary solenoid 107 is turned OFF, thereby applying a tension to the weft yarn 21 under the influence of air jet from the nozzle 35. Additionally, the movable rod 109 of the weft brake 105 becomes separate from the fixed piece 111 thereby to release the weft yarn 21 which has been put therebetween. In this state, the main shaft 51 is maintained in a position at an angle of 300 degrees. Subsequently, when the starting switch 131 is turned ON, the electromagnetic brake 123 is released while supplying the main motor 50 with electric current so that the operation of the loom is initiated.

During operation of the loom, the solenoid valve 65 is closed so that the projection 59A and the groove 61A engage with each other, thereby rendering the one-position clutch 58 in an engaged state. Accordingly, the main shaft 51 is rotated by the main motor 50, so that the warp yarn system is driven while the shaft 62 is driven to rotate. This causes the shafts 67, 68 to be driven to rotate. Upon rotation of this shaft 68, the rotatable shaft 42 rotates in timed relation to the main shaft 51, and accordingly the winding arm 44 initiates winding of the weft yarn 21 on the drum 43, so that the weft yarn 21 has been wound by an amount corresponding to one weft picking on the drum 43 between the engaging members 48, 49 by the timing of weft picking, thereby accomplishing length-measuring and reserving the weft yarn (by the timing of the vicinity of an angle of 90 degrees).

Immediately before the initiation of the weft picking, the valve 95 is opened thereby ejecting pressurized air from the main nozzle 25. Immediately after that time, the engaging member 49 gets out of the drum 43 so that the weft yarn 21 is projected from the main nozzle 25 under the influence of air jet ejected from the main nozzle 25. At this time, the valves 103A to 103D for the auxiliary nozzles 31A to 31D are successively opened in timed relation to the advance of the tip end section of the weft yarn 21, thereby ejecting air jet from the respective auxiliary nozzles. Under such operation of the auxiliary nozzles 31A to 31D, the weft yarn 21 flies toward the counter-weft picking side in the state to be guided along the aligned grooves 84 of the reed blades 83 (weft picking: a time period from the vicinity of an angle of 90 degrees to the vicinity of an angle of 230 degrees). When the weft yarn 21 thus flies and reaches a side edge of the woven cloth on the counter-weft picking side, the valve 95 is closed and simultaneously the mechanical valve 140 is opened immediately before an end section of the weft yarn 21 reserved on the drum 43 is brought into engagement with the engaging member 48, so that the tip end section of the weft yarn 21 which has already been passed into the air introduction opening 115 is blown in the introduction opening 117 under the influence of air ejected from the air ejection opening 116, thus accomplishing weft yarn traction. Immediately after weft picking, the engaging member 49 engages in the drum 43, in which the weft yarn traction continues in a state where the engaging member 48 has got out of the drum 43. This weft yarn traction continues until the beating-up with the reed takes place (for a time period from the vicinity of an angle of 230 degrees to the vicinity of an angle of 20 degrees). During the above-mentioned weft yarn traction, beating-up with the reed takes place in the angular position of 0 degrees of the main shaft 51. After beating-up with the reed, the picked weft yarn 21 is cut in the vicinity of an angular position of 5 degrees of the main shaft 51.

It will be understood that when the engaging member 49 engages in the drum 43 and immediately thereafter the engaging member 48 gets out of the drum 43, the weft yarn 21 required for one weft picking in the next cycle is wound by an amount corresponding to one weft picking on the drum 43; and thereafter the same operations as mentioned above will be repeated.

Assuming that a mispick occurs in a process where normal weaving operation is taking place, processing will be made according to the flow of flowcharts of FIGS. 15 to 18 by means of the control circuit 129.

Figure 15:
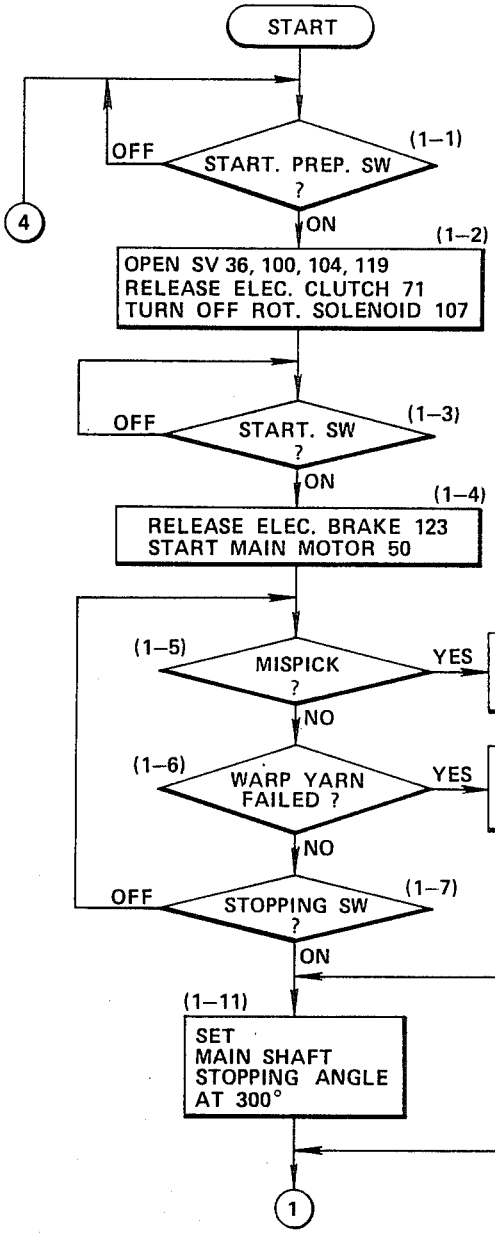
FIGS. 15 to 18 are flowcharts showing the flow of controlled operation of a picked weft yarn removing method in connection with the loom of FIG. 3.

As shown in FIG. 15, after performing controls (1-1, 1-2) relating to preparating operation and controls (1-3, 1-4) relating to loom starting, watching of mispick (1-5), watching of failure in warp yarn operation (1-6), and watching of ON-switching of the stopping switch 132 are performed (1-7). Here, assuming that the tip end section of the weft yarn 21 is caught by the warp yarn 29 thereby to cause a mispick, such a mispick is detected by the weft feeler 32 at the step of bearing-up by the reed, thus outputting mispick signal (1-8). This causes main shaft stopping angle (at which the main shaft 51 stops) to be set at an angle of 180 degrees in the succeeding weaving cycle (1-9).

Figure 16:
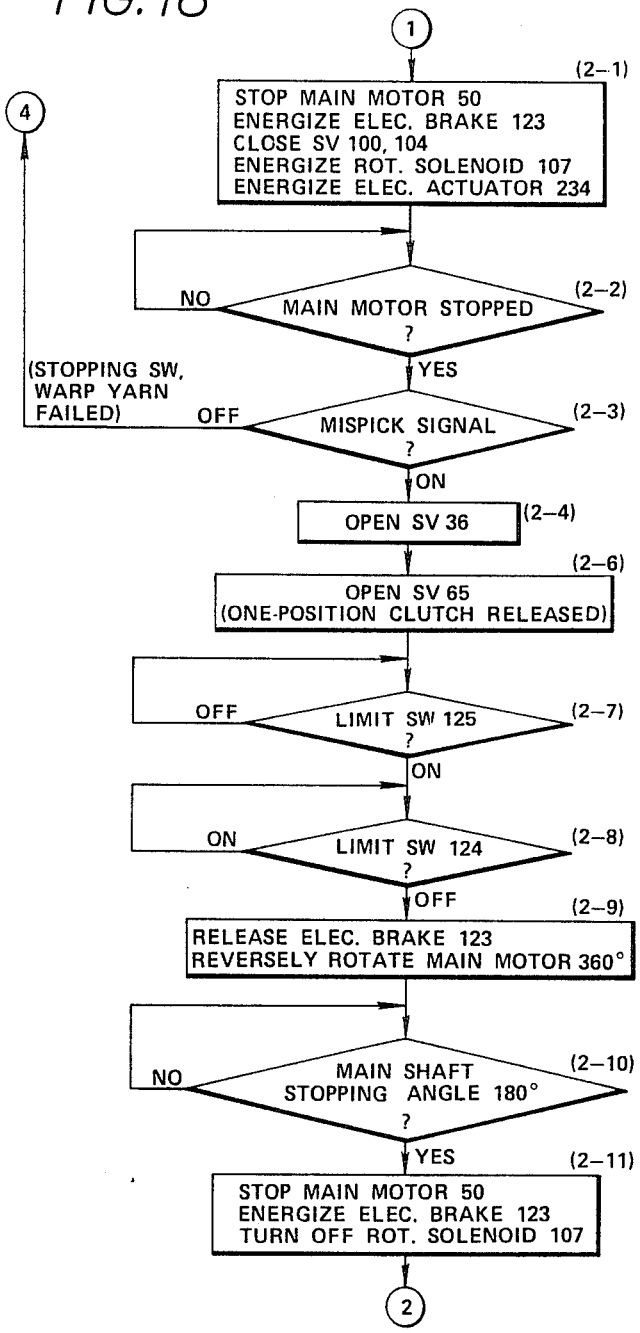

As shown in FIG. 16, the following controls are performed (2-1) in order to stop the main shaft 51 at the above-mentioned 180 degrees in consideration of inertial movement of the main shaft 51: control for stopping the main motor 50; control for energizing the electromagnetic brake 123; control for closing the solenoid valve 100, 104; control for energizing the rotary solenoid 107 in the weft brake device 105; and control for energizing the electromagnetic actuator 234 in the cutter disabling device 10. At this time, the weft brake device 105 is put into a state to grasp the weft yarn 21, and the cutter 28 becomes inoperative. At the main shaft stopping step according to the above-mentioned controls, the valve 95 and the 103A to 103D are opened so that pressurized air remaining in a piping between the solenoid valve 100 and the valve 95 and in a piping between the solenoid valve 104 and the valves 103A to 103D is ejected from the main nozzle 25 and from the auxiliary nozzles 31A to 31D. Additionally, the engaging member 49 gets out of the drum 43. However, the weft yarn 21 is prevented from picking under the grasping action of the weft brake device 105 against the weft yarn 21. Furthermore, the movable blade 218A of the cutter 28 does not rotate upon energization of the electromagnetic actuator 234.

Figures 19A, 19B:
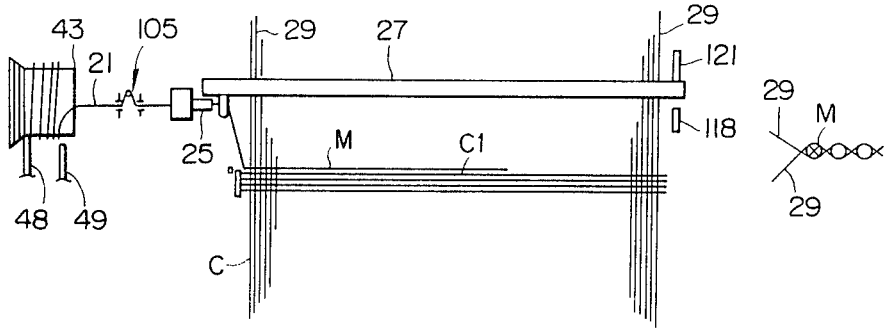

The main shaft 51 stops, so that the control circuit 129 recognizes the stopping of the main shaft 51 in accordance with the angular signal from the angle sensor 133 (2-2). At this stopping angle 180 degrees, the reed 27 is at the most-backward position relative to the cloth fell C1 so that the shed opening of the warp yarns 29 becomes the maximum, in which the mispicked weft yarn M is connected to the cloth fell (See FIGS. 19A and 19B).

When the control circuit 129 recognizes the stopping of the main motor 50, a judgement is made as to whether the cause of this stopping is mispick or not (2-3). Since the cause is the mispick, the solenoid valve 36 is closed (2-4) and thereafter the solenoid valve 65 is opened (2-6). Upon opening of the solenoid valve 65, the one-position clutch 58 is released, by which the limit switch 125 is turned ON while the other limit switch 124 is turned OFF, thus detecting change in state of the one-position clutch 58 (2-7, 2-8).

Figures 20A, 20B:
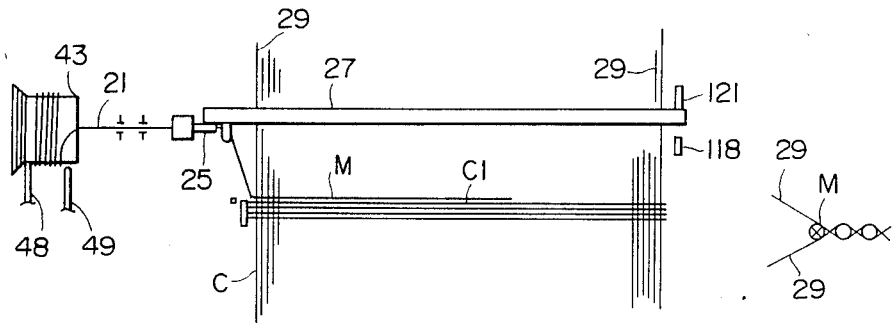

Subsequently, the electromagnetic brake 123 is released and additionally the main motor 50 is operated in reverse rotational direction to rotate an angle of 360 degrees (corresponding to one rotation of the main shaft 51) (2-9). Upon this reverse rotation of 360 degrees, the main shaft 51 is positioned at an angle of 180 degrees in the weaving cycle in which the mispick occurs. When this position is detected (2-10), electric current supply to the main motor 50 is stopped while energizing the electromagnetic brake 123 thereby to brake the main motor 50 (2-11). Simultaneously, the rotary solenoid 107 is turned OFF thereby to release the grasping action to the weft yarn 21 at the cloth fell under the above operation (See FIGS. 20A and 20B).

Figure 17:
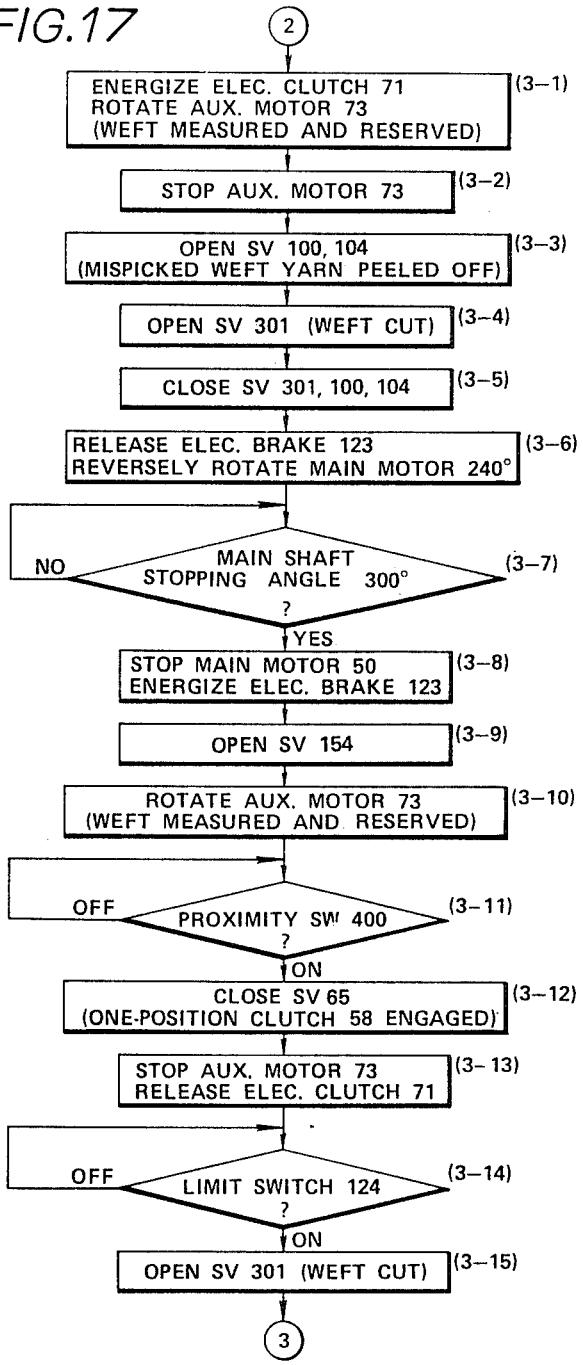
Figures 21A, 21B:
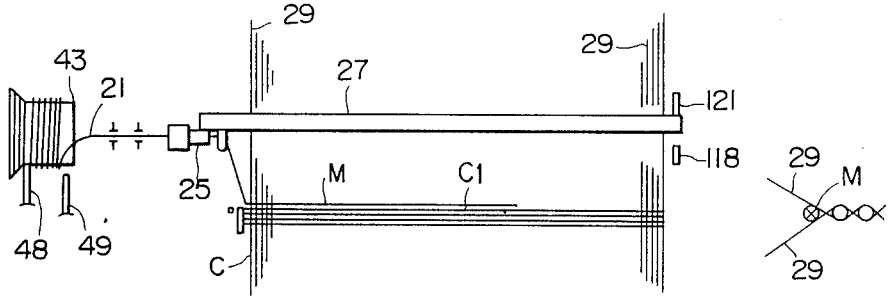
Figures 22A, 22B:
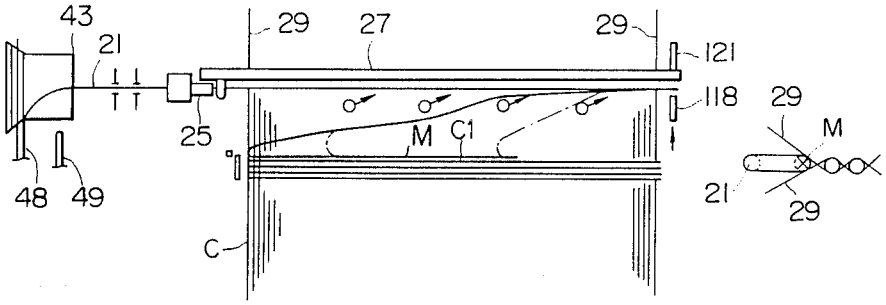
Figures 23A, 23B:
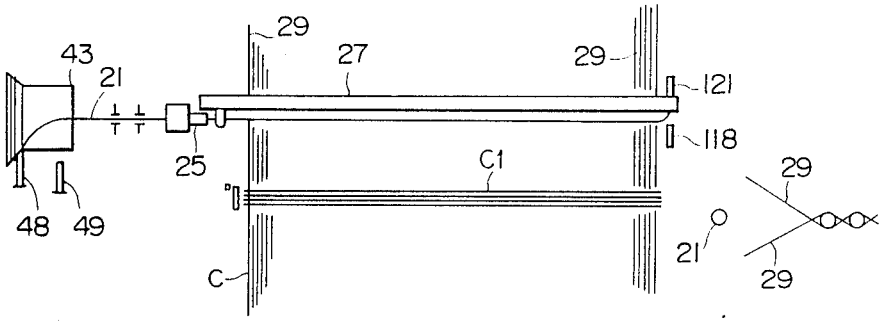
Figures 24A, 24B:
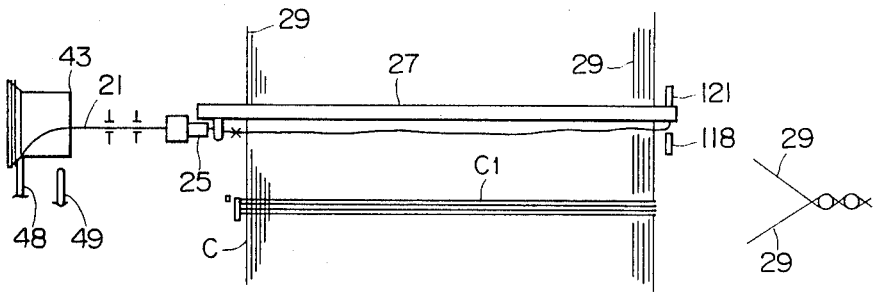

Next, as shown in FIG. 17, after the electromagnetic clutch 71 is energized, the auxiliary motor 73 is rotated (3-1) in such a manner as to reserve the weft yarn 21 in a length corresonding to two weft pickings on the drum 43. The length may be smaller than a length corresponding to two weft pickings. The rotation of the auxiliary motor 73 is stopped in a state where the engaging member 49 has got out of the drum 43 (3-2) (See FIGS. 21A and 21B). When the solenoid valves 100, 104 are opened (3-3) after the auxiliary motor 73 is stopped, the engaging member 49 has got out of the drum 43 and the valve 95 and the valves 103A to 103D have opened at the present stopping position (180 degrees) of the main shaft 51. Accordingly, the weft yarn 21 is projected into the shed opening of the warp yarns 29 in a state of being connected to the mispicked weft yarn M generally in the V-shape under the influence of air jet ejected from the main nozzle 25 and from the auxiliary nozzles 31A to 31D. Already in the preparation operation, the solenoid valve 119 has been opened and the mechanical valve 140 has been opened at the present stopping position (180 degrees) of the main shaft 51, so that the tip end section of the projected weft yarn 21 is subjected to air ejected from the ejection opening 116 and blown into the introduction opening 117 to be drawn from the counter-weft picking side (See FIGS. 22A and 22B). Such traction from the counter-weft picking side peels off the mispicked weft yarn M from the cloth fell successively in the direction from the weft picking side to the counter-weft picking side, so that the weft yarn 21 extends straight from the main nozzle 25 toward the introduction opening 117 (See FIGS. 23A and 23B). The opening of the solenoid valves 100, 104 continues for a sufficient time to peel off the mispicked weft yarn M from the cloth fell. It will be understood that the solenoid valves 100, 104 may be adapted to close when a detector (not shown) detects the fact that the mispicked weft yarn M has been peeled off. In the above-mentioned state, when the solenoid valve 301 is opened (3-4), the cutter 300 projects to the vicinity of the tip end section of the main nozzle 25, thus cutting the weft yarn 21 at a portion located near the tip end of the main nozzle 25. The cut weft yarn 21 disconnected from the main nozzle 25 is sucked into the introduction opening 117 and thereafter fed through the introduction pipe 121 into the waste yarn receiver 112 (See FIGS. 24A and 24B). Then, the solenoid valve 301 is closed thereby to be restored to its withdrawn position, and the solenoid valves 100, 104 are closed thereby to stop air ejection from the main nozzle 25 and from the auxiliary nozzles 31A to 31D (3-5).

Figures 25A, 25B:
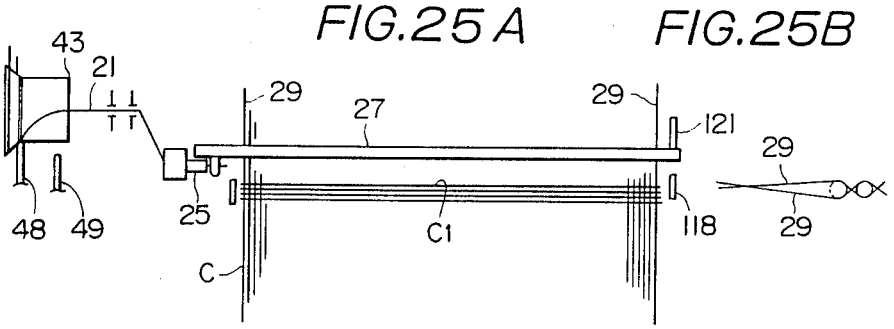

Thereafter, the electromagnetic brake 123 is released while making reverse rotation of the main motor 50 by an angle of 240 degrees (3-6) in such a manner that the rotational position of the main shaft 51 is brought into agreement with an angle of 300 degrees (the angular position at which the loom starts) in the weaving cycle just previous the cycle where the mispick has occured (3-7). Then, electric current supply to the main motor 50 is stopped and additionally the electromagnetic brake 123 is energized to stop the operation of the main motor 50 (308) (See FIGS. 25A and 25B).

Subsequently, after the solenoid valve 154 is opened (3-9), the auxiliary motor 73 is rotated thereby to reverse the weft yarn 21 on the drum 43 (3-10). At the timing where the rotational angle of the clutch counterpart 61 has exceeded 300 degrees, the proximity switch 400 is turned ON. At this timing (3-11), the solenoid valve 65 is closed (3-12). This solenoid valve closing causes the shifter 63 of the air actuator 64 to move leftward in FIG. 4, thereby putting the one-position clutch 58 into its engageable state. However, the one-position clutch 58 is arranged to engage only at the angle of 300 degrees as discussed above. Accordingly, the one-position clutch 58 has not yet engaged since the clutch counterpart 61 exceeds 300 degrees, so that the auxiliary motor 73 further rotates in which the clutch counterparts 61, 59 are in sliding contact with each other. At 300 degrees in the next rotation, the projection 59A is brought into engagement with the groove 61A, so that the auxiliary motor 73 is compulsorily stopped under the action of mechanical load on the side of the main shaft 51. Immediately after this, the electromagnetic clutch 31 is turned OFF to take its released state, and additionally electric current supply to the auxiliary motor 73 is stopped (3-13). At this stage, the rotational torque of the clutch counterpart 59 is lost and then the clutch counterpart 59 further moves leftward so that the projection 59A and the groove 61A are brought into complete engagement with each other, thereby allowing the limit switch 124 to be turned ON.

Now, the engaging members 48, 49 engage in and get out of the drum 43 at predetermined timings, in which the weft yarn 21 will be projected from the main nozzle 25 upon getting-out of the engaging member 49. At this time, the weft yarn 21 stands ready for picking in a tensed state upon being sucked into the introduction pipe 152 under the action of air ejected from the ejection pipe 26. When the limit switch 124 is turned ON (3-14), the solenoid valve 301 is opened (3-15), the weft yarn in the above-mentioned tensed state is cut by the cutter 300 in the same manner as discussed above.

Figure 18:
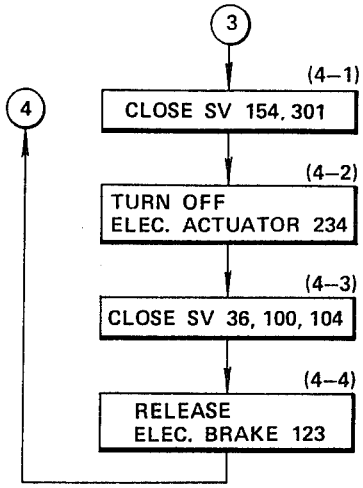
Figure 26:
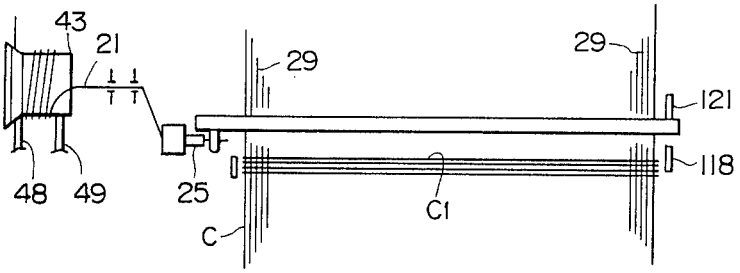

Thereafter, as shown in FIG. 18, the solenoid valves 154, 301 are closed (4-1) to complete the preparation of the weft picking (See FIG. 26). Then, the electromagnetic actuator 234 of the cutter disabling device 10 is turned OFF (4-2) and the movement preventing member 230 is withdrawn from the swinging or moving region of the drive lever 222, thereby putting the cutter 28 in a condition to be able to make its shearing action. After the preparation of loom starting is completed upon opening of the solenoid valves 36, 100, 104 (4-3), the electromagnetic brake 123 is released (4-4), so that the control circuit 129 becomes into the watching state for the starting preparation switch 130 at the step (1-1) of FIG. 15. In this state, the loom is put in the state to be able to re-start.

Turning to the flow of FIG. 15, the control circuit 129 outputs a warp yarn failure signal (1-10) to set the stopping angle of the main shaft 51 to 300 degrees (1-11) in case where the control circuit 129 detects warp yarn failure (1-6). Additionally, the main shaft stopping angle is also set at 300 degrees (1-11) in case where ON-switching of the stopping switch 132 is detected (1-7). Thereafter, the flow is restored through the steps 2-1, 2-2 and 2-3 in FIG. 16 to the step 1-1 in FIG. 15.

As discussed above, according to this mispicked weft yarn removing method, the weft yarn 21 is formed generally into the V-shape and gradually drawn from the counter-weft picking side, in which the mispicked weft yarn is connected to the thus drawn weft yarn 21. Accordingly, the mispicked weft yarn M can be peeled off from the cloth fell with a smaller resistance, so that the tension applied to the mispicked weft yarn M is smaller, thus effectively preventing weft yarn cutting.

Figure 27:
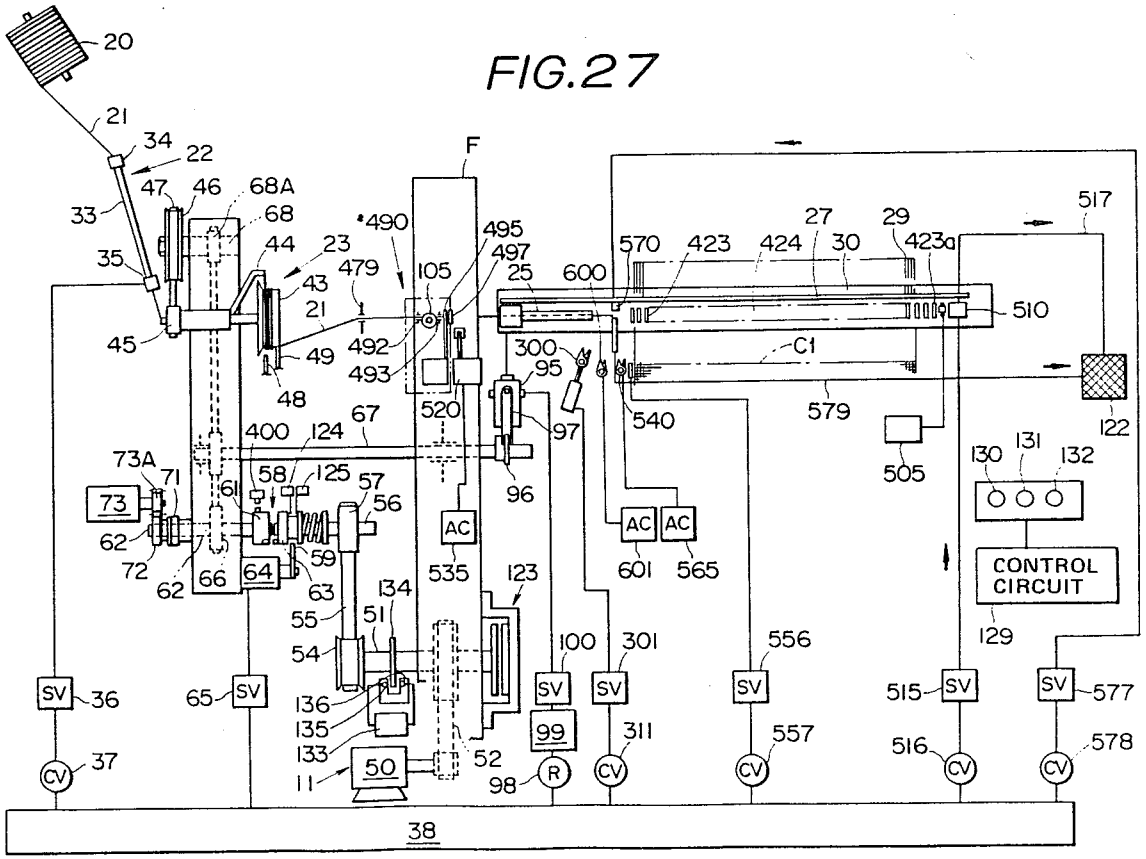
FIG. 27 is a schematic view of an essential part of an air jet loom provided with a second embodiment of the mispicked weft yarn removing system in accordance with the present invention.
Figure 28:
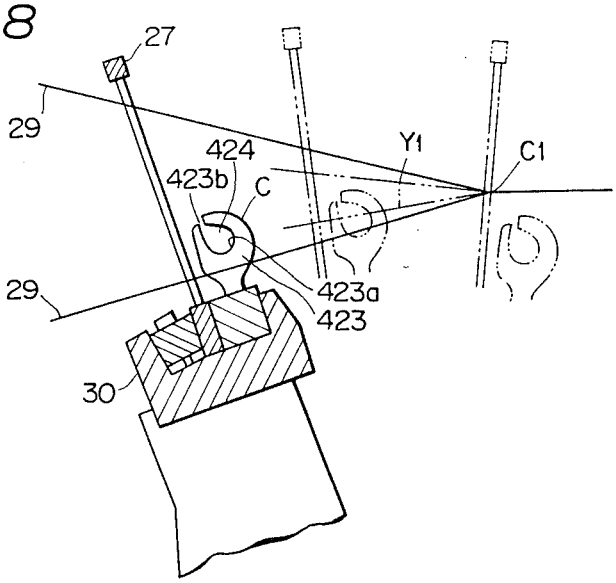
FIG. 28 is a cross-sectional view of the weft picking device including closed type air guide members, of the loom of FIG. 27.

FIGS. 27 to 35 illustrates an air jet loom provided with a second embodiment of the mispicked weft yarn removing system according to the present invention, in which the same reference numerals as in the first embodiment of FIGS. 3 to 13 designate the same elements and parts. The air jet loom is provided with a so-called closed type weft picking device as shown in FIG. 28. As illustrated in FIG. 28, the closed type weft picking device consists of a plurality of air guide members 423 each of which is secured at its lower section to an elongate member (no numeral) fixedly disposed in a groove of the sleigh 30 together with a lower frame (no numeral) of the reed 27. Air guide members 423 are aligned with each other along the length of the sleigh 30 like teeth of a comb. Each air guide member 423 includes a generally C-shaped section or loop section C, defining at its inner periphery an air guide opening (no numeral). The aligned air guide openings of the aligned air guide members 423 constitute the air guide channel 424. The weft yarn 21 located in the air guide opening of each air guide member 423 can escape from the air guide opening through the slit 423*b* to separate from the air guide member 423. With this closed type weft picking device, air jet ejected together with the weft yarn 21 from the main nozzle 25 is guided through the air guide channel 424 forming an air stream toward the counter-weft picking side, thus accomplishing a weft picking. At the beating-up step where a picked weft yarn is beaten up by the reed 27, each air guide member 423 moves under the array of the warp yarns Y1 as indicated in phantom, in which the picked weft yarn located in the air guide opening of the air guide member 423 escapes from the air guide opening upon being supported on the warp yarn array Y1. It will be understood that this closed type weft picking device is less in pressurized air consumption amount and has such advantages that less pressurized air is required while facilitating the picking of even yarns having a lower tensile strength.

Figure 29:
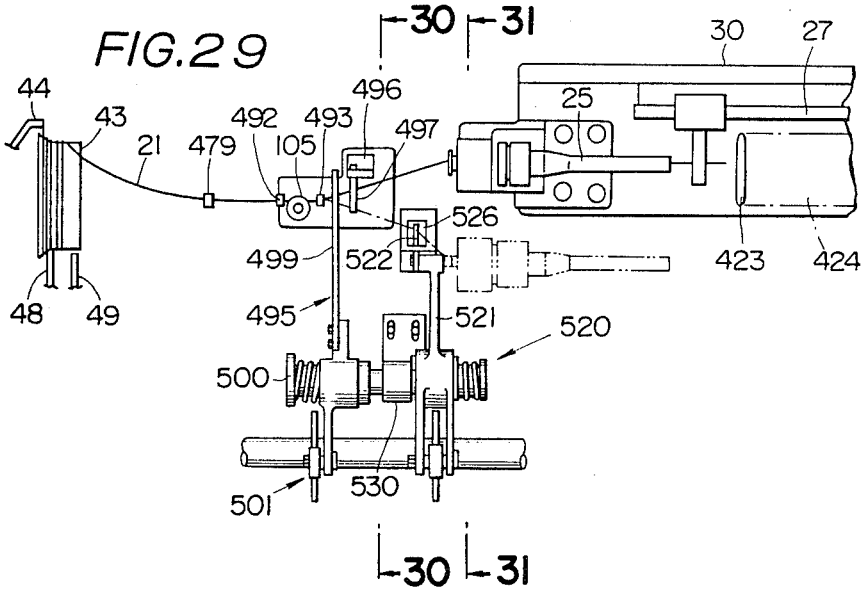
FIG. 29 is a plan view of an essential part of the loom of FIG. 27.
Figure 30:
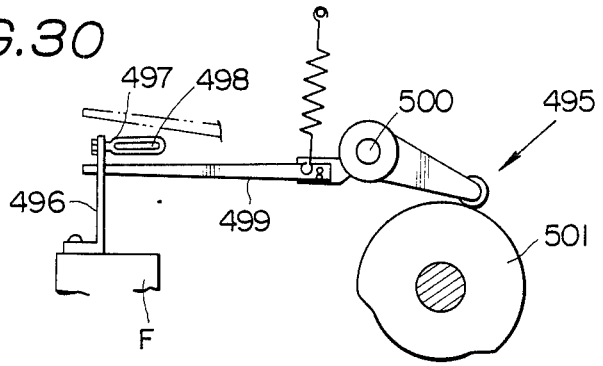
FIG. 30 is a side view, partly in section, taken in the direction of arrows substantially long the line 30—30 of FIG. 29.

As shown in FIG. 27, the loom is provided with a weft braking mechanism 490 operatively mounted on the frame F. As illustrated in FIGS. 29 and 30, the weft braking mechanism 490 consists of the weft brake 105 disposed between yarn guides 492, 493. The weft brake 105 operates in timed relation to the shaft 67 to make grasping or braking action for the weft yarn as discussed below. Another weft brake or brake device 495 is provided. A yarn guide 497 of the weft brake 495 is fixed to a bracket 496 which fixedly stands on the frame F. The yarn guide 497 is disposed on the right side of the yarn guide 493 and formed with an elongate hole 498 elongated in the fore-and-aft direction of the loom. The brake device 495 includes an arm 499 which is swingably mounted on a fixed shaft 500. The arm 499 is driven in such a manner that the tip end section thereof moves from its lower position indicated by solid lines toward its upper position indicated in phantom during a time period of weft picking terminal stage under the action of a cam 501 rotated in timed relation to the shaft 67.

Figure 32:
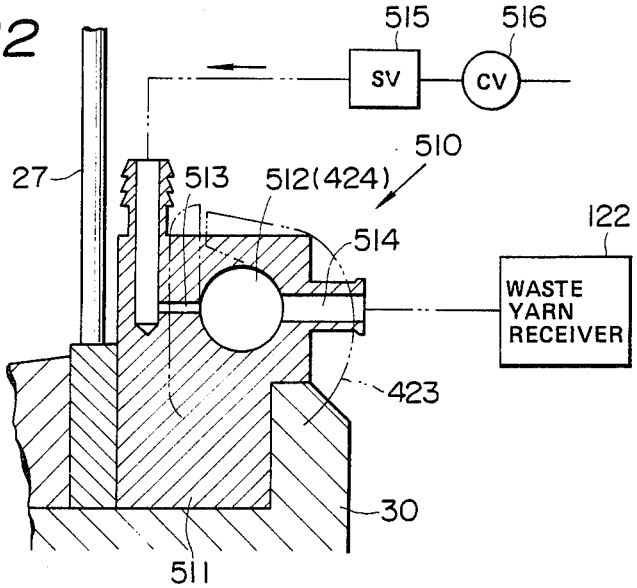
FIG. 32 is a vertical sectional view of a weft traction device of the loom of FIG. 27.

Turning to FIG. 27, a photoelectric weft detector 505 is provided on the counter-weft picking side and adapted to output a signal representing "presence" of the weft yarn 21 when the weft yarn escapes from the air guide opening of the air guide member 423*a* located extremely rightward in the row of the air guide members 423 in FIG. 27. A weft traction device 510 is fixed to the sleigh 30 and located further rightward or on the counter-weft picking side relative to the extremely rightward located air guide member 23. As illustrated in FIG. 32, the weft traction device 510 includes a body 511 which is formed with a weft introduction opening 512 which can be coincident with the air guide channel 424. An air ejection opening 513 is opened to the weft introduction opening 512 at the one side. A weft outlet opening 514 is opened to the weft introduction opening 512 in such a manner to be opposite to the air ejection opening 513. The air ejection opening 513 is fluidly connected through a solenoid valve 515 and a check valve 516 to the pressurized air supply source 38. The weft introduction opening 514 is communicated through a pipe 517 with the waste yarn receiver 122.

With such a configuration, the weft yarn 21 wound a predetermined times on the drum 43 is drawn out of the drum 43 and introduced to the main nozzle 25 successively through the yarn guide 479, the yarn guide 492, the weft brake 91, the elongate opening 498 of the yarn guide 497.

The operation in connection with the above-mentioned weft picking device will be discussed with reference to a timing chart in FIG. 36.

First when the starting preparation switch 130 is closed, the following three states are made: (A) The solenoid valve 36 for the weft tensor 22 is opened, so that air is ejected from the nozzle 35 into the pipe 33 thereby applying a suitable tension to the weft yarn leading to the weft measuring and reserving device 23; (B) The solenoid valve 100 for the main nozzle 25 is opened, so that pressurized air is fed to the control valve 95; and (C) The solenoid valve 515 for the weft traction device 510 is opened to eject air from the air ejection opening 513 (in FIG. 32), in which the thus ejected air is introduced into the waste yarn receiver 122 through the weft outlet opening 514 and the pipe 517. The states (A) and (B) continue until the stopping switch 132 is operated. Additionally, the electromagnetic brake 123 is released and the main motor 11 is simultaneously operated when the starting switch 131 is operated in such a state that the one-position clutch 58 is engaged and the electromagnetic clutch 71 for the auxiliary motor 73 is released.

Figure 36:
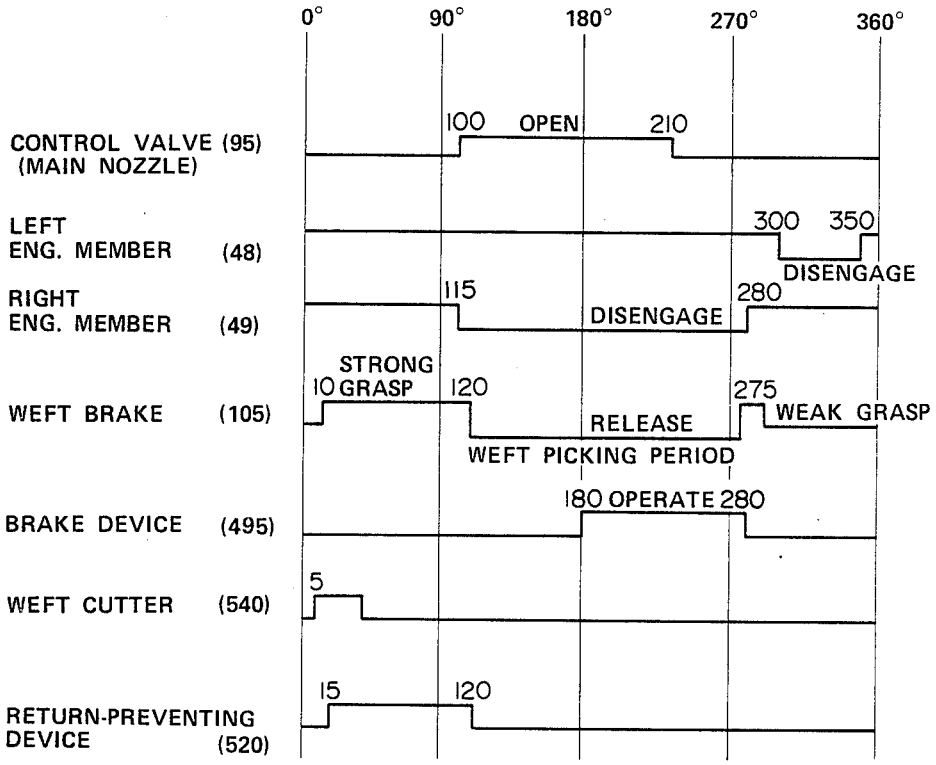
FIG. 36 is a diagram of a timing chart showing the operation timings of various devices and parts of the loom of FIG. 27.
Figure 37A:
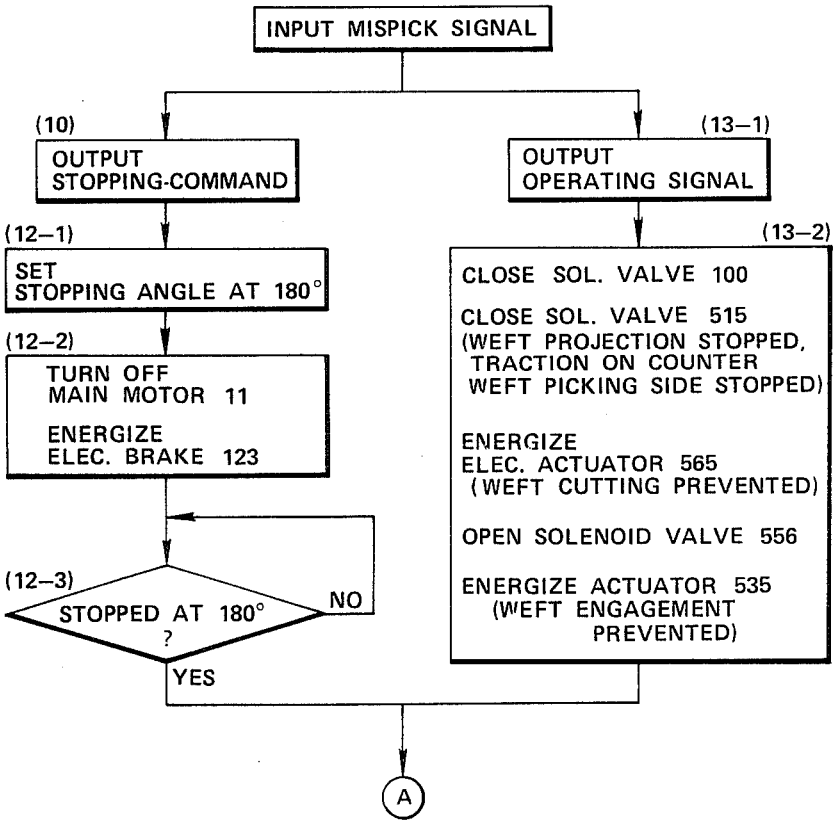
FIGS. 37A to 37G are flowcharts showing the flow of a mispicked weft yarn removing method in connection with the loom of FIG. 27.
Figure 37B:
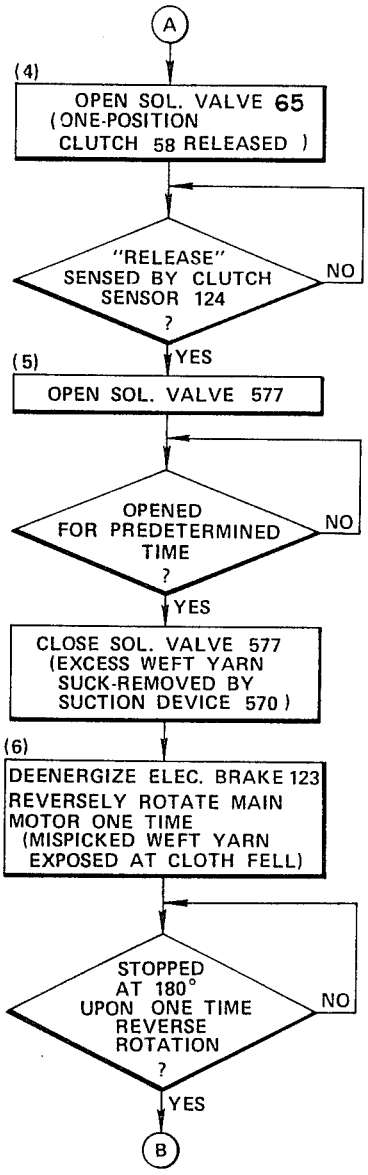
Figure 37C:
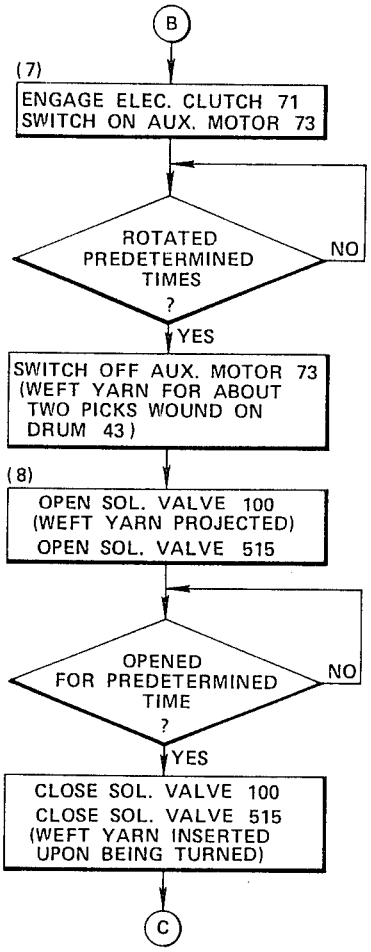
Figure 37D:
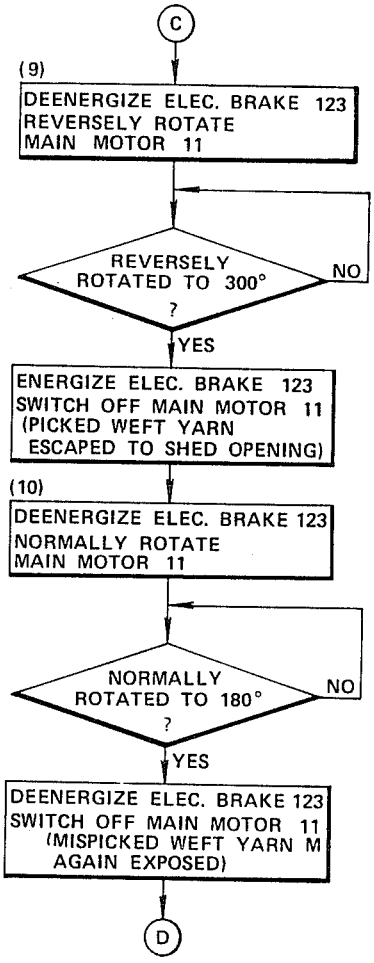
Figure 37E:
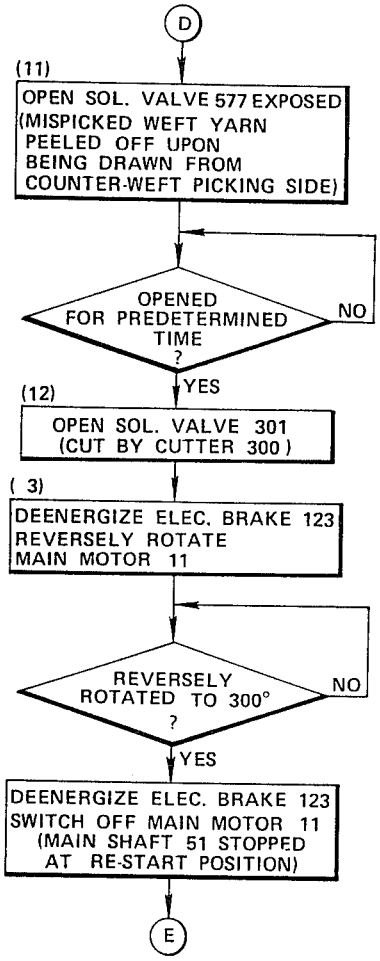
Figure 37F:
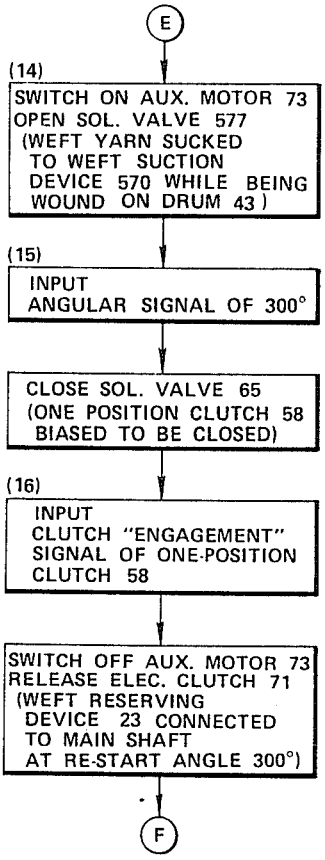
Figure 37G:
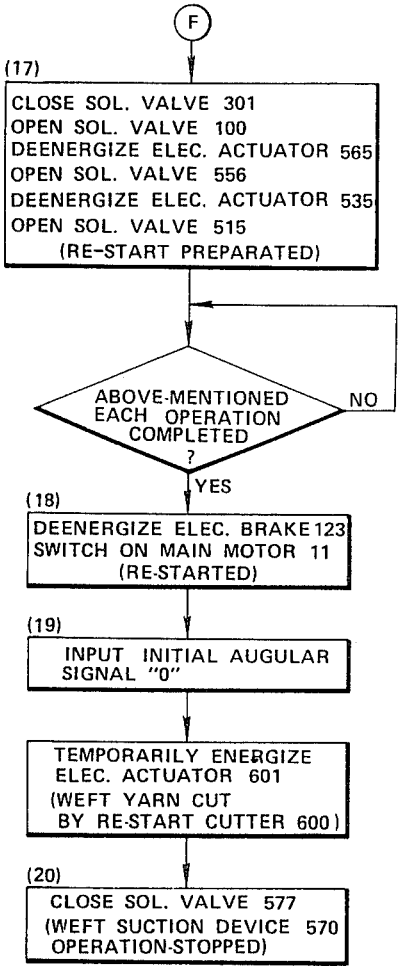

In this instance, the weft picking period of this loom is set from 120 degrees to 275 degrees in the rotational angle (crank angle) of the main shaft 51, in which the weft picking period corresponds to a period of "RELEASE" of the weft brake 105 in FIG. 36.

Explanation will be made from a standard (at 0 degree) at the timing of beating-up by the reed. When the starting timing of weft picking is coming (100 degrees) at the step (0 to about 180 degrees) of backward movement of the reed 27, the control valve 95 is opened to eject air from the main nozzle 25. Immediately after (115 degrees) this, the right engaging member 49 gets out of the drum 43. Subsequently, when the weft picking starting timing (120 degrees) has come, the weft brake 105 releases the weft yarn 21 so that the weft yarn is projected to the air guide channel 424 and makes its flight toward the counter-weft picking side. At a timing (about 180 degrees) during this weft yarn flight, the arm 499 (in FIGS. 29 and 30) of the brake device 495 is driven upward of the yarn guide 497 to take its upper position. Accordingly, the weft yarn 21 is bent at a portion between the yarn guides 497, 493 to receive a suitable braking force. Thus, the weft yarn 21 continues its flight, maintaining its straight posture. The weft picking of this weft yarn 21 terminates when the tip end section of the weft yarn reaches into the weft introduction opening 512 (in FIG. 32). That is to say, at this weft picking termination timing (275 degrees), the yarn brake 105 strongly grasps the weft yarn 21 to brake the weft yarn. Simultaneously the tip end of the weft yarn 21 introduced into the opening 512 is bent upon being blown by air jet from the air ejection opening 513 (in FIG. 32), and then fed into the weft outlet opening 514 to be kept as it is. Immediately after (280 degrees) this, the right engaging member 49 engages into the drum 43, and simultaneously the arm 499 of the brake device 495 restores to the previous or lower position. Upon the above-mentioned engagement in the drum 43, the weft yarn is temporarily fixed onto the drum 43. Thereafter, the left engaging member 48 gets out of the drum 43 (300 degrees) By this, the weft yarn 21 which has been wound or is being wound behind the engagement member 48 moves onto the side of the right engaging member 49, in which the length of the wound weft yarn reaches an amount corresponding to one weft picking (350 degrees), the left engaging member 48 again engages into the drum 43. The weft brake 105 temporarily strongly grasps the weft yarn 21 to brake the weft yarn and thereafter weakly grasps the same till a timing (10 degrees) immediately after the beating-up by the reed. Accordingly, the weft yarn 21 is drawn from the weft braking mechanism 490 with advance of the reed 27 whilst a suitable tension is applied to it, so that the weft yarn is prevented from cutting.

Figure 31:
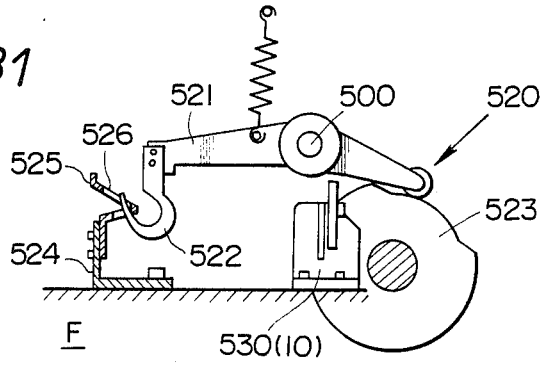
FIG. 31 is a side view, partly in section, taken in the direction of arrows substantially along the line 31—31 of FIG. 29.

As shown in FIG. 27, a weft return-preventing device 520 is disposed adjacent the brake device 495 to temporarily fix the weft yarn 21 near the cloth fell Cl after cut upon being beaten up by the reed as discussed below. The detailed structure of the return-preventing device 520 is shown in FIGS. 31 and 29. As illustrated in FIGS. 31 and 29, the return-preventing device 520 includes an arm 521 rotatably mounted on the fixed shaft 500. The arm 521 is provided at its tip end section with a hook 522 which is fixed in a downwardly-extending state. The hook 522 is located slightly behind the cloth fell C1 and opened backward. The arm 521 is adapted to be driven to move upward throughout a period from a timing (15 degrees) after the beating-up to a weft picking initiation timing (120 degrees) as shown in FIG. 36 under the action of a cam 523 rotatable in timed relation to the shaft 67 (in FIG. 27). An engaging piece 525 is fixed to a bracket 524 standing on the frame F, and formed at its upper part with a V-shaped section having a V-shaped cross-section. The V-shaped section is opened backward and formed with an open window or through-opening 526 to which the hook 522 can be inserted as shown in FIG. 31 when the arm 521 is driven upward as described above.

Disposed under the arm 521 is a rotationpreventing device 530 has the same structure and therefore operates in the same manner as the cutter disabling device 10

(as shown in FIG. 7) of the first embodiment loom of FIGS. 3 to 13, in which the drive lever 222 in FIG. 7 corresponds to the arm 521 in FIG. 31. Accordingly, when the electromagnetic actuator 234 is energized, the pushing member 236 projects against the biasing force of the compression spring 241, thereby causing the movement preventing member 230 to rotate. Upon this, the movement preventing member 230 is in a state indicated by solid lines, so that the upper end section of the movement preventing member 230 prevents the arm 431 from its downward movement.

Figure 33:
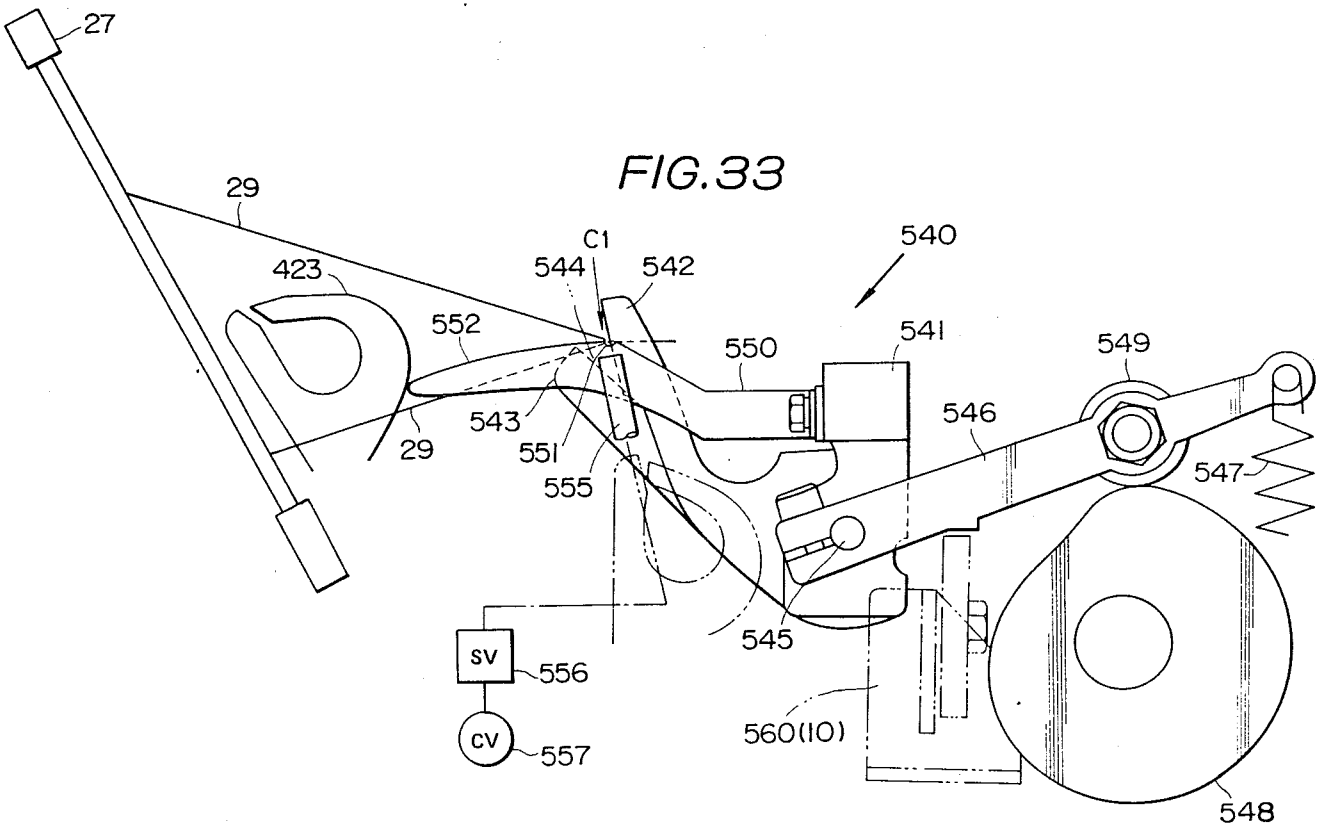
FIG. 33 is a side view of a weft cutter of the loom of FIG. 27.

A cutter 540 shown in FIG. 27 is provided to cut the weft yarn beaten up by the reed so as to disconnect the weft yarn from the main nozzle 25. The detailed structure of the cutter 540 is shown in FIG. 33. As illustrated in FIG. 33, the cutter 540 includes a bracket 541 fixedly disposed near and in front of the cloth fell C1. A fixed blade 542 is fixed to the bracket 541. Additionally, a movable blade 543 is movably supported by the bracket 541 to form a shearing opening 544 between it and the fixed blade 542, the shearing opening 544 being located on the weft picking side relative to the cloth fell C1. The movable blade 543 is pivotally supported through a shaft 545 to the bracket 541. A drive lever 546 is fixedly mounted on the shaft 545 and has a free end section pulled by an extension spring 547 so that closing action of the movable blade 64 is made. The drive lever 546 is provided with a cam follower 549 in contact with a cam 548 rotated in timed relation to the shaft 67 (in FIG. 27), so that the rotation of the cam 548 makes opening action of the movable blade 543.

A yarn leader 550 is fixed to the bracket and extended backward. The yarn leader 550 is formed at its upper surface with a groove 551 located by the cloth fell C1 and formed with a lead surface 552 which is located backward relative to the groove 551 and smoothly curved. Accordingly, the weft yarn between the weft picking mechanism 490 (in FIG. 27) and the main nozzle 25 is advanced while being introduced to the lead surface 552 and then falls into the groove 551 to be engaged with the groove simultaneously with the beating-up by the reed. This arrangement prevents cutting mistake for the weft yarn. A nozzle 555 is disposed in close proximity to and under the groove 551, and has an axis passing through the groove 551. The nozzle 555 is fluidly connected through a solenoid valve 556 and a check valve 557 with the pressurized air supply source 38. Accordingly, when air is ejected from the nozzle 555, the weft yarn 21 engaged with the groove 551 is blown out to be released from the groove 551. Additionally, a cutting-preventing device 560 is disposed under the drive lever 546 of the cutter 140. The cutting-preventing device 560 has the same structure and operates in the same manner as the rotation-preventing device 530 and the cutter disabling device 10 (in FIG. 7), in which the drive lever 222 in FIG. 7 corresponds to the drive lever 546 in FIG. 33. Accordingly, when the electromagnetic actuator 234 is operated or energized, the tip end section of the movement preventing member 230 moves from its withdrawn position indicated in phantom to its projected position indicated by the solid lines thereby to prevent the movable blade 543 from making its closing action.

Figure 34:
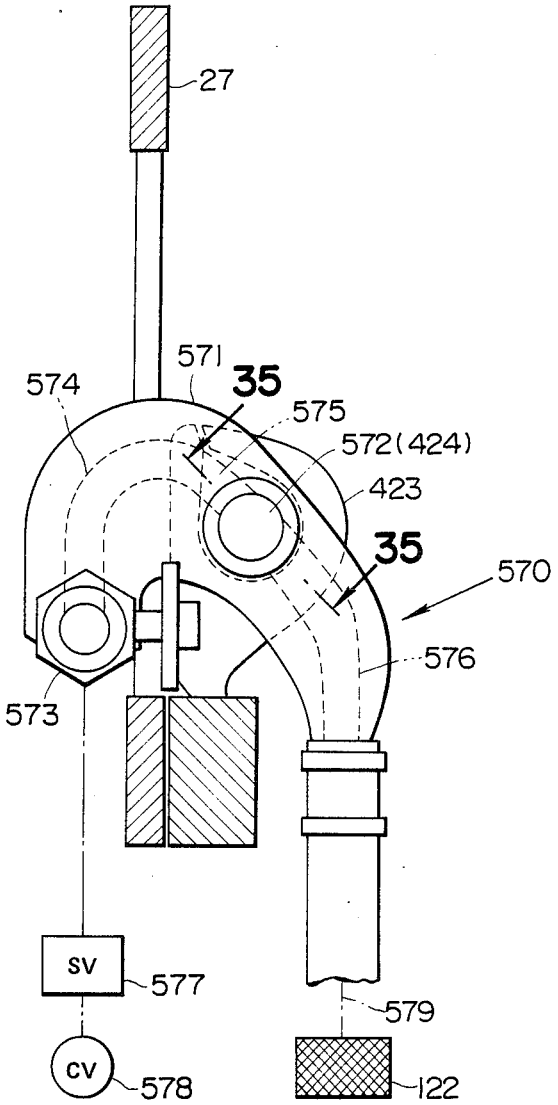
FIG. 34 is a side view of a weft suction device of the loom of FIG. 27.
Figure 35:
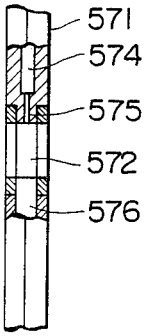
FIG. 35 is a fragmentary sectional view taken in the direction of arrows substantially along the line 35—35 of FIG. 34.

A weft suction device 570 in FIG. 27 is provided between the main nozzle 503 and the air guide member 423 located the nearest the main nozzle 25. The detailed structure of the weft suction device 570 is shown in FIGS. 34 and 35. As illustrated in FIGS. 34 and 35, the weft suction device 570 includes a flat body 571 which is fixed to the reed 27 and formed with a weft passing hole 572. The weft passing hole 572 is formed through the flat body 571 in right and left direction, and can be coincident with the air guide opening of the air guide member 423 and accordingly with the air guide channel 424. An inlet connector 573 is communicated with an air feed passage 574 at one end. The other end of the air feed passage 574 is flatened to be narrowed in cross-sectional area thereby to form a nozzle 575. The nozzle 575 extends through a side wall surface defining the weft passing hole 572 so as to be communicated with the weft passing hole. An air discharge passage 576 is communicated with the weft passing hole 572 and located opposite to the nozzle 575. The inlet connector 573 is fluidly connected through a solenoid valve 577 and a check valve 578 with the pressurized air supply source 38 (in FIG. 27). The air discharge passage 576 is fluidly connected through the passage 579 to the waste yarn receiver 122.

In this instance, the mispicked yarn cutter 300 can take a projecting-limit position (as indicated in phantom in FIG. 11) which is at a timing (about 180 degrees) at which the reed 27 is located in its most-backward position. The mispicked yarn cutter 300 in the projecting-limit position is located between the main nozzle 25 and the weft suction device 570. Additionally, the mispicked yarn cutter 300 can take a withdrawing-limit position (as indicated in solid lines in FIG. 11) where the cutter 300 is prevented from interference with the reed 27 when the reed 27 is in the most-forward position. A weft cutter 600 for re-start is disposed adjacent to the cutter 540 and operatively connected to an actuator 601 for making shearing action of the cutter 600.

The mispicked weft yarn removing method in the above-described loom arrangement will be discussed hereinafter with reference to FIGS. 37A to 37G, and 38A to 38J, and also to FIG. 36. The operation of the solenoid valves, the electromagnetic actuators, a loom driving system and the like is performed in response to command output from a sequence controller (not identified) in the control circuit 129. While such operation performance is accompanied with a variety of confirming portions depending upon the signals from the angle sensor 133, the position sensor or proximity switch 400, the limit switches 124, 125 respectively representing disengagement and engagement of the one-position clutch 58, and the like, the explanation therefor will be omitted for the purpose of simplicity of illustration.

(1): When a mispick has occured in a process of weft picking, the weft detector 505 outputs a mispick signal representing "absence" of weft yarn and fed it to the control circuit 129 which in turn outputs a stopping-command.

(2-1): A stopping control device of the control circuit 129 sets the stopping angle at 180 degrees in the succeeding weaving cycle relative to the weaving cycle where the mispick occurs, in response to the above-mentioned stopping-command.

(2-2) The main motor 11 is turned OFF, and the electromagnetic brake 123 is energized.

(2-3): The main motor 11 is stopped at the angular position of 180 degrees, in which the warp shed opening becomes the largest at this stopping position.

(3-1): The control circuit 38 outputs operating signals in response to the mispick signal, thereby causing the following operations to be performed.

(3-2): The solenoid valves 100 and 515 respectively for the main nozzle 25 and the weft traction device 510 are closed. The electromagnetic actuator 565 for the cutter 540 is energized to prevent cutting of the weft yarn. The solenoid valve 556 for the cutter 540 is opened while energizing the electromagnetic actuator 234 for the return-preventing device 520 is energized. Accordingly, air ejection is made from the nozzle 555 of the cutter so that the weft yarn gets out of the groove 551 (in FIG. 33) in which no weft engagement with the hook 522 is made (in FIG. 31).

Figure 38A:
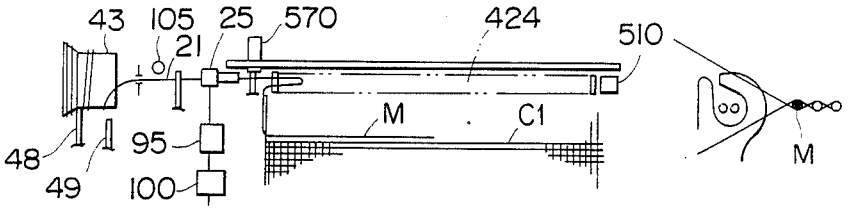
FIGS. 38A to 38J are schematic illustrations showing the process of the mispicked weft yarn removing method of FIGS. 37A to 37G.
Figure 38B:
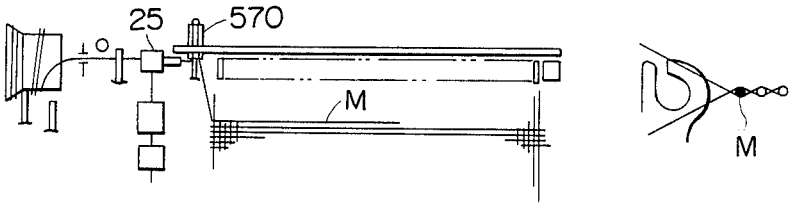
Figure 38C:
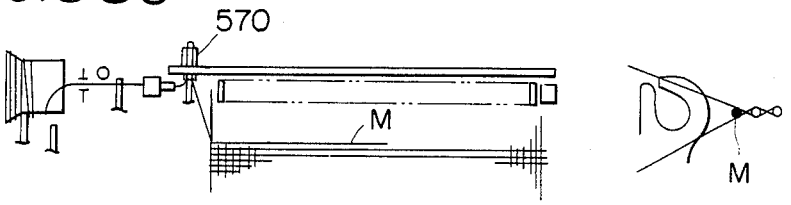
Figure 38D:
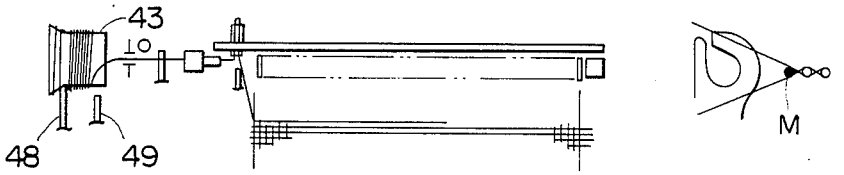

FIG. 38A shows a state where the above-mentioned various operations (1), (2-1 to 2-3), and (3-1, 3-2) have been completed. The mispicked weft yarn M is connected to the main nozzle 25 without being cut or engaged in a state of being woven at the cloth fell C1. As seen from FIG. 36, since the control valve 95 is opened and the right engaging member 49 gets out of the drum in this stopping position, pressurized air stored in between the valve 95 and the solenoid valve 32 is temporarily ejected from the main nozzle 25. Accordingly, a part of the weft yarn reserved on the drum 43 is projected into the air guide channel 424 in which the weft yarn is U-shaped.

(4): The solenoid valve 65 for the one-position clutch 58 is opened, so that the air actuator 64 is operated thereby to disengage the clutch 58.

(5): The solenoid valve 577 for the weft suction device 570 is opened a predetermined time. This opening-operation of the solenoid 577 causes the excessive weft yarn projected in the U-shaped to be sucked into the air discharge passage 576 (in FIGS. 34 and 35) to be removed. (See FIG. 38B)

(6) The electromagnetic brake 123 is deenergized and a reverse-rotation circuit of the main motor 11 is turned ON thereby to reversely rotating the main shaft 51 by one time. Then the main shaft 51 is stopped. That is to say, the stopping angle of the main shaft 51 comes back to 180 degrees immediately before the occurrence of the mispick, so that the mispicked weft yarn M is exposed at the cloth fell. (See FIG. 38C)

(7): The electromagnetic clutch 71 of a weft supply system is engaged and the auxiliary motor 73 is switched ON, thereby rotating the motor 73 predetermined times. Accordingly, only the weft measuring and reserving device 23 is driven so that the weft yarn is wound on the drum 43. When the length of the thus wound weft yarn becomes an amount corresponding to two weft picking and the right engaging member 49 gets out of the drum, the auxiliary motor 73 is stopped. (See FIG. 38D) The wound amount of the weft yarn may be smaller than that corresponding to two weft pickings.

(8): The solenoid valves 100, 515 for the respective the main nozzle 25 and the weft traction device 510 are opened for a predetermined time. By this, the weft yarn having the length corresponding to the two weft pickings is projected into the air guide channel 424 and then reversed on the counter-weft picking side to extend to the weft picking side, taking the U-shaped form. The thus formed reversed section on the counter-weft picking side is sucked into the weft outlet opening 514 (in FIG. 32) of the weft traction device 510. (See FIG. 38E)

(9): The reverse-rotation circuit of the main motor 11 is switched ON to reversely rotate the main shaft 51, for example, to its position at 300 degrees. In this process, the weft yarn inserted in the U-shape escapes from the air guide channel 424 through the slit 423*b* and fed into the warp yarn shed opening as explained with reference to FIG. 28. (See FIG. 38F)

(10): The main shaft 51 is restored to its position at the previous stopping angle 180 degrees by normally rotating the main motor 11, in which the mispicked weft yarn M is again exposed.

(11): The solenoid valve 577 for the weft traction device 570 is opened. Accordingly, the weft yarn which has escaped is drawn in the U-shape from the counter-weft picking side, so that the exposed mispicked weft yarn M is peeled off from the woven cloth to be removed. (See FIG. 38G)

(12): The solenoid valve 301 for the mispicked yarn cutter 300 is opened. Accordingly, the rod 303 of the air actuator 302 projects to cut the weft yarn thereby to disconnect the weft yarn from the main nozzle 25 as explained with reference to FIG. 11. (See FIG. 38H). The cut and disconnected weft yarn is fed together with the mispicked weft yarn M into the waste yarn receiver 518 through the passage 517.

(13): The reverse-rotation device of the main motor 11 is switched ON thereby to reservely rotate the main shaft 51 to its position of 300 degrees in the weaving cycle where the mispick occured. Here the main shaft 51 is stopped. The position of 300 degrees corresponds to the starting angle of the loom as described above. (See FIG. 38I)

(14): The auxiliary motor 73 is switched ON, and the solenoid valve 577 for the weft suction device 570 is opened. Accordingly, the weft yarn is wound on the drum 43, and the wound weft yarn is sucked into the weft suction device 570 to be removed every time the right engaging member 49 gets out of the drum. In this process, the angular signal representing 300 degrees is output from the position sensor or proximity switch 400.

(15): When the above-mentioned angular signal representing 300 degrees is output and disappeared, the control circuit 129 causes the solenoid valve 65 for the one-position clutch 58 to close thereby closing an air supply passage leading to the air actuator 64. Accordingly, the clutch counterpart or slide head 59 is brought into contact with the clutch counterpart or clutch head 61 under the biasing force of the air actuator 64. In this state, when the head 61 rotates by one time to take its angular position of 300 degrees, the one-position clutch 58 is engaged and simultaneously the clutch sensor or limit switch 125 outputs the signal representing "engagement".

(16): The auxiliary motor 73 is switched OFF in response to the above-mentioned clutch "engagement" signal from the clutch sensor 125, and additionally the electromagnetic clutch 71 of the auxiliary motor 73 is released. That is to say, the re-start condition of the weft supply system has been completed. Accordingly, the weft yarn is sucked to the weft suction device 570 and therefore kept in tension between the weft suction device 570 and the main nozzle 25. (See FIG. 38J)

(17): The re-start of the loom is made by outputting the following operating commands.

(17-1): The solenoid valve 301 is closed thereby to allow the mispicked yarn cutter 300 to withdraw.

(17-2): The solenoid valve 100 is opened thereby to feed pressurized air to the control valve 95.

(17-3): The electromagnetic actuator 565 is deenergized thereby to release the cutter 540 from its restraint. Simultaneously, the solenoid valve 556 is closed thereby to enable engagement of the weft yarn with the cutter 540.

(17-4): The electromagnetic actuator 535 is deenergized thereby to release the return-preventing device 520 from its restraint.

(17-5): The solenoid valve 515 is opened thereby to operate the weft traction device 510.

(18): The main motor 11 is re-started, in which the beating-up operation of the reed 27 is made without a picked weft yarn since no weft picking has been made.

(19): In response to the angular signal (0 degree) output from the angle sensor 133 at the timing of the above-mentioned beating-up operation, the electromagnetic actuator 601 of the weft cutter 600 for re-start is temporarily energized. Accordingly, the tensed weft yarn upon being sucked to the weft suction device 570 is cut by the weft cutter 600, and thereafter fed to the waste receiver 518 through the passage 579.

(20): The solenoid valve 577 is closed thereby to stop the operation of the weft suction device 570.

While the above-described various operations have been shown and described as being performed in accordance with the angular position of the main shaft 51 controlled by controllably driving driving the main motor 11, it will be understood that the angular position of the main shaft 51 may be controlled by means of a separate motor such as a low speed geared motor engaged with the main shaft 51.

Figure 38E:
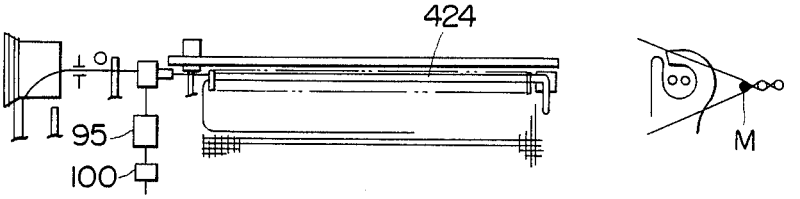
Figure 38F:
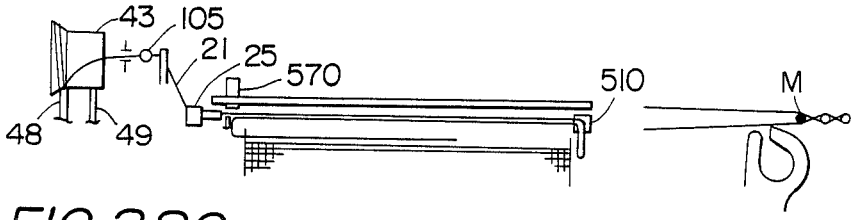
Figure 38G:
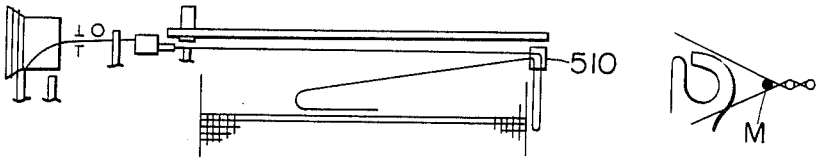
Figure 38H:
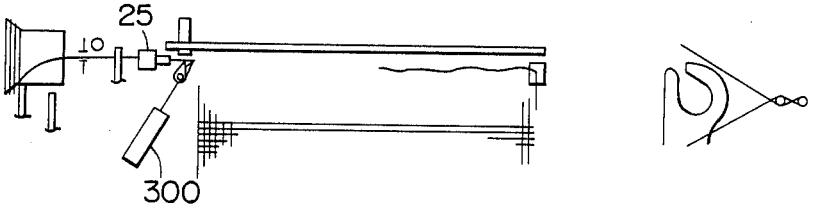
Figure 38I:
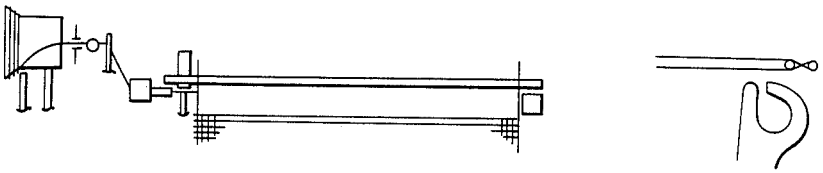
Figure 38J:
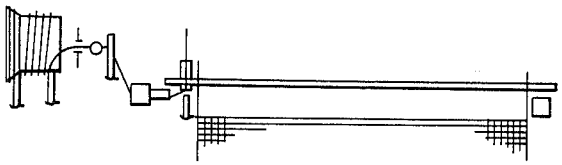

Although the second embodiment loom shown in FIGS. 27 to 35 has been shown and described as using the closed type air guide members as shown in FIG. 29, it will be appreciated that the principle of the mispicked weft yarn removing method of the second embodiment may be applied to a loom provided with an air guide channel formed by so-called open type air guide members as shown in FIG. 9 in which the projected plate section of each reed blade 83 corresponds to the open type air guide member. In this case, an improvement is achieved in performance of the mispicked weft yarn removing method in the loom using such open type air guide members. That is to say, if the above-mentioned operation steps (3-1, 3-2) and (8) are performed, there is possibility of the weft yarn being caught by the auxiliary nozzle 31A to 31D (shown in FIGS. 3, 8 and 9) when the weft yarn is inserted into the air guide channel as illustrated in FIGS. 38A or 38E. However, according to the mispicked weft yarn removing method in the second embodiment, the auxiliary nozzles 31A to 31D move under the array of the warp yarns 21 during the performance of the above-mentioned step (9), in which the weft yarn caught by the auxiliary nozzle will be released from the auxiliary nozzle upon being supported or pushed by this warp yarn array.

Figure 39:
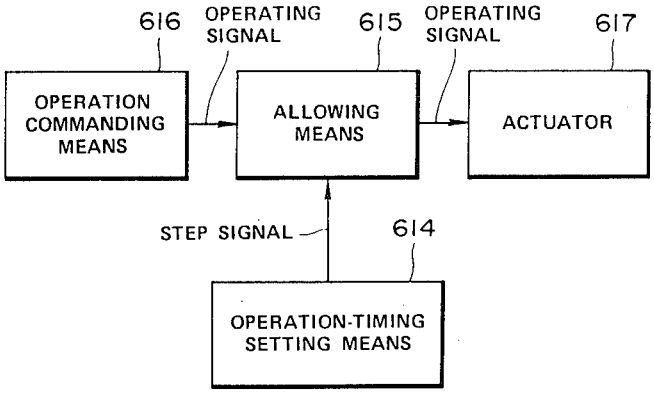
FIG. 39 is a block diagram illustrating essential part of a control circuit of an air jet loom provided with a third embodiment of a mispicked weft yarn removing system in accordance with the present invention.

FIGS. 39 to 43B illustrate an air jet loom provided with a third embodiment of the mispicked weft yarn removing system in accordance with the present invention, similar to the first embodiment substantially except for provision of an abnormality treating device 618 as shown in FIG. 39. Accordingly, the same reference numerals as in the first embodiment designate the same elements and parts in this embodiment. As illustrated in FIG. 39. the abnormality treating device 618 consists of actuators 617 which are adapted to be operated when a predetermined abnormality arises in a weaving process. An operation commanding means 616 is provided to function to output an operating signal to the actuators 617. An operation-timing setting means 614 is provided to be adapted to output a step signal at a timing at which the actuator 617 is scheduled to operate. Additionally, an allowing means 615 is adapted to make effective the function of the operation commanding means 616 when the step signal is output from the operation-timing setting means 614. In other words, the allowing means 615 allows the operating signal from the operation commanding means 616 to be transmitted to the actuator 617 in response to receiving the step signal from the operation-timing setting means 614.

Figure 41:
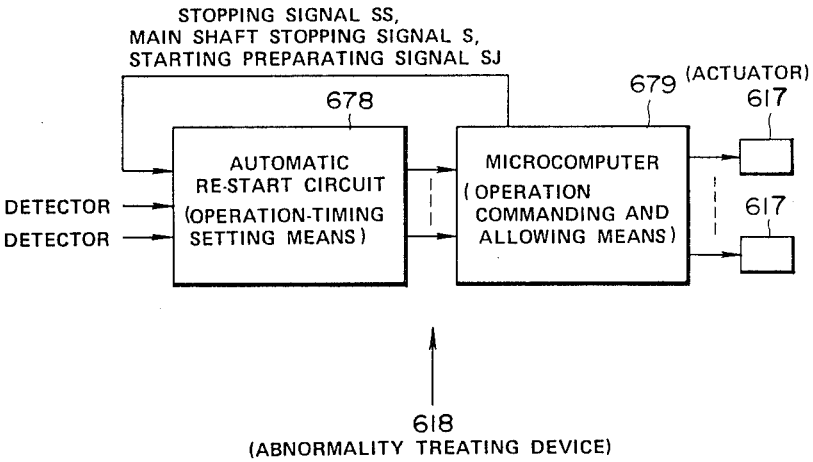
FIG. 41 is a block diagram illustrating the principle of the mispicked weft yarn removing system of FIG. 40.
Figure 40:
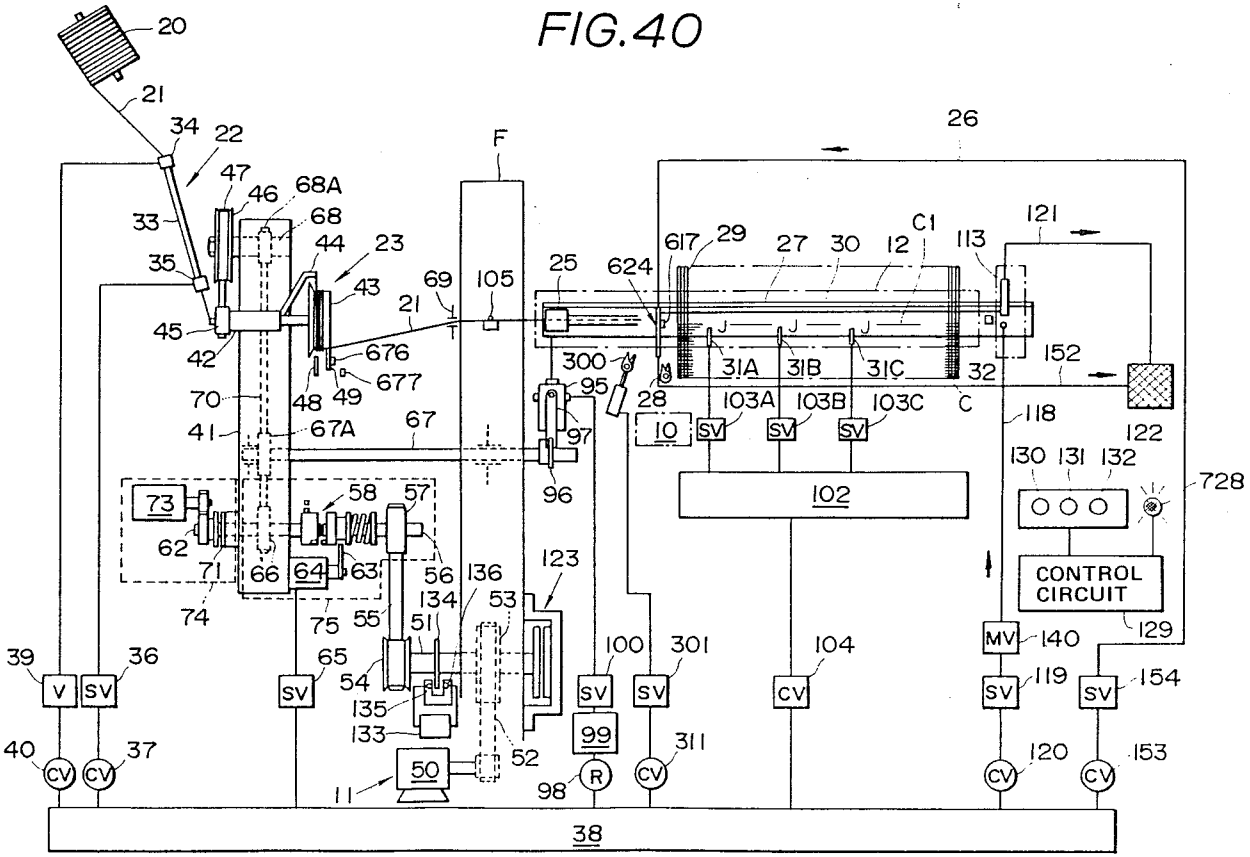
FIG. 40 is a schematic illustration of the loom provided with the second embodiment mispicked weft yarn removing system.

As shown in FIG. 41, the control circuit 129 includes a microcomputer 679 and an automatic re-start circuit 678. The microcomputer 679 includes the operation commanding means 616 and the allowing means 615 and is arranged to output operating signals at predetermined timings to actuators 617 (more specifically the solenoid valves, the main motor, the auxiliary motor, the electromagnetic clutch, and the like) in response to the step signal and to signals from a variety of detectors. It will be understood that the microcomputer 679 also function to control the normal weaving operation of the loom in response to ON and OFF signals from the starting preparation switch 130, the starting switch 131, and the stopping switch 132 operated by the operator, the angular signal from the angle sensor 133 and the like. An abnormality lamp 728 is provided to be electrically connected to the microcomputer 679 in the control circuit 129 and adapted to be lighted when an abnormal condition such as absence of the step signal and warp yarn cutting by which the loom cannot be restored into its normal weaving operation.

Figure 42:
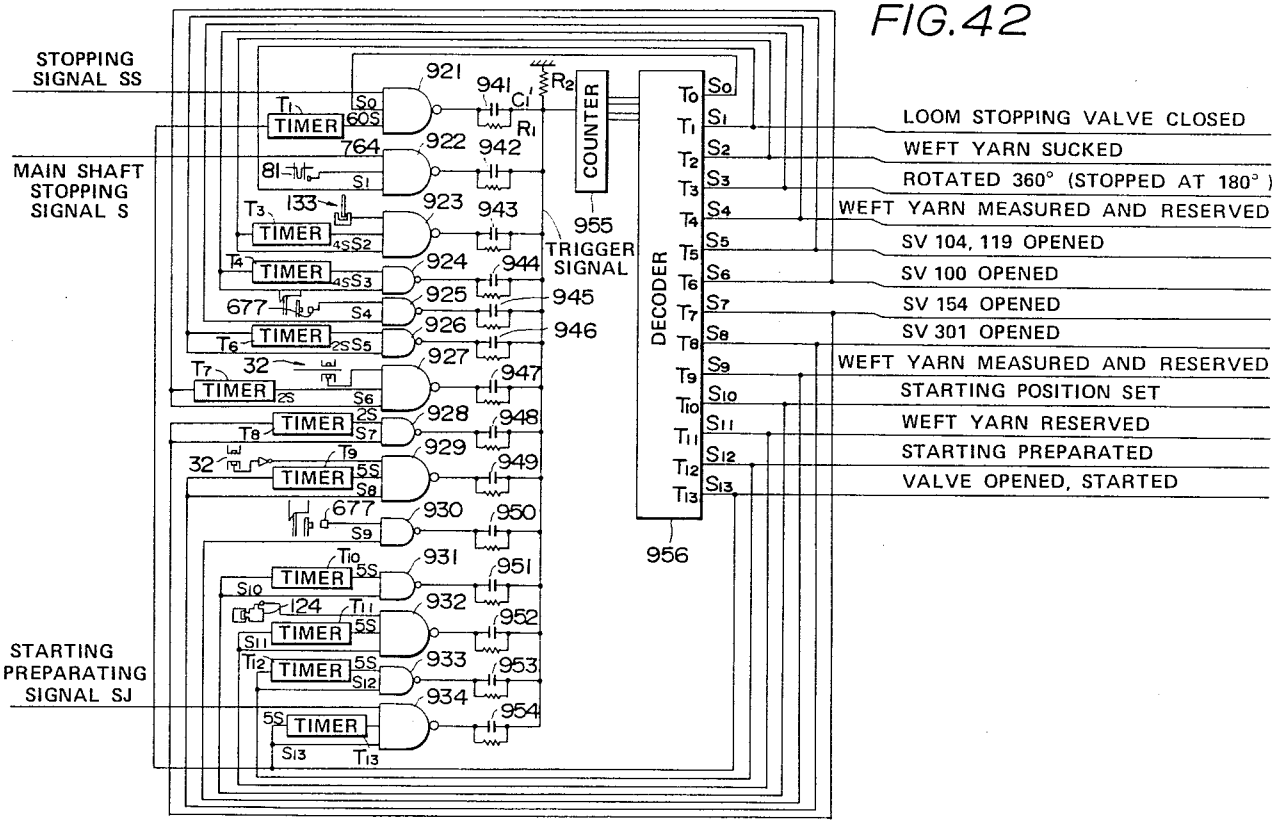
FIG. 42 is a circuit diagram of an automatic re-start circuit shown in FIG. 41.

The automatic re-start circuit 678 has the function of the operation-timing setting means 614 and arranged to produce the step signal in response to the signal from detectors, stopping signal SS, main shaft stopping signal S, and starting preparating signal SJ in a process of performing the program of abnormality treatment in the microcomputer 679. The thus produced step signal is output to the microcomputer 679. The detailed circuit arrangement of the automatic re-start circuit 678 is shown in FIG. 42. As illustrated in FIG. 42, the automatic re-start circuit 678 includes NAND gates 931 to 954, differentiators 941 to 954 each consisting of a parallel circuit constituted by a condenser C1′ and a resistor R1, a counter 955 for making counting-up operation in accordance with trigger signal from the differentiators 941 to 954, a decodar 956 for outputting the step signal S0 to S13 from respective terminals T0 to T13 in accordance with count value from the counter 955, and a timer T1 to T13 located on the output side of the NAND gate. The detailed operation of the automatic re-start circuit 678 will be discussed after.

Turning to FIG. 39, the engaging member 49 of the weft measuring and reserving device 23 is provided with a function piece 676 which is adapted to be faceable to a proximity switch 677 fixed to the frame F when the engaging member 49 is brought into its position to get out of the drum 43, in which the proximity switch 677 is turned ON. The proximity switch 677 is electrically connected to the control circuit 129.

Figure 43A:
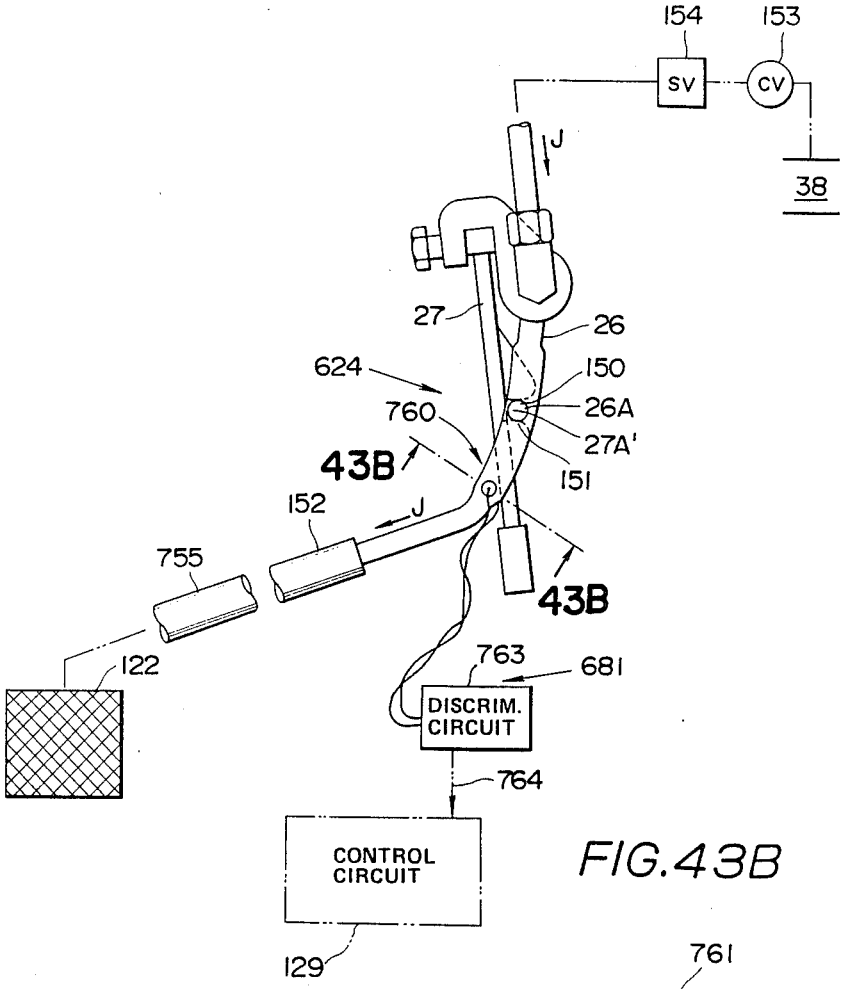
FIG. 43A is fragmentary side view of a weft traction device of the loom of FIG. 40.
Figure 43B:
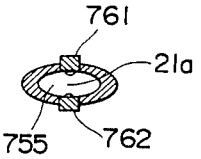
FIG. 43B is a cross-sectional view taken in the direction of arrows substantially along the line 43B—43B of FIG. 43A.

The loom is provided with a weft traction device 624 located on the weft picking side as shown in FIGS. 43A and 43B. As illustrated in FIGS. 43A and 43B, the weft traction device 624 consists of the suction pipe or air ejection pipe 26 communicable with the pressurized air supply source 38 through the solenoid valve 154 and the check valve 153. The solenoid valve 154 is in this instance adapted to be brought into a condition to open when the mispicked weft yarn M is drawn, in response to signal from the microcomputer 679. Accordingly, in order to draw the mispicked weft yarn M, pressurized air fed through the check valve 153 and the solenoid valve 154 is ejected to form a jet stream J. The weft yarn 21*a* is sucked to the downstream side of the traction pipe 26 under the action of the jet stream J, thereby accomplishing traction of the weft yarn 21*a*.

Additionally, a weft discriminating device 681 is provided to be arranged to detect whether or not the weft yarn 21*a* is completely removed from the warp shed opening after the weft yarn 21*a* is slightly projected in the U-shape into the warp shed opening in the loom stopping process and sucked into the drawing opening 151. The weft discriminating device 681 consists of a weft detector 760 electrically connected to a discriminating circuit 763. The weft detector 760 is installed in a position which becomes near the tip end section of the weft yarn 21*a* which has been drawn in the U-shape into the traction pipe 26. As shown in FIG. 43A, the weft detector 760 includes a light projector 761 and a light receiver 762 which face each other. The discriminating circuit 763 functions to output weft discriminating signal 764 (or making the discriminating signal ON) when the weft yarn 21*a* is present between the light projector 761 and the light receiver 762 while does not output the weft discriminating signal (or making the discriminating signal OFF) when the weft yarn 21*a* is absent. The OFF condition of the discriminating signal represents that there arises weft yarn cutting, for example, upon the weft yarn being caught by the auxiliary nozzle 31A when the weft traction device 624 sucks the weft yarn 21*a* which is projected in the U-shape into the warp shed opening in the loom stopping process. The weft discriminating circuit 763 is electrically connected to the control circuit 129 so that the the weft discriminating signal 764 is fed to the control circuit 129.

The manner of operation of the loom provided with the abnormality treating device 618 will be discussed hereinafter.

Figure 44:
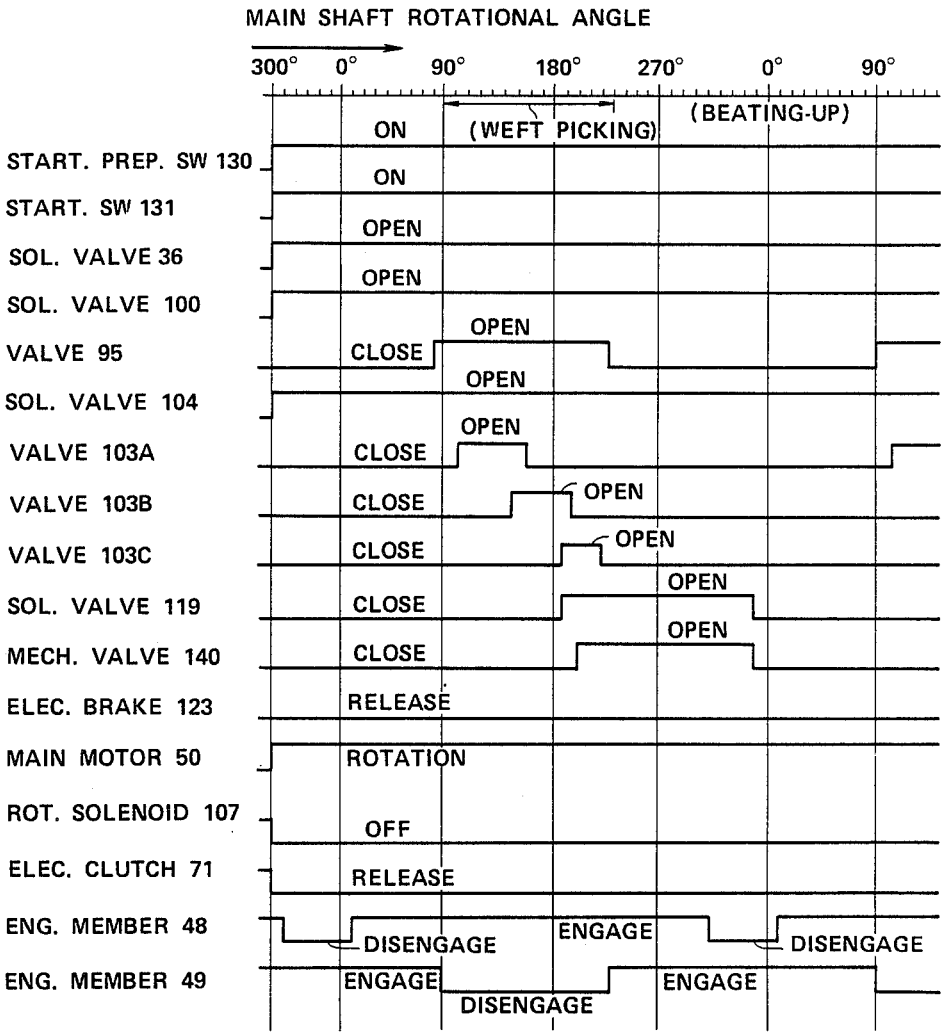
FIG. 44 is a diagram of a timing chart showing the operational timings of various devices and parts of the loom of FIG. 40.

First the basic or normal weaving operation of the loom will be discussed with reference to FIG. 44 showing a timing chart based on the rotational angle of the main shaft 51.

When the starting preparating switch 130 is turned ON by the operator, the following preparation operation is taken place after the abnormality lamp 728 is put out and the mispicked flug is reset: The solenoid valves 36, 100, 104, 119 are opened, the electromagnetic clutch 71 and the electromagnetic brake 123 is released, and the rotary solenoid 107 is turned OFF, thereby applying a tension to the weft yarn 21 under the influence of air jet from the nozzle 35. Additionally, the movable rod 109 of the weft brake 105 becomes separate from the fixed piece 111 as shown in FIG. 5A thereby to release the weft yarn 21 which has been put therebetween. Furthermore, since the electromagnetic brake 123 is released, the main motor 50 becomes in a rotatable condition upon being supplied with electric current. In this state, the main shaft 51 is maintained in an angular position of 300 degrees or the starting position. Subsequently, when the starting switch 131 is turned ON by the operator, the main motor 50 is supplied with electric current to rotate thereby starting the operation of the loom.

During operation of the loom, the solenoid valve 65 is closed so that the projection 59A and the groove 61A of the one-position clutch 58 engage with each other, thereby rendering the one-position clutch in an engaged state. Accordingly, the main shaft 51 is rotated by the main motor 50, so that the warp yarn system is driven whilst the shaft 62 is driven to rotate. This causes the shafts 67, 68 to be driven to rotate. Upon rotation of this shaft 68, the rotatable shaft 42 rotates in timed relation to the main shaft 51, and accordingly the winding arm 44 initiates winding action of the weft yarn 21 on the drum 43, so that the weft yarn 21 has been wound by an amount corresponding to one weft picking on the drum 43 between the engaging members 48, 49 by the timing of the weft picking thereby accomplishing length-measuring and reserving the weft yarn (by the timing of the vicinity of an angle of 90 degrees).

Immediately before the initiation of the weft picking, the valve 95 is opened by the cam 96 thereby ejecting pressurized air from the main nozzle 25. Immediately after this, the engaging member 49 gets out of the drum 43 so that the weft yarn 21 is projected from the main nozzle 25 under the fluence of air jet ejected from the main nozzle 25. At this time, the solenoid valves 103A to 103C for the auxiliary nozzles 31A to 31C are successively opened in timed relation to advance of the tip end section of the weft yarn 21 and successively closed with a lapse of time, in which each auxiliary nozzle is kept opened for a predetermined time. Additionally, the solenolid valve 119 opens at the angular position 190 degrees of the main shaft 51 and closed at the angular position 350 degrees of the main shaft. Upon this air ejection from the auxiliary nozzles 31A to 31C, the weft yarn 21 flies toward the counter-weft picking side in a state to be guided into the goove 84 of each reed blade 83, in which the weft picking period is from the vicinity of angular position 90 degrees to the vicinity of angular position 230 degrees of the main shaft. When the weft yarn 21 thus flies and reaches the side edge of the woven cloth on the counter-weft picking side, whole the weft yarn 21 reserved on the drum 43 between the engaging members 48, 49 has been released. Immediately before the weft yarn 21 is caught by the engaging member 48, the mechanical valve 140 is opened and the valve 95 is closed under the action of the cam 96, so that the tip end section of the weft yarn 21 already inserted into the introduction opening 115 of the weft traction device 113 is blown into the introduction opening 117 by air ejected from the ejection opening 116, thereby accomplishing traction of the weft yarn 21. After completion of the weft picking, the engaging member 49 engages in the drum 43, in which the weft yarn traction continues in a state where the engaging member 48 has got out of the drum 43. This weft yarn traction continues until a timing immediately before the beating-up by the reed takes place (for a time period from the vicinity of the angular position 190 degrees to the vicinity of the angular position 350 degrees of the main shaft). Then, the beating-up by the reed takes place at the angular position 5 degrees of the main shaft. After the beating-up by the reed, the picked weft yarn 21 is cut in the vicinity of an angular position 5 degrees of the main shaft 51. It will be understood that when the engaging member 49 engages in the drum 43 and immediately thereafter the engaging member 48 gets out of the drum 43, the weft yarn 21 required for the next cycle is moved to between the engaging members 48, 49. Thereafter, the same process as mentioned above will be repeated to weave the cloth C.

The above-discussed weaving operation is controlled by the microcomputer 679 of the control circuit 129. The flow of such a weaving operation control is shown in the flowcharts of FIGS. 45A to 45D. In the flowcharts, after controls (1 to 3) for the above-mentioned preparation operation and controls (4, 5) for the starting, the ON-OFF controls (6 to 17) for the solenoid valves 103A to 103C, 119 are performed. Then, the following controls are performed: Watching mispick is made in response to ON or OFF condition of mispick signal 13 from the weft detector 32 (18); Watching warp yarn cutting is made in response to ON or OFF condition of warp yarn cutting signal (19); and Watching ON or OFF operation of the stopping switch 132 (20). Lastly the solenoid valve 119 is closed at the angular position 350 degrees of the main shaft 51 (21, 22).

Here, assuming that abnormality such as a mispick aries in which, for example, the tip end section of the picked weft yarn is caught by one of the auxiliary nozzles 31A to 31C or the like in the above-discussed normal weaving process, controls for loom stopping, traction of the mispicked weft yarn M, and loom re-start will be performed in accordance with the flow of flowcharts in FIGS. 45C to 45L under the control of the microcomputer 679 forming part of the abnormality treating device 618.

Figure 45A:
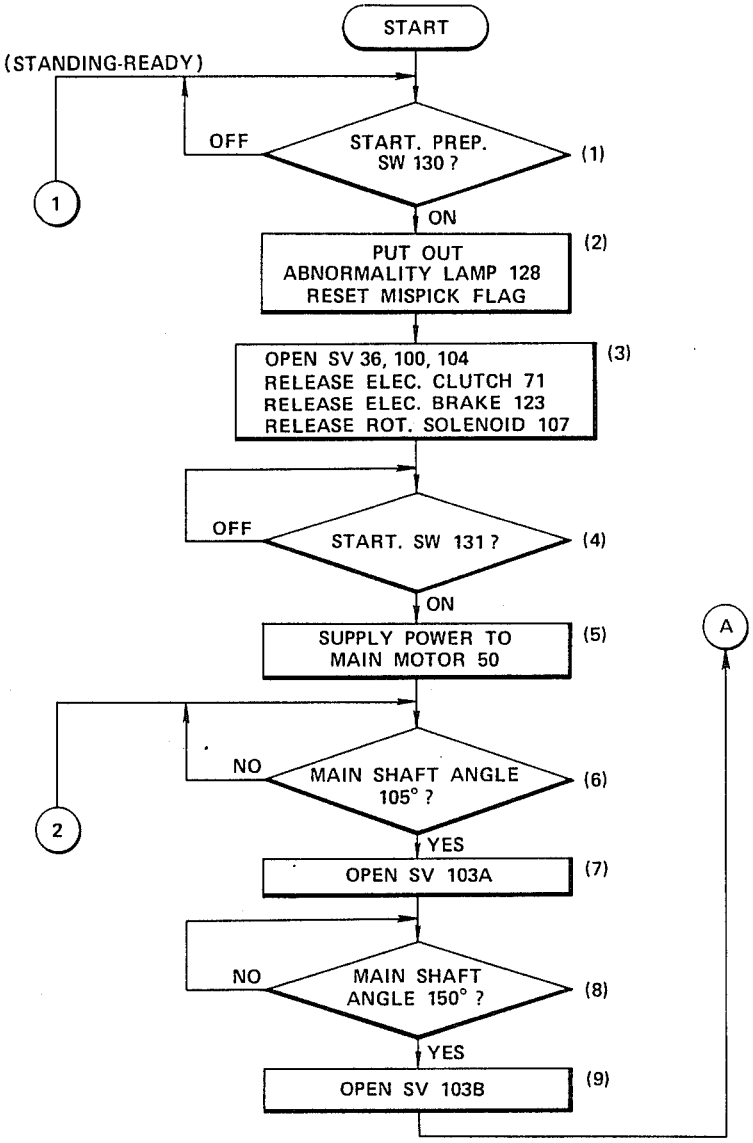
FIGS. 45A to 45L are flowcharts showing the flow of controlled operation of a mispicked weft yarn removing method in connection with the loom of FIG. 40.
Figure 45B:
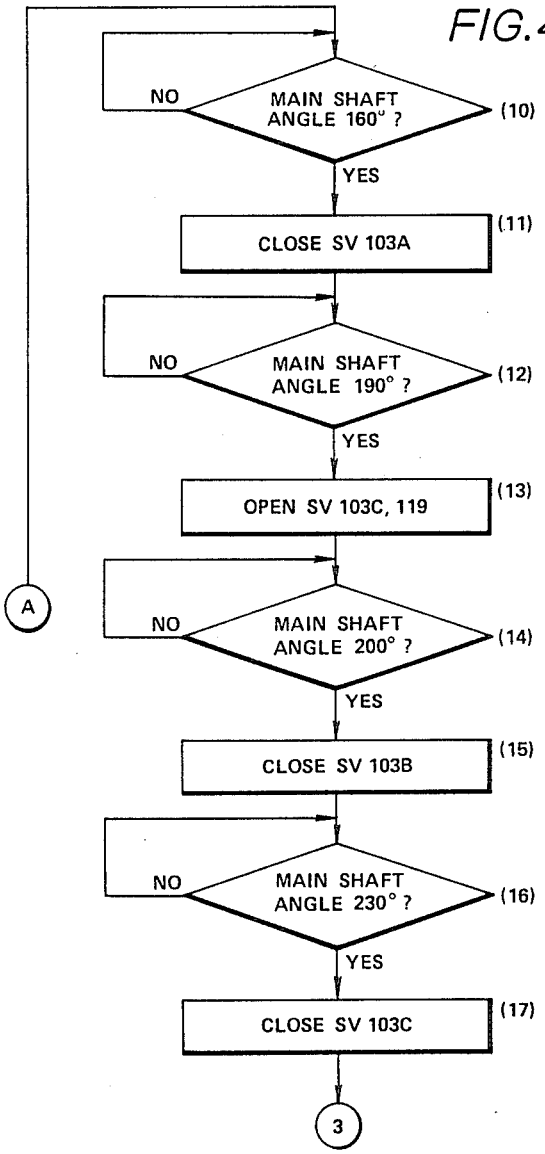
Figure 45C:
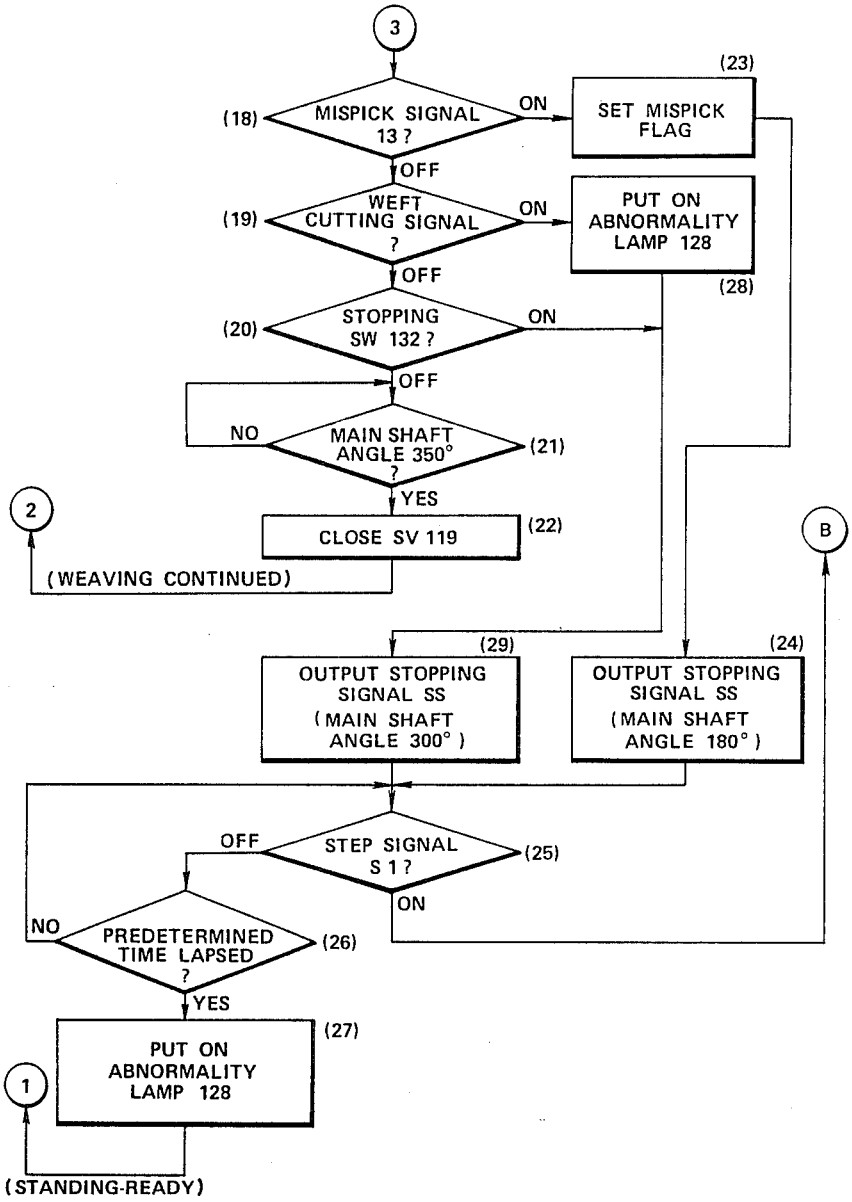

As shown at the step (18) in FIG. 45C, when the mispick aries, the weft detector 32 detects the mispick in the process of beating-up by the reed thereby to output the mispick signal, i.e., making the mispick signal ON. Then, the microcomputer 679 discriminates this (18) thereby to output the stopping signal SS to the automatic re-start circuit 678 and set the angular position of the main shaft 51 at 180 degrees in a cycle subsequent to the cycle where the mispick arises (24) after the mispick flag is set (23).

Subsequently, a discrimination of ON or OFF condition of the step signal S1 from the automatic re-start circuit 678 is made (25), in which since the step signal is in ON condition as mentioned after, the flow goes to the next step (30). It will be appreciated that, in the treatment process discussed hereinafter, the step signal is put into the ON condition at predetermined timings in response to the control of the microcomputer 679 for the actuators 615.

Figure 45D:
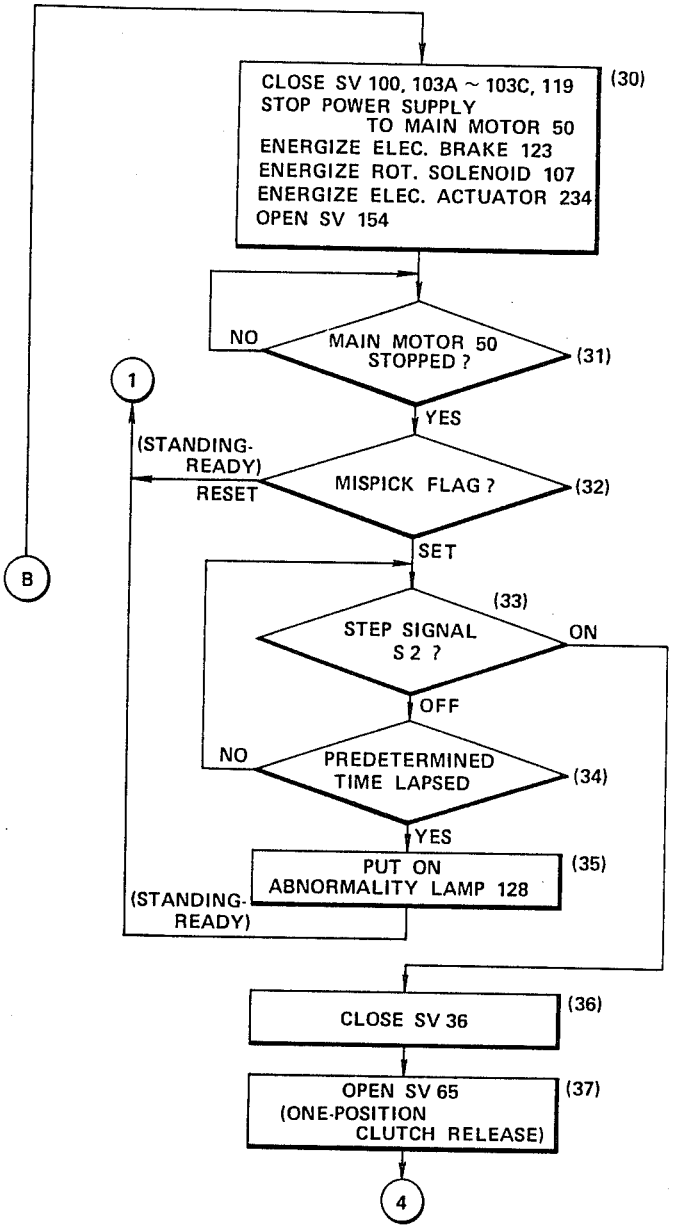
Figure 45E:
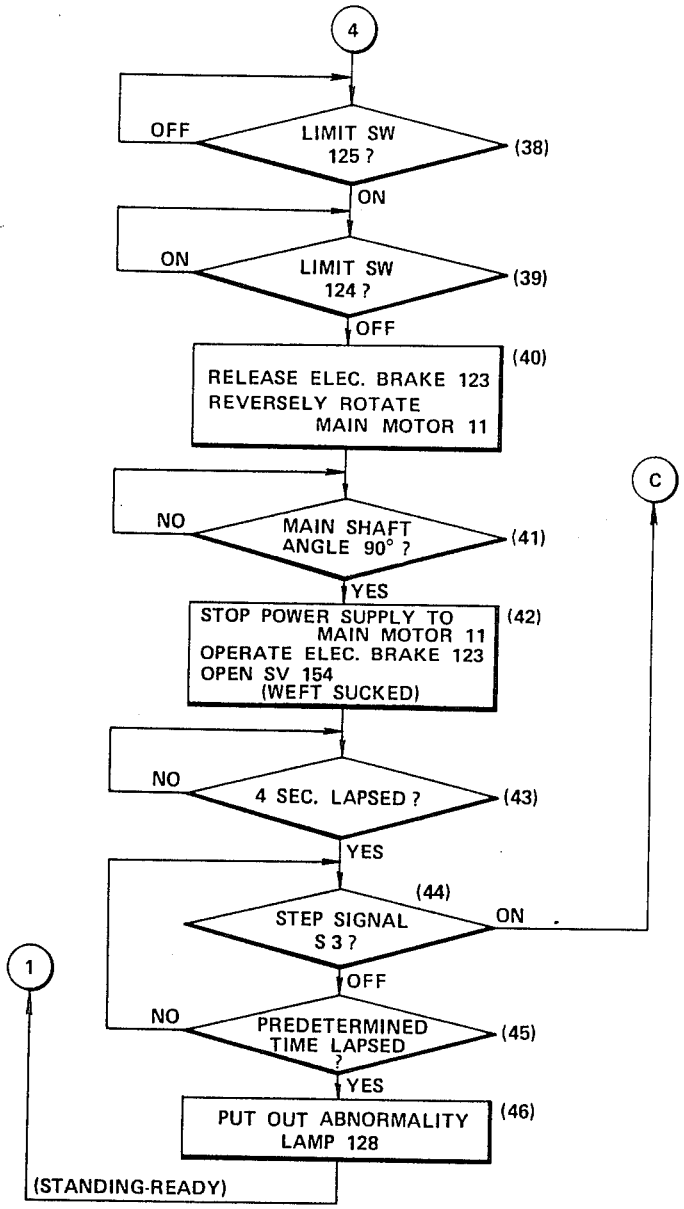
Figure 45F:
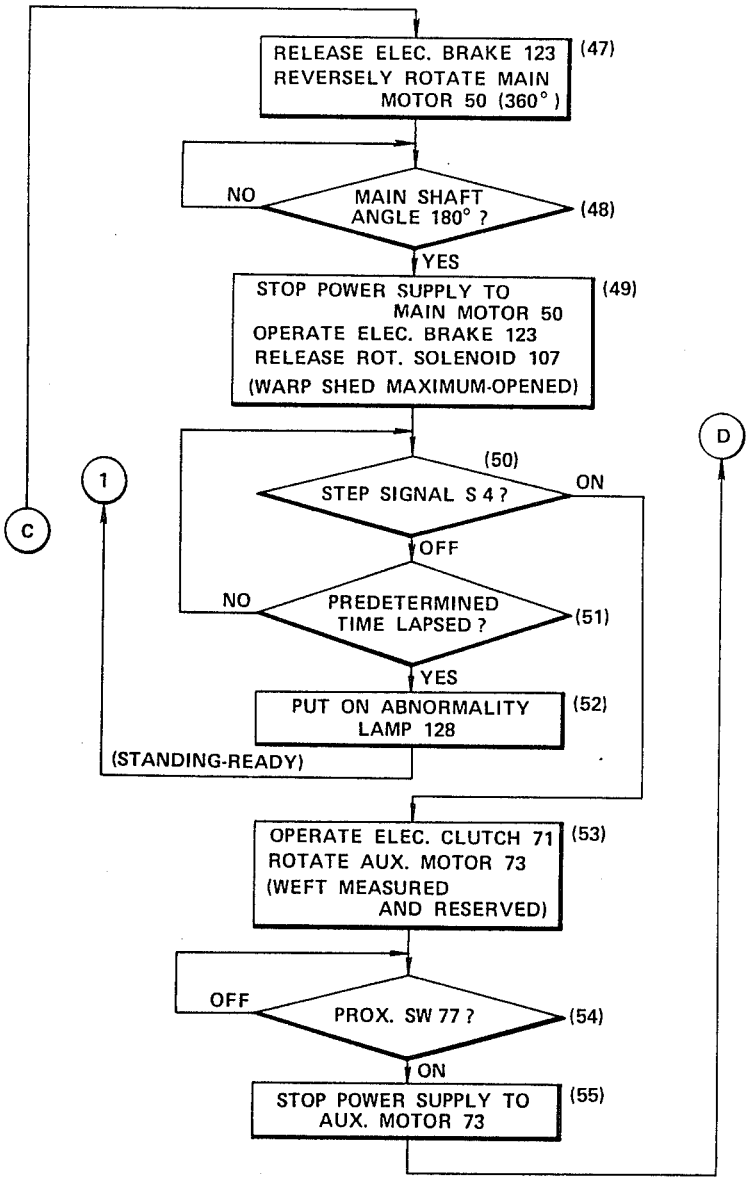
Figure 45G:
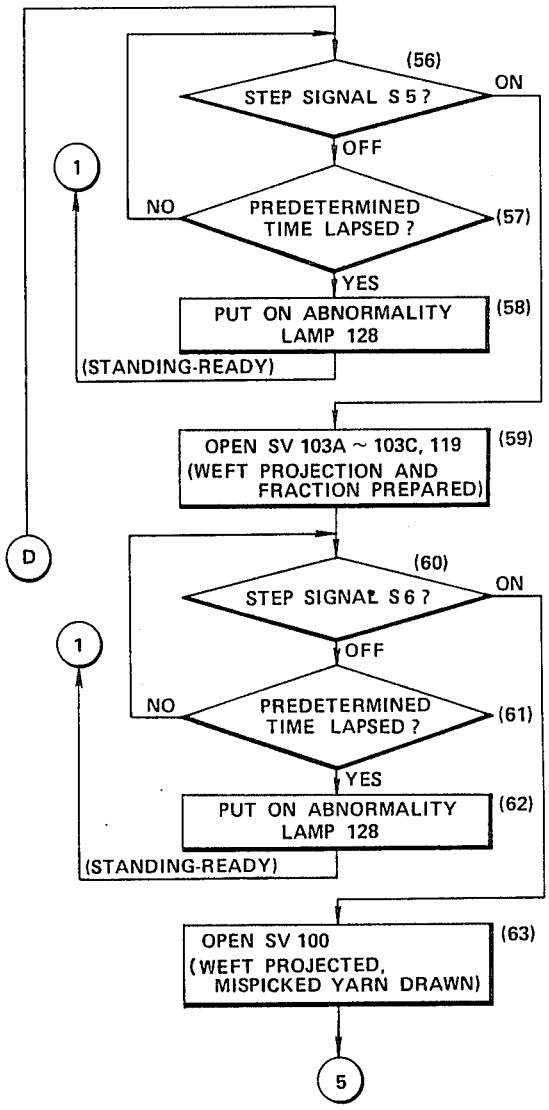

As shown at the step (30) in FIG. 45D, in order to stop the loom operation with the main shaft angular position 180 degrees taking account of inertial movement of the loom, the following operations are performed: power supply stopping to the main motor 50, energizing control of the electromagnetic brake 123, closing control of the solenoid valves 100, 103A to 103C, 119, and energizing control of the rotary solenoid 107 of the weft brake device 105, of the electromagnetic actuator 234 of the cutter disabling device 10 and of the solenoid valve 154 (30). At this time, the weft brake device 105 becomes into a grasping condition for the weft yarn 21, so that the weft yarn 21 is in a condition not to be projected while putting the cutter 28 into an inoperative condition. The mispicked weft yarn M is beaten up by the reed in the loom stopping process in accordance with the above-mentioned loom stopping control. Then, the valve 95 and the solenoid valves 103A to 103C are opened, so that the pressurized air remaining in a piping between the solenoid valve 100 and the valve 95 and in pipings between the solenoid valves 103A to 103C and the auxiliary nozzles 31A to 31C is ejected from the main nozzle 25 and the auxiliary nozzles 31A to 31C, and the engaging member 49 gets out of the drum 43. Since the weft brake 105 grasps the weft yarn 21, the weft yarn 21 is not projected from the main nozzle 25. However, in practice, a slight time is necessary until the weft yarn 21 is completely grasped upon rotation of the movable rod 109 after the rotary solenoid 107 of the weft brake 105 is brought into its energizing condition. Accordingly, the above-mentioned weft yarn 21*a* is slightly projected into the warp shed opening. The movable blade 216A of the cutter 28 is not rotated since electromagnetic actuator 234 is energized.

Figure 46A:
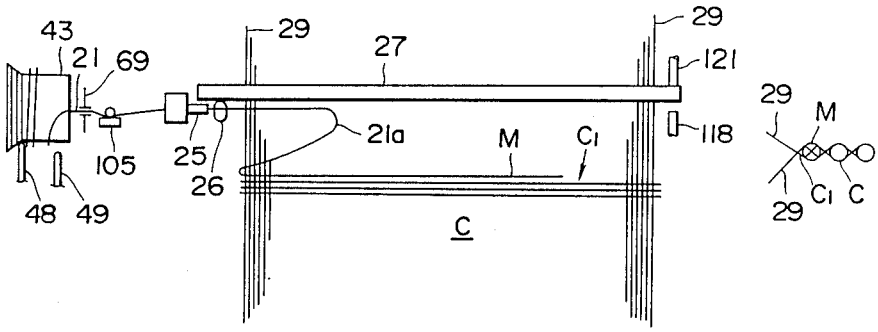
FIGS. 46A to 46I are schematic illustrations showing the process of the mispicked weft yarn removing method of FIGS. 45A to 45L.

Then, the main shaft 51 is completely stopped, and the control circuit 129 recognizes the main shaft stopping in response to the angular signal from the angle sensor 133 (31). At this stopping angle 180 degrees, the reed 27 is in the most-backward position relative to the cloth fell C1 in which the shed opening of the warp yarns 29 becomes the largest. Accordingly, the mispicked weft yarn M is in a state of being beaten up against the cloth fell C1 by the reed, in which the mispicked weft yarn M is connected to the weft yarn 21*a* which has been projected at the above-discussed stopping process. (See FIG. 46A).

The microcomputer 679 recognizes the above-mentioned loom stopping and then makes discrimination whether the cuase for the loom stopping is mispick or not (32). Since the cause is the mispick as assumed above (the mispick flag is in a set condition), the ON condition of step signal S2 is confirmed (33), and then the solenoid valve 36 is closed (36). Therefore, the solenoid valve 65 is opened (37). Upon opening of the solenoid valve 65, the one-position clutch 58 is released. By this, the limit switch 58 is switched ON (38) whilst the limit switch 124 is switched OFF (39), thereby detecting the state-change of the one-position clutch 58.

Next, the electromagnetic brake 123 is released while reversely rotating the main motor 50 (40), in which when the main shaft angular position becomes 90 degrees (41), the electromagnetic brake 123 is operated while stopping power supply to the main motor 50 (42).

Figure 46B:
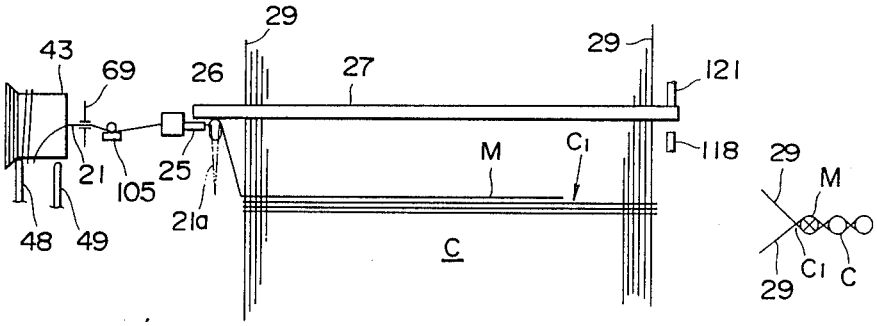

Subsequently, the solenoid valve 154 of the traction device 24 is opened a predetermined time (42). Then, the pressurized air from the pressurized air supply source 38 is fed to the traction pipe 26 through the check valve 153 and the solenoid valve 154 to be ejected as the jet stream J. Consequently, the weft yarn 21*a* slightly projected into the warp shed opening in the loom stopping process is sucked into the traction pipe 26, so that the mispicked weft yarn M becomes into its tensed state under the suction of the traction pipe 26 (See FIG. 46B). After standing ready for 4 seconds to confirm the ON condition of step signal S3 (44), the flow goes to the next step (47).

Figure 46C:
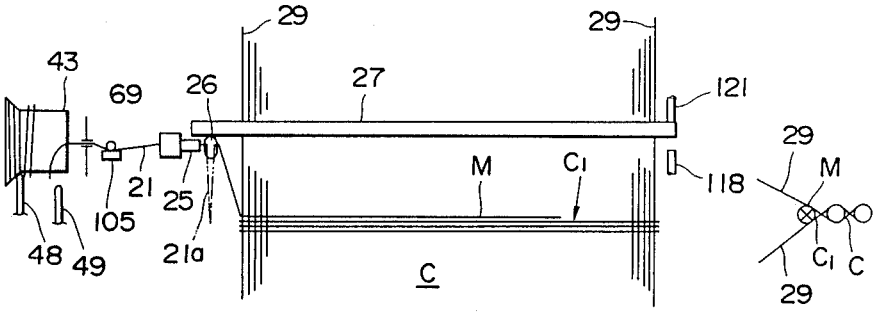

When the electromagnetic brake 123 is released while reversely rotating the main motor 50 by 360 degrees (corresponding to one rotation of the main shaft 51) (47). When the main shaft 51 rotates 360 degrees, the main shaft 51 becomes in the rotational angle 180 degrees in the cycle where the mispick arises. Upon detecting this angular position by the angle sensor 133 (48), the power supply to the main motor 50 is stopped while energizing the electromagnetic brake 123 to brake the main motor 50. Simultaneously, the rotary solenoid 107 of the weft brake 105 is turned OFF to release the grasping action to the weft yarn 21 (49). The above operation makes the warp yarns 29 in the largest shed opening condition in which the mispicked weft yarn M is exposed at the cloth fell C1 (See FIG. 46C).

Figure 46D:
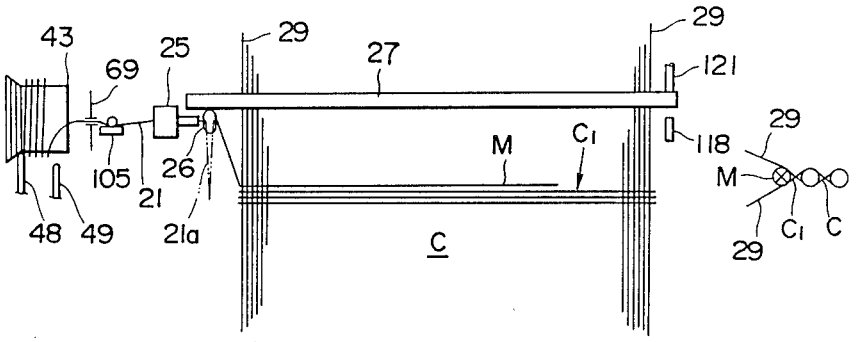

Subsequently, when step signal S4 is confirmed to be in ON condition (50), the electromagnetic clutch 71 is operated and therefore the auxiliary motor 73 is rotated to measure and reserve the weft yarn 21 of the length required for one weft picking (53). The weft yarn length may be smaller than that corresponding to one weft picking. When the engaging member 49 gets out of the drum 43 to turn the proximity switch 677 ON (54), power supply to the auxiliary motor 73 is stopped to interrupt the rotation of the motor 73 since the weft yarn 21 of the length for one weft picking has been reserved (55) (See FIG. 46D).

When step signal S5 is confirmed to be in ON condition (56), the solenoid valves 103A to 103C are opened to eject air from the auxiliary nozzles 31A to 31C, thereby making standing-ready condition for weft yarn projection described after. Additionally, the solenoid valve 119 is opened to make the traction action of the traction device 113 (59).

Figure 46E:
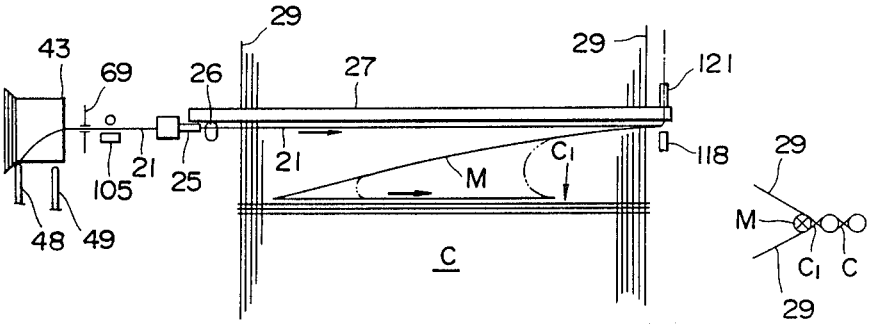

When, step signal S6 is confirmed to be in ON condition (60), the solenoid valve 100 is opened (63). Then, since the engaging member 49 has already got out of the drum 43, the weft yarn 21 is projected in the V-shape into the shed opening of the warp yarns 29 in a state of being connected to the mispicked weft yarn M. At this time, if the mispicked weft yarn M is peeled off from the cloth fell C1 of the woven cloth C, the weft yarn 21 may be caught by the auxiliary nozzle 31A to 31C. In this regard, it is preferable to support the mispicked weft yarn M on the weft picking side until the tip end section of the weft yarn 21 reaches the traction device 113. In the preparation operation, the solenoid valve 119 has already been in an open state, and the mechanical valve 140 becomes in an open state at the present stopping angular position (180 degrees). Accordingly, the tip end section of the projected weft yarn is exposed to the air ejected from the ejection opening 116 and blowin into the introduction opening 117 to be drawn. Under such traction from the counter-weft picking side, the mispicked weft yarn M is successively peeled off from the cloth fell C1 to extend straight from the main nozzle 25 to the introduction opening (See FIG. 46E). The opening of the solenoid valves 100, 103C is made for a sufficient time to peel the mispicked weft yarn M from the cloth fell C1. Additionally, a time for drawing the mispicked weft yarn M is previously set to be sufficiently long to completely remove the mispicked weft yarn M from the cloth fell C1.

Next, when step signal S7 is confirmed to be in ON condition (64), the solenoid valve 154 is opened (67) thereby to make the traction action of the traction device 24. When step signal S8 is confirmed to be in ON condition (68), the solenoid valve 301 is opened (71). Then, the cutter 300 is advanced to the vicinity of the tip end section of the main nozzle 25 and cut the weft yarn 21. The thus cut weft yarn 21 is blown into the introduction opening 117 and fed to the waste yarn receiver 112 (See FIG. 46F). Then, the solenoid valve 301 is opened to restore the cutter 300 to its withdrawn position while closing the solenoid valves 100, 103A to 103C, 119 (71A). Subsequently, when step signal S9 is confirmed to be ON condition (72), the electromagnetic clutch 71 is operated and the auxiliary motor 73 is rotated to measure and reserve the weft yarn 21 of a length required for one weft picking on the drum 43 (75). When the engaging member 49 gets out of the drum 43 to turn the proximity switch ON (76), power supply to the auxiliary motor 73 is stopped (77).

Subsequently when step signal S10 is confirmed to in ON condition (78), the electromagnetic brake 123 is released and the main motor 50 is reversely rotated 240 degrees (81) thereby to set the angular position of the main shaft 51 at 300 degrees (loom starting angular position) in the cycle previous to the cycle where the mispick arises (82), in which power supply to the main motor 50 is stopped and the electromagnetic brake 123 is energized to completely stop the main motor 50 (83) (See FIG. 46G).

Subsequently, when step signal S10 is confirmed to be in ON condition (84), the auxiliary motor 73 is rotated to initiate the reserving of the weft yarn 21 on the drum 43 (87). At a timing over the rotational angle 300 degrees of the clutch counterpart 61, the proximity switch 400 is turned ON (88). After the proximity switch 400 is turned ON, the solenoid valve 65 is closed (89). After lapse of a predetermined time (90), the shifter 63 of the air actuator 64 moves leftward in FIG. 4 to put the one-position clutch 58 into an engageable condition. However, since the one-position clutch 58 is arranged to engage only at the angular position 300 degrees of the clutch counterpart 61, the one-position clutch 58 has not yet engaged in the condition where the clutch counterpart rotates over the angular position 300 degrees. Accordingly, the auxiliary motor 73 further rotates under the condition where the clutch counterparts 61, 59 are in sliding contact with each other. Then, the projection 59A is inserted into the groove 61A at the angular position 300 degrees of the clutch counterpart 61 in the next rotation of the clutch counterpart 61, so that the auxiliary motor 73 is compulsorily stopped under the mechanical load on the side of the main shaft 51. Immediately after this, the electromagnetic clutch 71 is turned OFF to be released, and power supply to the auxiliary motor 73 is stopped (91). At this stage, the rotational torque of the clutch counterpart 61 is lost to further move the clutch counterpart 59 leftward, so that the projection 59A and the groove 61A completely engage with each other. Accordingly, the limit switch 124 is turned ON.

The engaging members 48, 49 are repeating their engaging and disengaging (getting-out) actions relative to the drum 43, in which the weft yarn 21 is projected from the main nozzle 25 when the engaging member 49 disengages or gets out of the drum 43. Now, the weft yarn 21 is standing ready in a tensed state upon being sucked into the introduction opening 152 under the jet stream J from the traction pipe 26.

Figure 46F:
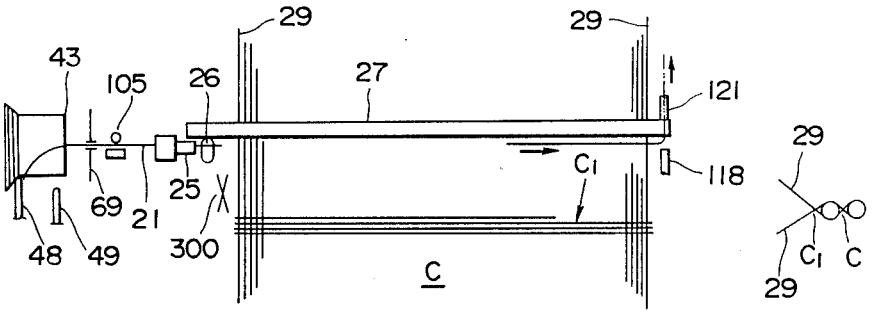
Figure 46G:
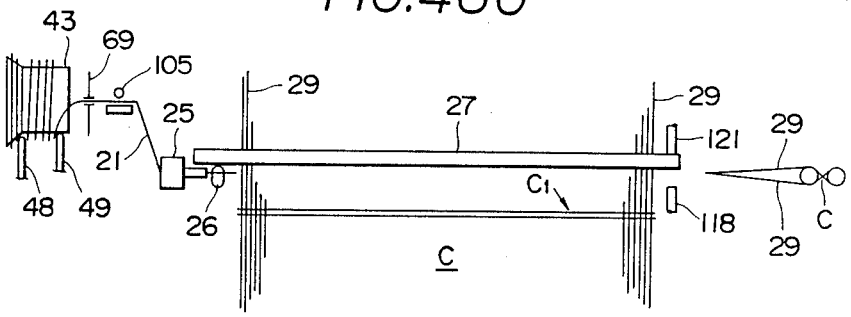
Figure 46H:
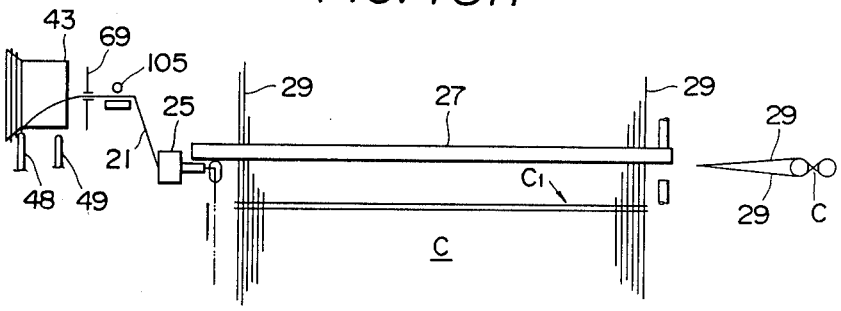
Figure 46I:
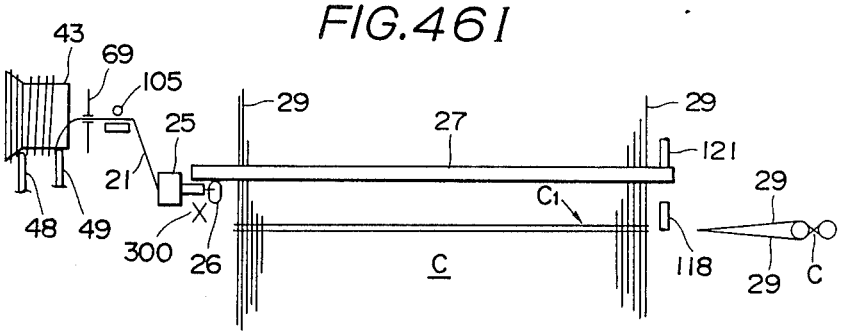

When the limit switches 124 is turned ON (92), step signal S12 is confirmed to be in ON condition (93) and the solenoid valve 301 closed (95A), thereby cutting the weft yarn 21 in a tensed state by the cutter 300 (See FIG. 46I). Then, after the starting preparation signal SJ is output to the automatic re-start circuit 78 (96), the electromagnetic brake 123 is released (97). When step signal S13 is confirmed to be in ON condition (98), the solenoid valves 154, 301 are closed and the electromagnetic actuator 234 of the cutter disabling device 10 is turned OFF so that the movement preventing member 230 becomes out of the moving region of the drive lever 222 thereby to put the cutter 28 in a condition where the shearing action thereof is possible. Additionally, the solenoid valves 36, 100, 103A to 103C, 119 ar opened to supply the main motor with power. Lastly, the mispick flag is reset thereby to complete a series of starting preparation. Therefore, the flow goes to the step (6) in FIG. 45A thereby to automatically re-start the loom.

Next, the operation of the automatic re-start circuit 678 will be discused with reference to FIG. 42.

In the weft picking process, when the micocomputer 679 detects the absence of the weft yarn 21 under the action of the weft detector 32, it outputs the stopping signal SS. This stopping signal SS causes the loom to stop at the angular position 180 degrees of the main shaft 51. In this stopping process, the mispicked weft yarn M is connected to the main nozzle 25 since the cutter 28 is made disable.

The rotary solenoid 107 is turned ON due to the stopping signal SS thereby to grasp the eeft yarn 21 under the action of the movable rod 109; however, the grasping action starts at the initial period of the weft picking phase or period in the next weaving cycle. Accordingly, a slight weft picking is made. Because this stopping phase or timing corresponds to the weft picking phase or timing at which the reed 27 is at the most-backward position, so that air remaining between the solenoid valve 100 and the valve 95 is ejected from the main nozzle 25 in this stopping process. The thus picked weft yarn 21*a* is drawn under the action of the air stream J ejected from the ejection opening 150 upon opening of the solenolid valve 154 and removed from the warp shed opening.

The stopping signal SS from the microcomputer 679 is also input to the NAND gate 921, in which this input signal is changed from at L level to at H level due to the stopping signal. At this time, step signal at H level is output from a terminal T0 of the decoder 356 to the NAND gate 921. It is to be noted that the step signal S0 is at H level during normal loom operation.

Additionally, since the NAND gate 921 is supplied with the H level signal from the timer T1, so that the output therefrom is changed from at H level to at L level and converted to a trigger signal by the differentiator 941. By this, the counter 955 counts up from 0 to 1. As a result, the decoder 956 outputs from its terminal T1 the step signal S1 at H level, thereby closing the solenoid valves 100, 103A, 103B, 103C, 119. This step signal S1 is also fed to the NAND gate 922.

The weft discriminating signal 764 is input at H level from the weft discriminating device 681 to the NAND gate 322. Additionally, if pulse signal is not fed from the angle sensor 133 for more than a predetermined time, i.e., the rotation of the main shaft 51 is stopped, the main shaft stopping signal S is changed from at L level to at H level so that the output of the NAND gate 922 is changed from at H level to at L level. At this time, trigger signal is output from the differentiator 942, so that the counter 955 counts up by one to output 2. If the weft discriminating signal 764 is not output from the weft discriminating device 681, the counting-up is not made, making the stopping as it is.

As a result, the decoder 956 outputs from its terminal $T_2$ the step signal at H level. This step signal S2 causes the solenoid valve 154 to open in accordance with the program of the microcomputer 674, thereby drawing the weft yarn 21*a*. During this, the solenoid valve 65 is opened to allow the operating rod 64A to project, so that the clutch counterpart 59 is moved rightward by the shifter 63 thereby to release the clutch 58. Then, the electromagnetic brake 123 is turned OFF, and the auxiliary motor 73 is turned ON to be reversely rotated so as to be stopped at 90 at an angle of 90 degrees. After completion of this, clocking of 4 seconds is made by the timer T3 and the standing-ready condition for the step signal S3 is made.

This signal S2 is also fed to the NAND gate 323. Connected to this NAND gate 323 are a timer T3 whose output changes from at L level to at H level after 4 seconds from initiation of clocking upon receiving the signal S2 and a signal line for transmitting a signal which is changed from at L level to at H level when the angle sensor 133 outputs the signal representing 90 degrees. Accordingly, after the above-described 4 seconds, i.e., after lapse of a sufficient time to remove the weft yarn 21*a* by drawing it projected into the inside of the warp yarn shed opening in the loom stopping process and to release the one-position clutch 58, an and-operation is made between the output from the timer T3 and the signal representing 90 degrees in the angle sensor 133. When the main shaft 51 stops at 90 degrees, the tip end section of the auxiliary nozzles 31A to 31C gets out of the lower yarn array or surface of the warp yarns 29, thereby preventing the weft yarn 21*a* from being impossible to be drawn upon being caught by the auxiliary nozzle 31A to 31C during traction and removal operation of the weft yarn 21*a*.

When signal from the timer T3 changes from at L level to at H level, the output of the NAND gate 923 changes into at L level, so that the differentiator 943 outputs trigger signal, the counter 955 counts up to obtain 3, and the the signal S3 at H level is output from the terminal T3 of the decoder 356. In accordance with this signal S3, the microcomputer 679 causes the electromagnetic brake 123 to release, and the main motor 50 is reversely rotated and stopped at the main shaft angular position 180 degrees thereby exposing the mispicked weft yarn M at the cloth fell C1.

The signal S3 is fed to the NAND gate 924 and to the timer T4. The timer T4 is adapted to output signal which changes from at L level to at H level after a predetermined time (for example, 4 seconds), i.e., after a sufficient time to complete the stopping at 180 degrees upon the main motor reverse rotation, so that the output of the NAND gate 924 is changed from at H level to at L level. Accordingly, the output signal from the NAND gate 924 is changed into the trigger signal by the differentiator 944, so that the counter 955 counts up by 1. By this, the counter 955 outputs 4 and therefore the decoder 956 outputs from its terminal T4 the step signal S4 at L level.

In accordance with this signal S4, the microcomputer 679 causes the electromagnetic clutch 71 to be turned ON and the auxiliary motor 73 to be turned ON. As a result, the winding arm 44 is rotated through the shaft 62, the shaft 68 and the pulley 68A, thereby winding up the warp yarn 21 of the length corresponding to one weft picking on the drum 43. This winding operation is carried out until the engaging member 49 moving in timed relation to the winding arm 44 gets out of the drum 43 so that the function piece 676 faces the proximity switch 677 thereby to turn the proximity switch ON after the engaging member 49 is projected to or engaged with the drum 43, so that the weft yarn 21 of the length corresponding to one weft picking is wound around the drum 43. Since the signal S4 is also fed to the NAND gate 925, the output of the NAND gate 925 changes from at H level to at L level when the engaging member 49 gets out of the drum 43 so that the proximity switch 677 is turned ON thereby to change its output signal from at L level to at H level. As a result, the differentiator 945 outputs the trigger signal, so that the counter 955 counts up by 1 to obtain 5. The decoder 956 upon receiving the trigger signal outputs the signal S5 at H level from its terminal T5.

In accordance with this signal S5, the microcomputer 679 causes the solenoid valves 119, 103A to 103C to open. Additionally, this signal S5 is fed to NAND gate 923 and to the timer T6. The output of the timer T6 changes from at L level to at H level after lapse of a predetermined time (for example, 2 seconds) from receiving the signal S5. By this, the output signal of the NAND gate 926 changes from at H level to at L level, so that the differentiator 946 outputs trigger signal, thereby allowing the counter 955 to count up by 1 to output 6. Upon receiving the output of the counter 955, the decoder 956 outputs the signal S6 at H level.

In accordance with this signal S6, the microcomputer 679 opens the solenoid valve 100 thereby to eject air from the main nozzle 25 so that the weft yarn 21 wound on the drum 43 is blown up toward the counter-weft picking side under assistance of the air jets from the auxiliary nozzles 31A to 31C while being blown into the introduction pipe 121 under air ejection from the solenoid valve 119 thereby to draw the weft yarn. By this, the mispicked weft yarn M is removed in such a manner as to be peeled off from the cloth fell C1 with advance of the weft yarn 21 toward the counter-weft picking side in which the weft yarn 21 connected to the mispicked weft yarn M is kept generally in the V-shape. Then, the weft detector 32 detects the weft yarn 21 to output signal which changes from at L level to H level.

The signal S6 is fed together with the output of the weft detector 32 to the NAND gate 927 and to the timer T7. The output of the timer T7 changes from at L level to at H level after lapse of a predetermined time (for example, 2 seconds), i.e., such a sufficient time that the weft yarn 21 reaches the weft detector 32, from receiving the signal S6. This causes the output of the NAND gate 927 to change from at H level to at L level, so that the differentiator 947 outputs the trigger signal, thereby allowing the counter 955 to count up by 1 to output 7. Accordingly, the step signal S7 is output from the terminal T7. Upon receiving this signal S7, the microcomputer 679 causes the solenoid valve 154 to open, so that pressurized air is ejected from the ejection opening 150 of the traction device 24 thereby to draw the weft yarn 21.

The signal S7 is fed to the NAND gate 928 and to the timer T8. This timer T8 outputs signal which changes from at L level to at H level after lapse of a predetermined time (for example, 2 seconds) from receiving the signal S7, so that the output of the NAND gate 923 changes from at H level to at L level. As a result, the differentiator 948 outputs the trigger signal thereby allowing the counter 955 to count up by 1 to output 8. Upon receiving the signal from the counter 955, the decoder 956 outputs signal S8 at H level from its terminal T8.

In accordance with this signal S8, the microcomputer 679 causes the solenoid valve 301 to open thereby advancing the cutter 300 to cut the weft yarn 21 between the traction device 24 and the warp yarns 29. This signal S8 is fed to the NAND gate 928 and to the timer T9. The timer T9 outputs the signal which changes from at L level to at H level after a predetermined time (for example, 5 seconds), i.e., such a sufficient time that the weft yarn cut by the cutter 300 is completely drawn into the introduction pipe 121, from receiving the signal S8. The NAND gate 929 is connected with the weft detector 32 which outputs the signal changing from at L level to at H level upon detecting absence of the weft yarn. Accordingly, when the weft yarn 21 is drawn into the introduction pipe 121, the output signal from the weft detector 32 becomes at H level. Additionally, the output of the timer T9 changes to at H level after 5 seconds, so that the output of the NAND gate 929 changes from at H level to at L level. Accordingly, the differentiator 949 outputs the trigger signal thereby causing the counter 955 to count up by 1 to output 9. Upon receiving this output signal from the counter 955, the decoder 956 outputs signal S9 at H level from its terminal T9. When this signal S9 is fed to the microcomputer 679, the weft yarn 21 of the length corresponding to one weft picking is measured and reserved on the drum 43.

The signal S9 is fed to the NAND gate 930, in which an and-operation is made between the signal S9 and the signal from the proximity switch 677. When the weft yarn 21 of the length corresponding to one weft picking on the drum 43, the proximity switch 677 is turned ON, so that an and-operation of the NAND gate 930 is made thereby outputting signal at H level. Accordingly, the counter 955 counts up by 1 so that the counted value becomes 10 from 9. Upon receiving this signal from the counter 955, the decoder 956 outputs step signal at H level from its output terminal T10.

In accordance with this signal S10, the microcomputer 679 causes the solenoid valves 119, 103A to 103C to open, the electromagnetic brake 123 to be turned OFF, and the main motor 50 to reversely rotate to obtain the initial main shaft angular position 300 degrees (the loom starting angular position), i.e., 300 degrees in the cycle previous to the cycle where the mispick arises, in which the electromagnetic brake 123 is turned ON and the main motor is turned OFF to be stopped thereby completing starting condition of the side of the main shaft 56.

This signal S10 is fed to the NAND gate 931 and to the timer T10. The timer T10 outputs signal which changes from at L level to at H level after lapse of a sufficient time (for example, 5 seconds) necessary for the above-mentioned reverse rotation to 300 degrees. By this, the output of the NAND gate 931 changes from at H level to at L level, so that the differentiator 951 outputs the trigger signal, thereby allowing the counter 355 to count up by 1 to output 11. This causes the decoder 956 to output signal S11 at H level from its terminal T11.

In accordance with this signal S11, the microcomputer 679 drives the auxiliary motor 73 to rotate the winding arm 44 so that the weft yarn 21 is wound on the drum 43. At the angular position 300° of the shaft 62 or when the function piece 401 faces the proximity switch 400 so that the proximity switch 400 is turned ON thereby closing the solenoid valve 65. By this, the operating rod 64A of the air actuator is withdrawn under the action of a spring (not shown) so that the projection 59A of the clutch counterpart 59 is brought into engagement with the groove 61A of the clutch counterpart 61; however, the one-position clutch 58 is so arranged as to engage only at a phase or rotational position (300 degrees). Accordingly, in practice, the projection 59A is brought into engagement with the groove 61A when the angular position 300 degrees has come upon a further rotation. Then, the starting condition is completed. In this state, although the auxiliary motor 73 is turned ON, it cannot rotate under load on the side of the main shaft 56. Thereafter, the electromagnetic clutch 71 and the auxiliary motor 73 are turned OFF upon lapse of a predetermined time. On this stage, the clutch counterpart 61 losts its rotational torque, in which the clutch counterpart 59 moves leftward thereby to be brought into complete engagement with the clutch counterpart 61. Upon this engagement, the limit switch or microswitch 124 is turned ON, thereby outputting signal at H level. Additionally, during the above-described weft winding operation, the engaging member 49 gets out of the drum 43 and the solenoid valve 154 opens, so that the weft yarn 21 is drawn into the traction device 24 under the influence of air ejection from the ejection opening 150. As a result, the weft yarn 21 stands ready in a tensed state.

The signal S11 is fed to the NAND gate 922 and to the timer 11. The timer 11 is adapted to output signal which changes from at L level to at H level after lapse of a sufficient time (for example, 5 seconds) to wind the weft yarn 21, from receiving the signal S11. At this time, since the output of the microswitch 124 has already changed into at H level, the output of the NAND gate 932 changes from at H level to at L level in accordance with the output variation of the timer T11, so that the differentiator 952 outputs the trigger signal. Accordingly, the counter 955 counts up by 1 thereby to output 12. Upon receiving this signal from the counter 955, the decoder 956 outputs signal S12 at H level from its terminal T12.

In accordance with this signal S12, the microcomputer 679 outputs the starting preparating signal SJ while turning the electromagnetic clutch 71 OFF and electromagnetic brake 123 OFF.

This signal S12 is fed to the NAND gate 933 and to the timer T12. The timer T12 is adapted to output signal which changes from at L level to at H level after lapse of a sufficient time (for example, 5 seconds) to complete the starting preparation, from receiving the signal S12, in which the output of the NAND gate 933 changes from at H level to at L level. This causes the differentiator 953 outputs the trigger signal, so that the counter 955 counts up by 1 to output 13. Upon receiving this signal from the counter 955, the decoder 956 outputs signal S13 at H level from its terminal T13.

In accordance with this signal S13, the microcomputer 679 causes the solenoid valves 154, 100 to close and the main motor 50 to be driven thereby re-start the loom. This signal S13 is fed to the NAND gate 934 and to the timer T13. The timer T13 is adapted to output signal which changes from at L level to at H level after lapse of a predetermined time (for example, 5 seconds) from receiving the signal S13. Since the starting preparating signal SJ at H level is fed from the micrcomputer 679 to the NAND gate 934, the output of the NAND gate 934 changes from at H level to at L level when the output of the timer T13 changes from at L level to at H level. This causes the differentiator 954 to output the trigger signal, so that the counter 955 counts up by 1, i.e., signal S0 at H level is output from the terminal T0 upon making a reset.

This signal S13 is fed to the timer T1 connected to the NAND gate 921. This timer T1 is adapted to output signal which changes from at L level to at H level after lapse of a predetermined time (for example, 60 seconds). Accordingly, if the stopping signal SS is input during 65 seconds after starting of the loom, the output of the NAND gate 921 does not change to at L level so that counting-up is not made, thus preventing automatic re-start. In this connection, during normal loom operation, only the output signal S0 of the decoder 956 is at H level whilst the signals S1 to S13 are at L level.

Figure 45H:
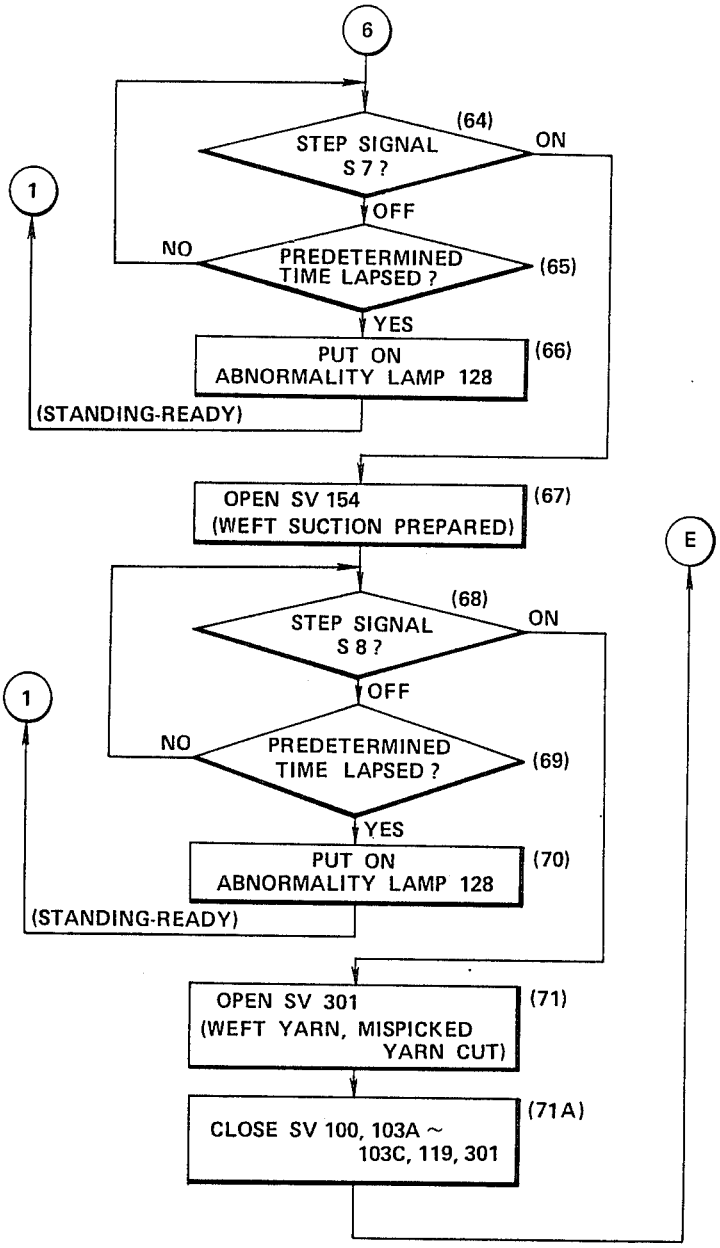
Figure 45I:
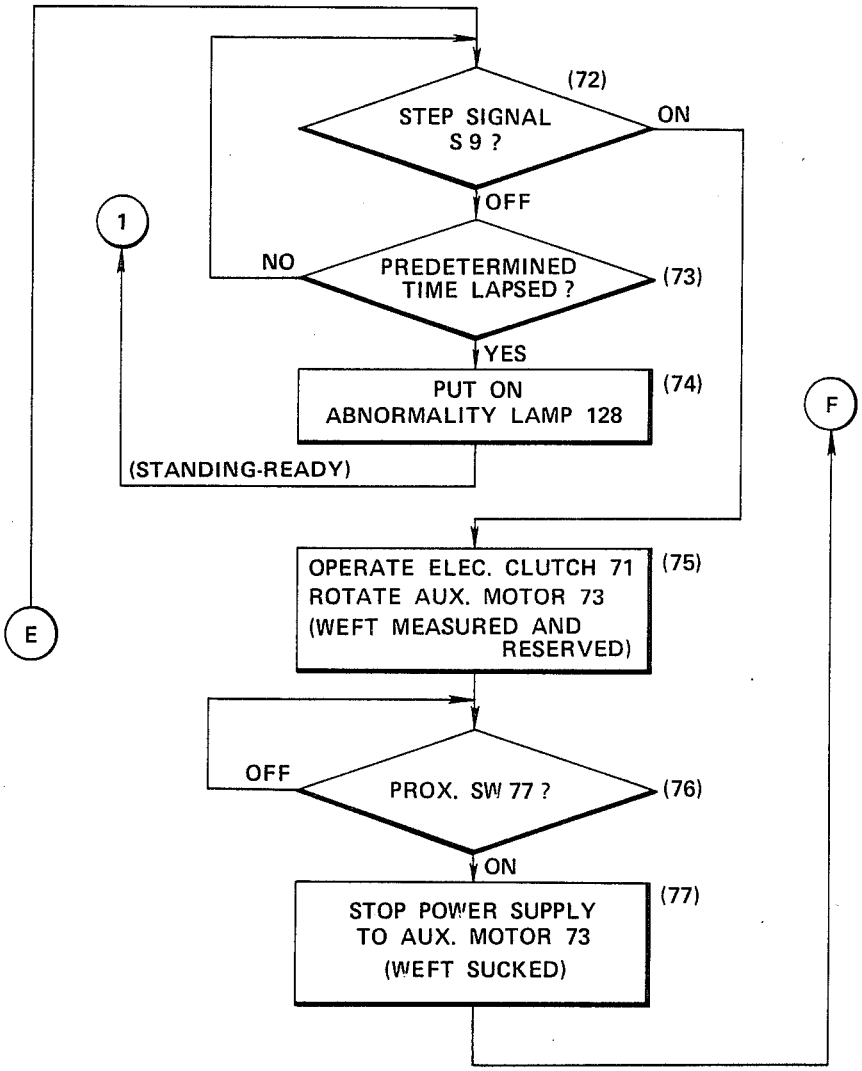
Figure 45J:
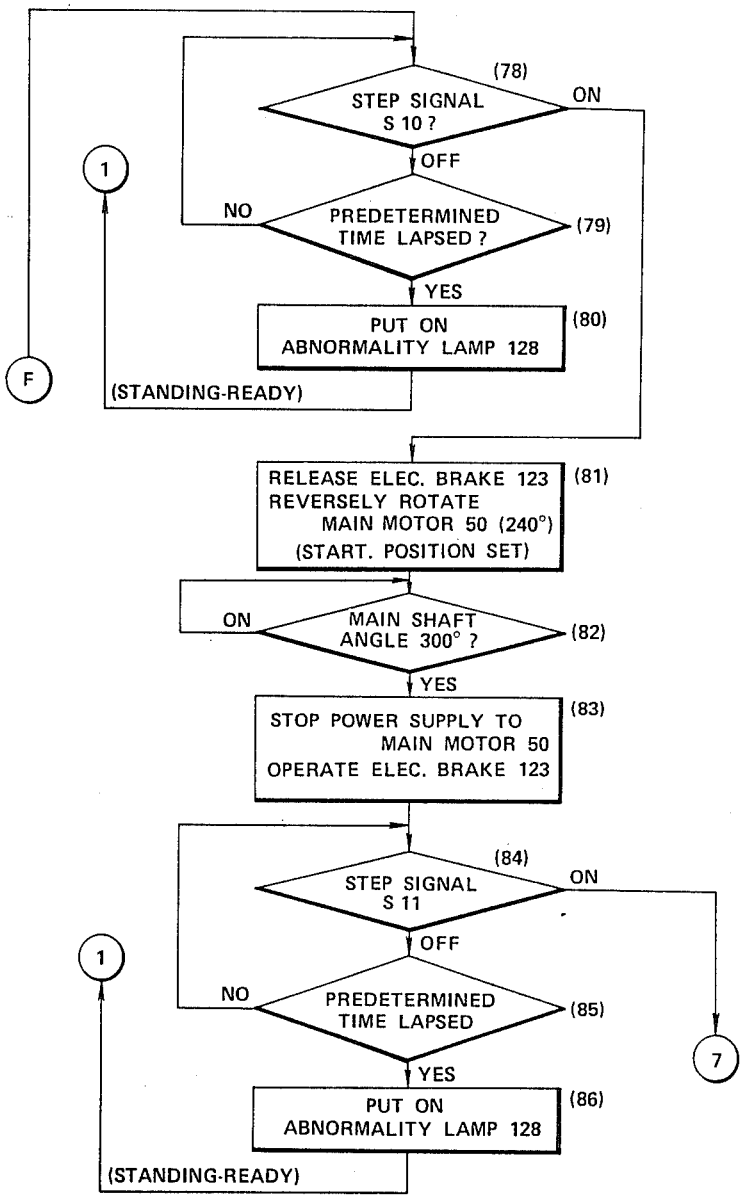
Figure 45K:
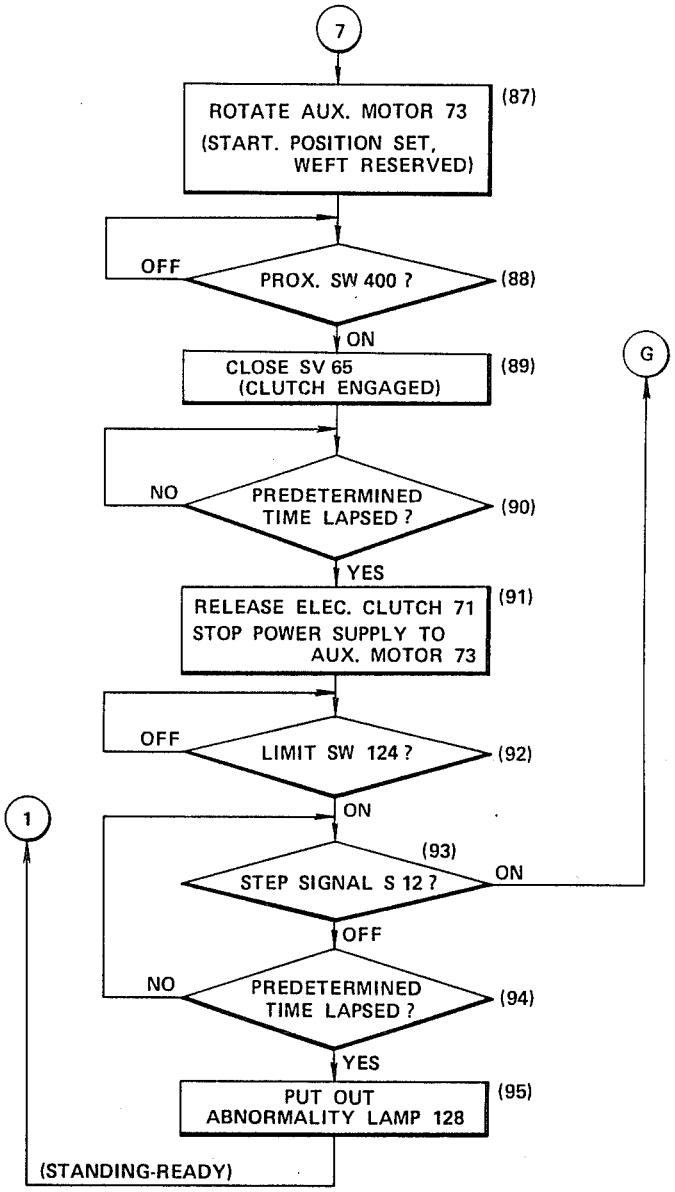
Figure 45L:
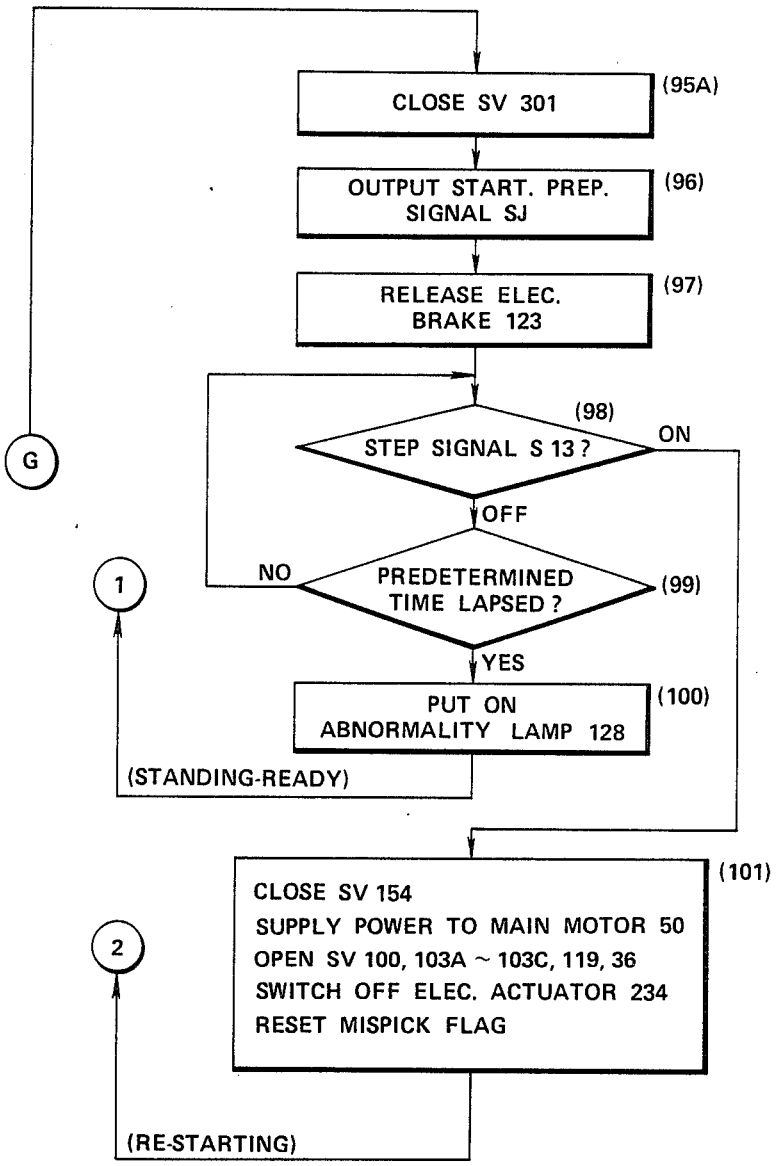

Now, assuming that during normal weaving operation the electronic circuit in the control circuit 129 malfunctions in which, for example, the operation of the program of the microcomputer 679 falls into confusion before a step (68) in FIG. 45H, the following operations will be performed. First the step signal S8 is confirmed to be in ON condition or not according to a step signal discrimination routine. Then, watching is continued for a predetermined time (69). However, the automatic re-start circuit 678 has not yet output the step signal S8 to the microcomputer 679, and consequently the abnormality lamp 728 is lighted (70) to take a standing-ready condition.

Accordingly, the cutter 300 does not operate since the flow does not go to the step (71). This previously prevents a serious drawback in which the cutter 300 strikes against the reed 27 and the like to damage or break the loom if the cutter 300 operates.

In case where the program of operation falls into confusion in such a manner that the flow goes to the other step, the similar operation will be performed.

Figure 47A:
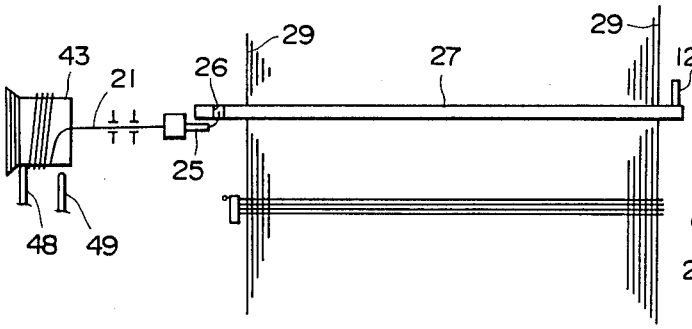
FIGS. 47A to 48C are schematic illustrations showing steps which may be added to the process of FIGS. 46A to 46I.
Figure 47B:
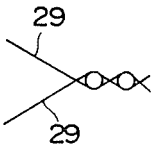
Figure 48A:
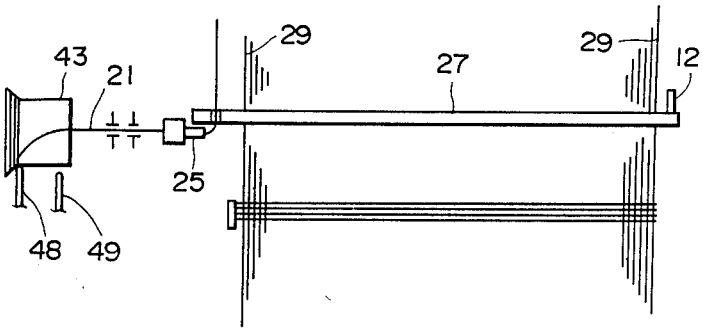
Figure 48B:
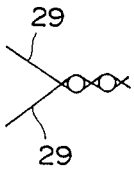
Figure 48C:
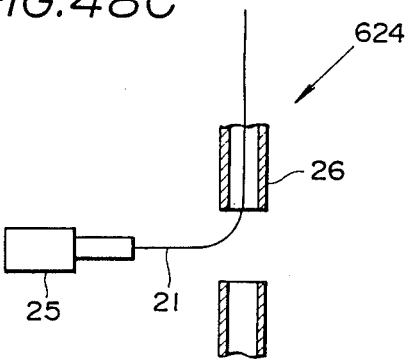

While the third embodiment is arranged to perform the mispicked weft yarn removing method in which only a short weft yarn portion is sucked into the pipe 26 of the weft traction device 624 on the weft picking side as shown in FIG. 46F, it will be appreciated that the following additional steps may be carried out after the weft yarn cutting step shown in FIG. 46F and before the reed 27 has not moved toward the cloth fell: First a fresh weft yarn of a length corresponding to about one weft picking is measured and wound on the drum 43 upon rotating the auxiliary motor 73 as shown in FIGS. 47A, 47B. The rotation of the auxiliary motor 73 is stopped in a condition where the engaging member 49 gets out of the drum 43. Then the weft brake 105 is released, so that the weft yarn 21 gets out of the main nozzle 25 under the influence of air jet from the main nozzle. The weft yarn 21 is then fed into the pipe 26 of the traction device 624 on the weft picking side under suction of the pipe 26 as shown in FIGS. 48A, 48B, 48C. As a result, a relatively long portion of the weft yarn is being drawn into the weft traction pipe 26, and therefore the weft yarn 21 is prevented from being getting out of the traction device 624 even under flapping action of the reed 27 and disturbed traction-air stream and air jet stream from the main nozzle 25, thus allowing the weft yarn 21 to be securely maintained in position.

It will be understood that, in order to interrupt cutting action for the mispicked weft yarn M, the loom may be provided with such an arrangement that the weft yarn 21 is prevented from advancing into the opening 220 of the cutter 28, or with such arrangement that the cutter 28 is made disable upon releasing the movable blade 216A from its press-contact with the fixed blade 216B.

While the weft length-measuring and reserving device 23 is shown and described as being of the type wherein the weft yarn of the length corresponding to one or two weft pickings is reserved between the engaging members 48, 49, it will be understood that the weft length-measuring and reserving device may be of the type wherein the weft yarn 21 of the length larger than that corresponding to one or two weft pickings is wound around the drum 43 in which regulation of the weft yarn length of one weft picking is made upon engagement and disengagement of the engaging members 48, 49 with the drum 43.

Although the traction device 113 has been shown and described as drawing the weft yarn 21 under the influence of air stream, it will be appreciated that the traction device may be of the type wherein the weft yarn is rolled up on a roller.

It will be appreciated that the weft picking after a mispick may be made in a stage where the main shaft 51 is stopping, in which the mispicked weft yarn M is exposed at the cloth fell after the weft yarn at the main shaft stopping stage is peeled off from the cloth fell.

Furthermore, it will be understood that the weft yarn 21 may be caught by the auxiliary nozzles 31A–31D if the mispicked weft yarn M is peeled off from woven cloth side during weft picking under the action of the weft carrying device 12. Therefore, it is preferable to support the mispicked weft yarn M on the weft picking side.

While only air jet loom have been shown and described, it will be appreciated that the principle of the present invention may be applied to water jet looms in which weft insertion is made under the influence of water jet, or to rapier looms in which weft insertion is made under the action of a rapier for carrying a weft yarn into a warp shed.

What is claimed is:

1. A method of removing a mispicked weft yarn in a loom, comprising the following steps in the order named:

stopping operation of the loom in a state where the mispicked weft yarn is connected to weft inserting means, after the mispicked weft yarn is beaten up by a reed;

exposing the mispicked weft yarn at cloth fell of a woven cloth;

inserting a weft yarn connected to the mispicked weft yarn from a weft picking side to a counter-weft picking side of the loom; and drawing the inserted weft yarn together with the mispicked weft yarn to the counter-weft picking side.

2. A method as claimed in claim 1, further comprising producing a mispick signal representative of occurrence of a mispick, before the loom operation stopping step.

3. A method as claimed in claim 1, wherein the loom operation stopping step includes stopping the loom operation at a predetermined angular position of a main shaft of the loom.

4. A method as claimed in claim 3, wherein the mispicked weft yarn exposing step includes reversely rotating the main shaft of the loom to a predetermined angular position at which the mispicked weft yarn is in a condition to be inserted into an open shed of warp yarns.

5. A method as claimed in claim 4, wherein the predetermined angular position of the mispicked weft yarn exposing step is advanced 360 degrees relative to the predetermined angular position of the loom operation stopping step.

6. A method as claimed in claim 1, wherein the loom operation stopping step includes putting a first cutter into an inoperative condition, the first cutter being for cutting the weft yarn during normal weaving operation.

7. A method as claimed in claim 1, further comprising the step of reserving the weft yarn of a predetermined length in a weft measuring and reserving device located upstream of the weft inserting means, before the weft yarn inserting step.

8. A method as claimed in claim 7, wherein the predetermined length corresponds to about two weft pickings.

9. A method as claimed in claim 7, wherein the predetermined length is shorter than a length corresponding to two weft pickings.

10. A method as claimed in claim 1, wherein the weft yarn inserting step includes projecting the weft yarn from a weft inserting nozzle on the weft picking side to the counter-weft picking side through an air guide channel.

11. A method as claimed in claim 10, wherein the weft yarn inserting step includes ejecting air from the weft inserting nozzle and from auxiliary nozzles located along the air guide channel.

12. A method as claimed in claim 11, wherein inserted weft yarn drawing step includes maintaining air ejection from the weft inserting nozzle and from the auxiliary nozzles for a predetermined time.

13. A method as claimed in claim 12, wherein the predetermined time is sufficiently long to peel off the mispicked weft yarn from the cloth fell.

14. A metheod as claimed in claim 1, wherein the inserted weft yarn drawing step includes drawing the inserted weft yarn together with the mispicked weft yarn under suction of a traction device located on the counter-weft picking side.

15. A method as claimed in claim 1, wherein the inserted weft yarn drawing step includes peeling off the mispicked weft yarn from the cloth fell.

16. A method as claimed in claim 15, further comprising the step of putting the inserted weft yarn between the weft inserting nozzle and warp yarns in a tensed condition after the mispicked weft yarn is peeled off from the cloth fell, and thereafter cutting the inserted weft yarn by a cutter.

17. A method as claimed in claim 16, further comprising the step of increasing the length of the weft yarn sucked into a traction device on the weft picking side after the inserted weft yarn cutting step, the length increasing step including reserving the weft yarn of a predetermined length in a weft measuring and reserving device located upstream of the weft inserting nozzle, and thereafter operating the weft measuring and reserving device so that the reserved weft yarn is fed through the weft inserting nozzle into the traction device on the weft picking side.

18. A method as claimed in claim 1, further comprising the step of cutting the inserted weft yarn by a cutter operable in a condition where a mispick has occurred, after the inserted weft yarn drawing step.

19. A method as claimed in claim 1, further comprising the step of rotating a main shaft of the loom so as to move the reed toward the side of the cloth fell so that the inserted weft yarn comes to the outside of an air guide channel, after the weft yarn inserting step, and thereafter moving the reed backward in a direction far from the cloth fell.

20. A method as claimed in claim 19, further comprising the step of reserving the weft yarn of a predetermined length in a weft measuring and reserving device located upstream of the weft inserting means, before the weft yarn inserting step.

21. A method as claimed in claim 20, wherein the predetermined length corresponds to about two weft pickings.

22. A method as claimed in claim 1, further comprising the step of operating an actuator for carrying out each of the loom operation stopping step, the mispicked weft yarn exposing step, the weft yarn inserting step and the inserted weft yarn drawing step, in response to both operating signal and step signal, the operating signal being produced to command the operation for the actuator in accordance with a program, the step signal being produced when the mispick actually occurs and being output at a timing at which the actuator is to be operated.

23. A method as claimed in claim 22, further comprising the step of confirming that the step signal is produced, before the actuator operating step.

24. A method as claimed in claim 22, wherein the step signal is produced in accordance with at least one of signals representing stopping of the loom, stopping of a main shaft, and starting preparation of the loom, and signals produced by detectors for detecting operating condition of the loom.

25. A method as claimed in claim 22, wherein the actuator operating step includes preventing the flow of the program from going to a required next step upon absence of the step signal.

26. A method as claimed in claim 25, further comprising the step of cutting the inserted weft yarn by a cutter operable in a condition where a mispick occurs, wherein the cutter is prevented from being put into its operative position to cut the inserted weft yarn in the absence of the step signal in which the reed is cable of becoming in a position to strike against the cutter.

27. A method as claimed in claim 25, further comprising the step of reserving the weft yarn of a predetermined length in a weft measuring and reserving device located upstream of a weft inserting nozzle by rotating an auxiliary motor before the weft yarn inserting step, the weft measuring and reserving device being of the type wherein the weft yarn is wound on a drum upon assistance of an engaging member engageable with the drum, wherein the step signal is produced in accordance with the operation of the engaging member, wherein the operation of the auxiliary motor is controlled in response to the step signal.

28. A system of removing a mispicked weft yarn in a loom provided with a main shaft and weft inserting means, comprising:

means for stopping operation of the loom in a state wherein the mispicked weft yarn is connected to the weft inserting means after the mispicked weft yarn is beaten up by a reed, when operated;

means for exposing the mispicked weft yarn at cloth fell of a woven cloth, when operated;

means for inserting a weft yarn connected to the mispicked weft yarn from a weft picking side to a counter-weft picking side of the loom, when operated; and means for drawing the inserted weft yarn together with the mispicked weft yarn to the counter-weft picking side, when operated.

29. A system as claimed in claim 28, further comprising means for producing a mispicked signal representative of occurrence of a mispick.

30. A system as claimed in claim 28, wherein said loom operation stopping means includes means for stopping the loom operation at a first predetermined angular position of a main shaft of the loom.

31. A system as claimed in claim 30, wherein said mispicked weft yarn exposing means includes means for reversely rotating the main shaft of the loom to a second predetermined angular position at which the mispicked weft yarn is in a condition to be inserted into an open shed of warp yarns.

32. A system as claimed in claim 31, wherein the second predetermined angular position is advanced 360 degrees relative to the first predetermined angular position.

33. A system as claimed in claim 28, wherein said loom operation stopping means includes means for putting a first cutter into an inoperative position where said first cutter is disabled, said first cutter being for cutting the weft yarn during normal weaving operation.

34. A system as claimed in claim 28, further comprising means for measuring and reserving the weft yarn of a predetermined length, located upstream of the weft inserting means.

35. A system as claimed in claim 34, wherein the predetermined length corresponds to about two weft pickings.

36. A system as claimed in claim 34, wherein the predetermined length is shorter than a length corresponding to two weft pickings.

37. A system as claimed in claim 28, wherein said weft inserting means includes a weft inserting nozzle located on the weft picking side to project the weft yarn to the counter-weft picking side through an air guide channel.

38. A system as claimed in claim 37, wherein said weft inserting means includes a plurality of auxiliary nozzles located along the air guide channel.

39. A system as claimed in claim 38, wherein said inserted weft yarn drawing means includes means for maintaining air ejection from said weft inserting nozzle and from said auxiliary nozzles for a predetermined time.

40. A system as claimed in claim 39, wherein the predetermined time is sufficiently long to peel off the mispicked weft yarn from the cloth fell.

41. A system as claimed in claim 28, wherein said weft yarn drawing means includes means for drawing the mispicked weft yarn under suction, located on the counter-weft picking side.

42. A system as claimed in claim 28, wherein said inserted weft yarn drawing means includes means for peeling off the mispicked weft yarn from the cloth fell.

43. A system as claimed in claim 42, further comprising means for putting the inserted weft yarn between a weft inserting nozzle and warp yarns in a tensed state after mispicked weft yarn is peeled off from the cloth fell, and a cutter for cutting the inserted weft yarn in the tensed state.

44. A system as claimed in claim 43, further comprising means for increasing length of the weft yarn sucked by traction means on the weft picking side after the inserted weft yarn is cut, said length increasing means including means for measuring and reserving the weft yarn of a predetermined length, and means for feeding the reserved weft yarn through said weft inserting nozzle into said traction means on the weft picking side.

45. A system as claimed in claim 28, further comprising a cutter for cutting the inserted weft yarn and means for putting said cutter into an operative position to cut the inserted weft yarn connected to the mispicked weft yarn.

46. A system as claimed in claim 28, further comprising means for rotating a main shaft of the loom so as to move the reed toward the side of the cloth fell so that the inserted weft yarn comes to the outside of an air guide channel, and moving the reed in a direction far from the cloth fell.

47. A system as claimed in claim 46, further comprising means for measuring and reserving the weft yarn of a predetermined length, located upstream of the weft inserting means.

48. A system as claimed in claim 47, wherein the predetermined length corresponds to about two weft pickings.

49. A system as claimed in claim 28, further comprising:

actuators each for operating one of said loom operation stopping means, said mispicked weft yarn exposing means, said weft yarn inserting means, and said inserted weft yarn drawing means, when receiving an operating signal;

operation commanding means for outputting the operating signal to said actuator upon necessity of operating one of said loom operation stopping means, said mispicked weft yarn exposing means, said weft yarn inserting means, and said inserted weft yarn drawing means;

operation-timing setting means for outputting a step signal at a predetermined timing upon confirming neccessity of operation of said actuator; and allowing means for allowing the operating signal from said operation commanding means to be transmitted to said actuator when receiving the step signal from said operation-timing setting means.

50. A system as claimed in claim 49, further comprising means for outputting a first signal representative of stopping of loom operation, a second signal representative of stopping of the main shaft of the loom, and a third signal representative of starting preparation of the loom.

51. A system as claimed in claim 50, further comprising detectors for detecting operational condition of the loom to output signals.

52. A system as claimed in claim 51, wherein said operation-timing setting means is arranged to output the step signal in response to the first, second, and third signals and the signals from said detectors.

53. A system as claimed in claim 49, wherein said operation-timing setting means is arranged to prevent the step signal from being output to the actuator for operating a cutter when the reed is in position to be strikable to the cutter, said cutter being for cutting the inserted weft yarn upon occurrence of a mispick.

54. A system as claimed in claim 49, wherein said weft measuring and reserving means includes a drum, a winding arm for winding the weft yarn on said drum by rotating an auxiliary motor, and an engaging member engageable with said drum and movable relative to said drum, and means for causing said operation-timing setting means to output the step signal in response to the movement of said engaging member, wherein the rotation of said auxiliary motor is controlled in response to the step signal.

* * * * *